US011712636B1

(12) United States Patent
Lee et al.

(10) Patent No.: US 11,712,636 B1
(45) Date of Patent: Aug. 1, 2023

(54) TRANSFORMABLE TOY

(71) Applicant: SPIN MASTER LTD., Toronto (CA)

(72) Inventors: Michael Lee, Torrance, CA (US); Evan Miller, Los Angeles, CA (US); Jaedon Tseng, Los Angeles, CA (US); Fujio Nobata, Tokyo (JP); Michitoshi Sugimoto, Tokyo (JP)

(73) Assignee: SPIN MASTER LTD., Toronto (CA)

( * ) Notice: Subject to any disclaimer, the term of this patent is extended or adjusted under 35 U.S.C. 154(b) by 0 days.

(21) Appl. No.: 17/887,383

(22) Filed: Aug. 12, 2022

(51) Int. Cl.
*A63H 33/00* (2006.01)
*A63H 7/00* (2006.01)
*A63H 17/26* (2006.01)

(52) U.S. Cl.
CPC ..... *A63H 33/003* (2013.01); *A63H 7/00* (2013.01)

(58) Field of Classification Search
CPC ..... A63H 17/00; A63H 17/02; A63H 17/26; A63H 33/00; A63H 33/003; A63H 33/26
USPC ..... 446/95, 233, 269, 321, 376, 383, 487
See application file for complete search history.

(56) References Cited

U.S. PATENT DOCUMENTS

| | | | |
|---|---|---|---|
| 152,250 | A | 6/1874 | Powers |
| 1,387,224 | A | 8/1921 | Ahler |
| 1,557,751 | A | 10/1925 | Winks |
| 1,610,724 | A | 12/1926 | Wilson |
| 1,879,013 | A | 9/1932 | Arnold |
| 1,985,716 | A | 12/1934 | Bueschel |
| 2,277,672 | A | 3/1942 | Stone |
| 2,584,789 | A | 2/1952 | Clark |
| 2,584,798 | A | 2/1952 | Goerditz |
| 2,809,062 | A | 10/1957 | Mainhardt |
| 2,968,121 | A | 1/1961 | Pearson |
| 2,987,852 | A | 6/1961 | Koch |
| 3,032,921 | A | 5/1962 | Greene |

(Continued)

FOREIGN PATENT DOCUMENTS

| | | | |
|---|---|---|---|
| CA | 1328474 | C | 4/1994 |
| CA | 2857579 | A1 | 6/2013 |

(Continued)

OTHER PUBLICATIONS

Tribunal Di Milano Filed by Choirock Contents Factory Co. Ltd. in Italy against EP Patent 1820548, Aug. 4, 2016.

(Continued)

*Primary Examiner* — Kien T Nguyen
(74) *Attorney, Agent, or Firm* — Aird & McBurney LP

(57) ABSTRACT

A transformable toy for use on a playing surface is provided. The transformable toy is formed to includes at least one movable housing element that will move from and expanded to a retracted position when a catch and a latch of the transformable toy are secured and released by an actuator of the transformable toy. The transformable toy is formed to roll about at least one rotation axis thereof, and in some embodiments, is also formed to be driven to spin about a spinning axis thereof. In some embodiments the transformable toy includes separably connectable top and bottom housing portions, and in some embodiments, different bottom housing portions can be exchanged on a particular top housing portion to provide different functionality to the transformable toy. The transformable toy can be driven to spin about the spinning axis by a shaft and flywheel mounted within the transformable toy.

24 Claims, 38 Drawing Sheets

(56) References Cited

U.S. PATENT DOCUMENTS 3,095,723 A 7/1963 Mcknight et al.
3,166,322 A 1/1965 Branneman
3,401,485 A 9/1968 Goodrum
3,411,237 A 11/1968 Crosman
3,520,078 A 7/1970 Klamer
3,589,059 A 6/1971 Caswell
3,626,961 A 12/1971 Quinones
3,684,292 A 8/1972 Penrod
3,687,452 A 8/1972 Thompson
3,831,986 A 8/1974 Kobayashi
4,030,239 A 6/1977 White
4,132,032 A 1/1979 Triska
4,326,235 A 4/1982 Hopkins
4,411,097 A 10/1983 Murakami
4,516,948 A 5/1985 Obara
4,571,199 A 2/1986 Murakami
4,575,348 A 3/1986 Wiggs et al.
4,581,904 A 4/1986 Lehmann et al.
4,605,381 A 8/1986 MacBain
4,605,383 A 8/1986 Horiuchi
4,606,618 A 8/1986 Geller
4,610,638 A 9/1986 Iwao
D287,258 S 12/1986 Maruyama
4,639,232 A 1/1987 Wang
4,674,990 A 6/1987 Ohno
4,687,459 A 8/1987 Lockett
4,696,656 A 9/1987 Torres et al.
4,698,043 A 10/1987 May et al.
4,708,687 A 11/1987 Goldberg et al.
4,773,889 A 9/1988 Rosenwinkel
4,817,936 A 4/1989 Matsuda
4,874,340 A 10/1989 Smallwood
4,891,995 A 1/1990 Lin
5,019,010 A 5/1991 Nikaido et al.
5,076,623 A 12/1991 Richards
5,090,935 A 2/1992 Monson
5,090,938 A 2/1992 Reynolds
5,098,327 A 3/1992 Ferrero
5,169,156 A 12/1992 Smollar
5,169,354 A 12/1992 Norton
5,188,405 A 2/1993 Maccaferri
5,209,345 A 5/1993 Haugabook
5,310,378 A 5/1994 Shannon
5,439,408 A 8/1995 Wilkinson
5,701,702 A 12/1997 Reid et al.
5,855,499 A 1/1999 Yamazaki et al.
5,893,789 A 4/1999 Wu
5,893,791 A 4/1999 Wilkinson
5,902,169 A 5/1999 Yamakawa
5,916,007 A 6/1999 Maxim
6,086,449 A 7/2000 Sharp
6,126,507 A 10/2000 Lieberman
6,203,393 B1 3/2001 Flynn
6,225,885 B1 5/2001 Lin
6,231,346 B1 5/2001 Sagi-Dolev
6,261,146 B1 7/2001 Spector
6,261,149 B1 7/2001 Moore
6,530,499 B1 3/2003 Coleman
6,572,436 B1 6/2003 So
6,592,427 B1 7/2003 Wilhelm et al.
6,638,136 B1 10/2003 Lee et al.
6,719,606 B1 4/2004 Mukensturm
6,752,679 B1 6/2004 Lui
6,761,612 B1 7/2004 Pencil et al.
7,297,042 B2 11/2007 Whitehead
7,306,504 B2 * 12/2007 Saucier ..... A63H 3/003 446/268
7,458,874 B2 12/2008 Rung et al.
7,731,563 B2 6/2010 Saucier
8,066,542 B2 11/2011 Ejima
8,500,353 B2 8/2013 Kim
8,500,508 B2 8/2013 Yamada
8,517,791 B2 8/2013 Yamada
8,777,689 B1 7/2014 Neal et al.
9,120,025 B2 9/2015 Hudson et al.
9,526,998 B2 12/2016 Hudson et al.
9,643,095 B2 * 5/2017 Choi ..... A63H 1/04
9,757,659 B2 9/2017 Hashemi et al.
9,868,073 B2 1/2018 Yamada et al.
9,975,058 B2 5/2018 Yamada et al.
10,434,400 B2 10/2019 Choi
10,507,398 B2 12/2019 Choi
10,561,957 B2 2/2020 Choi
10,646,790 B2 5/2020 Choi
10,695,687 B2 6/2020 Fernandez et al.
2002/0077024 A1 6/2002 Choi
2002/0098770 A1 7/2002 Mesch
2002/0098773 A1 7/2002 Hornsby et al.
2003/0016443 A1 1/2003 Shin
2003/0176146 A1 9/2003 Norman
2003/0176147 A1 9/2003 Krondorfer et al.
2004/0200434 A1 10/2004 Shatoff et al.
2005/0112988 A1 5/2005 Whitehead
2006/0009115 A1 1/2006 Saucier
2007/0167108 A1 * 7/2007 Hanamoto ..... A63H 3/46 446/321
2007/0197124 A1 8/2007 Sato et al.
2009/0233519 A1 9/2009 Ejima
2010/0291831 A1 11/2010 Yamada
2012/0058706 A1 3/2012 Hudson et al.
2012/0309262 A1 12/2012 Uehara
2012/0329365 A1 12/2012 Johnston
2014/0273724 A1 * 9/2014 Hoeting ..... A63H 11/06 446/308
2015/0050859 A1 2/2015 Choi
2016/0157461 A1 6/2016 Hill
2016/0168127 A1 6/2016 Hocutt
2016/0325191 A1 11/2016 Cai
2016/0361661 A1 12/2016 Tiefel
2017/0028305 A1 2/2017 Cai
2017/0189821 A1 7/2017 Cai
2018/0147502 A1 5/2018 Choi
2018/0169537 A1 6/2018 Choi
2018/0193760 A1 7/2018 Yamada et al.
2018/0311593 A1 11/2018 Choi
2018/0345158 A1 12/2018 Paul
2019/0168127 A1 6/2019 Fernandez
2019/0224582 A1 7/2019 Fernandez
2019/0236978 A1 8/2019 Falls
2020/0094157 A1 3/2020 Choi

FOREIGN PATENT DOCUMENTS

CA 2868116 A1 1/2015
CA 2878517 A1 1/2015
CA 2900133 A1 5/2015
CA 2889882 A1 7/2015
CA 2913660 A1 4/2016
CA 2950224 A1 4/2016
CA 2923104 A1 7/2016
CA 2944628 A1 12/2016
CA 2899674 C 4/2017
CA 2906265 C 6/2017
CA 2906247 C 7/2017
CA 2917006 C 7/2017
CA 2906252 C 9/2017
CN 2454000 Y 10/2001
CN 201147642 B 11/2008
CN 101970069 B 3/2013
EP 337960 A1 10/1989
FR 2314111 A1 1/1977
FR 2559072 A1 8/1985
GB 2123795 A 2/1984
GB 2184663 A 7/1987
GB 2217218 A 10/1989
IT TO2004000796 A 11/2004
JP 389155 Y2 5/1963
JP 57126289 U 8/1982
JP 58126893 U 8/1983
JP 58165881 A 9/1983
JP 58179191 U 11/1983
JP 5991984 A 5/1984
JP 60128693 U 8/1985
JP 60253480 A 12/1985

(56) References Cited

FOREIGN PATENT DOCUMENTS

| | | | |
|---|---|---|---|
| JP | 61115593 | U | 7/1986 |
| JP | 715701 | S | 7/1987 |
| JP | 715702 | S | 7/1987 |
| JP | 62111092 | U | 7/1987 |
| JP | S63122488 | U | 8/1988 |
| JP | 1112893 | U | 7/1989 |
| JP | 1-61797 | U | 11/1989 |
| JP | 6-160 | Y | 1/1994 |
| JP | 3001886 | U | 9/1994 |
| JP | 9322985 | A | 12/1997 |
| JP | 2003062359 | A | 3/2003 |
| JP | 2003190648 | A | 7/2003 |
| JP | 2003225457 | A | 8/2003 |
| JP | 3112866 | U | 8/2005 |
| JP | 5391084 | B2 | 1/2014 |
| KR | 102022167 | B1 | 9/2019 |
| WO | WO0156674 | A1 | 8/2001 |
| WO | 2006051417 | A2 | 5/2006 |
| WO | WO2011083313 | A1 | 7/2011 |

OTHER PUBLICATIONS

U.S. Appl. No. 10/889,488 File History dated Jul. 12, 2004 through Nov. 21, 2007.
U.S. Appl. No. 11/644,913 File History dated Dec. 22, 2006 through Nov. 8, 2010.
U.S. Appl. No. 11/944,126 File History dated Nov. 21, 2007 through May 19, 2010.
U.S. Appl. No. 12/821,890 File History dated Jun. 23, 2010 through Jul. 17, 2013.
U.S. Appl. No. 13/939,033 File History dated Jul. 10, 2013 through Mar. 24, 2016.
U.S. Appl. No. 17/362,981—NOA incl Notice of References cited issued Mar. 1, 2022.
*Choirock Contents Factory Co., Ltd.* v. *Spin Master Ltd.*, IPR No. IPR2019-00897, Final Written Decision dated Sep. 23, 2020.
*Choirock Contents Factory Co., Ltd.* v. *Spin Master Ltd.*, IPR No. IPR2019-00900, Final Written Decision dated Sep. 24, 2020.
*Choirock Contents Factory Co., Ltd.* v. *Spin Master Ltd.*, IPR No. IPR2019-00901, Final Written Decision dated Sep. 23, 2020.
*Spin Master Limited* v. *Alpha Animation & Toys Limited*, Claim No. HP-2018-000002, filed in European High Court of Justice Business and Property Court, Patents Court, Amended Grounds of Invalidity, Apr. 25, 2018, received Oct. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using Bandai Tackleboy and Thomas and Friends Grain Loader, served via Email Sep. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Thomas and Friends Grain Loader and U.S. Pat. No 6,592,427, served via Email Sep. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using U.S. Pat. No. 5,310,378 and Princess Magic Touch Candy Pendant, served via Email Sep. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Bandai Tackleboy and Princess Magic Touch Candy Pendant, served via Email Sep. 24, 2018.
English translation of 61115593.
English translation of 62111092.
English translation of 3001886.
English translation of 3112866.
JP Design Appln No. 2021-021624, Prior Art Notice & English translation, Feb. 8, 2022, Japan Patent Office.
English Translation of CN101970069.
English Translation of JP5391084.
EP21184776, Partial European Search Report, dated Feb. 9, 2022, European Patent Office.
U.S. Pat. No. 4,610,638, Certificate of Correction, Sep. 9, 1986, USPTO.
EP21184776, European Search Report, dated May 11, 2022, European Patent Office.
EP21184776, Communication Pursuant to Article 94(3) EPC, dated May 24, 2022, European Patent Office.
English translation of FR2559072.
English translation of FR2314111.
English translation of JP6-160Y2.
English translation of JP 1112893.
English translation of JP60253480.
English Translation of JP60128693.
English Translation of JP5991984.
English Translation of JP58179191.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Transformers Universe Swerve with Roadhandler and Princess Magic Touch Candy-Pendant, served via Email Sep. 24, 2018.
English translation of CN201147642.
English translation of CN2454000.
English Translation of JP58165881.
English Translation of JP58126893.
English Translation of JP57126289.
English Translation of JP38-9155.
English Translation of JP9322985.
English Translation of JPS63122488U.
English Translation of JP2003225457.
English Translation of JP2003190648.
English Translation of JP2003062359.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using U.S. Pat. No. 5,310,378 and Princess Magic Touch Candy Pendant, served via Email Sep. 24, 2018.
English translation of JP1-61797.
PCT Patent Application Serial No. PCT/JP2007/053082 Written Opinion dated May 15, 2007 (Annotated to show translation.
Petition for Inter Partes Review of U.S. Pat. No. 7,306,504, *Choirock Contents Factory Co., Ltd.* v. *Spin Master Ltd., et al.*, IPR No. IPR2017-00030, filed Oct. 7, 2016.
*Spin Master Limited* v. *Mattel Pty Ltd*, Case No. VID1167/2017, pending in Federal Court of Australia, Affidavit of Ian James Anderson filed Oct. 1, 2018.
*Spin Master Limited* v. *Mattel Pty Ltd*, Case No. VID1167/2017, pending in Federal Court of Australia, Affidavit of Isobel Sarah Taylor filed Oct. 1, 2018.
*Spin Master Limited* v. *Mattel Pty Ltd*, Case No. VID1167/2017, pending in Federal Court of Australia, First Affidavit of Nadia Maree Odorico filed Oct. 1, 2018.
*Spin Master Limited* v. *Mattel Pty Ltd*, Case No. VID1167/2017, pending in Federal Court of Australia, Second Affidavit of Nadia Maree Odorico filed Oct. 1, 2018.
*Spin Master Ltd.* v. *Alpha Group US LLC*, Case No. 18-cv-1046-RGK, pending in the United States District Court, Central District of California, Western Division, Answer, Affirmative Defenses, and Counterclaims, Apr. 4, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using Bandai Tackleboy, Thomas and Friends Grain Loader, and U.S. Pat. No. 6,592,427, served via Email Sep. 24, 2018.

(56) References Cited

OTHER PUBLICATIONS

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using Bandai Tackleboy and Princess Magic Touch Candy Pendant, served via Email Sep. 24, 2018.
*Spin Master Ltd.* v. *Mattel Canada Inc.*, Canadian Federal Court No. T-231-17, Statement of Defence and Counterclaim, dated Nov. 10, 2017.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using JP H06-00160 and Mattel Barbie Travelin House, served via Email Sep. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using JP Utility Model Application 38-9155, served via Email Sep. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using Transformers Cybertron Override and Princess Magic Touch Candy-Pendant, served via Email Sep. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using Transformers Universe Swerve with Roadhandler and Princess Magic Touch Candy-Pendant, served via Email Sep. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Bandai Tackleboy, Thomas and Friends Grain Loader, and U.S. Pat. No. 6,592,427, served via Email Sep. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Bandai Tackleboy and Thomas and Friends Grain Loader, served via Email Sep. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using JP H06-00160 and Mattel Barbie Travelin House, served via Email Sep. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using JP Utility Model Application 38-9155, served via Email Sep. 24, 2018.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Transformers Cybertron Override and Princess Magic Touch Candy-Pendant, served via Email Sep. 24, 2018.
English translation of ITTO2004000796 filed Nov. 12, 2004.
*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No 3,868,073 using Thomas and Friends Grain Loader and U.S. Pat. No. 6,592,427, served via Email Sep. 24, 2018.
1st Technical Brief filed in Tribunal Di Milano Filed by Choirock Contents Factory Co. Ltd. in Italy against EP Patent 1820548, filed Sep. 15, 2017, English Translation Attached.
Argos Catelog, Coleco Princess Magic Tough Beauty Salon, No. 30, p. 306, 1988.
Australian Patent Application No. 2007200737, Examiner's Report, dated May 26, 2010, IP Australia.
Australian Patent Application No. 2007200737, Response to Examiner's First Report, dated Sep. 26, 2011, Madderns Patent & Trademark Attorneys.
Australian Patent Application No. 2007200737, Notice of Acceptance, dated Oct. 13, 2011, IP Australia.
Bandai UK, Ltd, Power Rangers Zeo DeLuxe Transforming Spring Action Warrior Wheel, copyright 1996.
Canadian Patent Application No. 2,547,539, Office Action, dated Jan. 23, 2008, Canadian Intellectual Property Office.
Canadian Patent Application No. 2,547,539, Applicant's Reply to Office Action, dated Jul. 14, 2008, Moffat & Co.
Chinese Patent Application No. 200780006093, Office Action, dated Sep. 11, 2009, Chinese State Intellectual Property Office (SIPO).
Chinese Patent Application No. 200780006093, Office Action Response, dated Jan. 26, 2010, China Sinda Intellectual Property Limited.
Chinese Patent Application No. 200780006093, Notice of Grant, dated Jun. 3, 2010, Chinese State Intellectual Property Office (SIPO).
*Choirock Contents Factory Co. Ltd.* v. *Spin Master*, Court of Milan, Italy, No. 53599/2016 Re EP 1820548, Observation on the Court Expert's Draft Report, dated Nov. 29, 2017 (English Translation Attached).
*Choirock Contents Factory Co. Ltd.* v. *Spin Master*, Court of Milan, Italy, No. 53599/2016 Re EP 1820548; Draft Report by Court Appointed Expert dated Nov. 13, 2017, English Translation Attached.
*Choirock Contents Factory Co. Ltd.* v. *Spin Master*, Court of Milan, Italy, No. 53599/2016 Re EP 1820548; Second Technical Brief for Choirock Contents Factory Co. Ltd. dated Oct. 13, 2017, English Translation Attached.
*Choirock Contents Factory Co. Ltd.* v. *Spin Master*, Court of Milan, Italy, No. 53599/2016 Re EP 1820548; Second Technical Brief for Spin Master Ltd. dated Oct. 13, 2017, English Translation Attached.
*Choirock Contents Factory Co., Ltd.* v. *Spin Master Ltd., et al.*, IPR No. IPR2017-00030, filed Oct. 7, 2016, Final Written Decision dated Oct. 25, 2018.
European Patent Application No. 04256605.9, Search Report, dated Oct. 31, 2005, European Patent Office.
European Patent Application No. 04256605.9, Office Action, dated Aug. 23, 2006, European Patent Office.
European Patent Application No. 04256605.9, Applicant's Reply to Office Action, dated Jan. 31, 2007, Wilson Gunn.
European Patent Application No. 04256605.9, Office Action, dated Jun. 2, 2008, European Patent Office.
European Patent Application No. 04256605.9, Applicant's Reply to Office Action, dated Oct. 8, 2008, Wilson Gunn.
European Patent Application No. 04256605.9, Notice of Intention to Grant, dated Jun. 4, 2009, European Patent Office.
European Patent Application No. 07250653.8, Extended Search Report, dated Jun. 25, 2007, European Patent Office.
European Patent Application No. 07250653.8, Search Report, dated Mar. 7, 2008, European Patent Office.
European Patent Application No. 07250653.8, Applicant's Reply to Office Action, dated Jul. 16, 2008, Wilson Gunn.
European Patent Application No. 07250653.8, Office Action, dated May 5, 2009, European Patent Office.
European Patent Application No. 07250653.8, Applicant's Reply to Office Action, dated Aug. 6, 2009, Wilson Gunn.
European Patent Application No. 07250653.8, Notice of Intention to Grant, dated Oct. 9, 2009, European Patent Office.
Japanese Patent Application No. 2006041918, Notice of Refusal, dated Jun. 21, 2011, Japan Patent Office.
Japanese Patent Application No. 2006041918, Amendment, dated Aug. 5, 2011, Ohga, Shinji.
Japanese Patent Application No. 2006041918, Decision to Grant, dated Oct. 11, 2011, Japan Patent Office.
Japanese Patent Application No. 2008046476, Notice of Refusal, dated Feb. 1, 2011, Japan Patent Office.

(56) References Cited

OTHER PUBLICATIONS

Japanese Patent Application No. 2008046476, Amendment, dated Jul. 29, 2011, Shiga, Masatake.
Japanese Patent Application No. 2008046476, Notice of Refusal, dated Apr. 17, 2012, Japan Patent Office.
Japanese Patent Application No. 2008046476, Amendment, dated Jul. 12, 2012, Shiga, Masatake.
Japanese Patent Application No. 2008046476, Notice of Refusal, dated Feb. 26, 2013, Japan Patent Office.
Korean Patent Application No. 10-2008-7020342, Notice of Refusal, May 16, 2013, Korean Intellectual Property Office.
Korean Patent Application No. 10-2008-7020342, Written Reply, dated Aug. 16, 2013, Yeong-Uk Ha.
Korean Patent Application No. 10-2008-7020342, Notice of Refusal, dated Dec. 27, 2013, Korean Intellectual Property Office.
Korean Patent Application No. 10-2008-7020342, Written Reply, dated Mar. 27, 2014, Yeong-Uk Ha.
Korean Patent Application No. 10-2008-7020342, Grant of Patent, dated Jul. 30, 2014, Korean Intellectual Property Office.
*Mattel, Inc.* v. *Spin Master Ltd.*, Inter Partes Review IPR2018-01672 of U.S. Pat. No. 8,500,508, filed Sep. 7, 2018.
*Mattel, Inc.* v. *Spin Master Ltd.*, Inter Partes Review IPR2018-01673 of U.S. Pat. No. 9,868,073, filed Sep. 7, 2018.
*Mattel, Inc.* v. *Spin Master Ltd.*, Inter Partes Review IPR2018-01674 of U.S. Pat. No. 9,975,058, filed Sep. 7, 2018.
Mexican Patent Application No. MX/A/2008/010661, Office Action, dated Feb. 2, 2012, Mexican Institute of Industrial Property.
Mexican Patent Application No. MX/A/2008/010661, Response to Office Action, dated Apr. 25, 2012, De Hoyos Koloffon & Asociados.
Mexican Patent Application No. MX/A/2008/010661, Notice of Allowance, dated May 23, 2012, Mexican Institute of Industrial Property.
PCT Application No. PCT/JP2007/053082, International Search Report, dated May 15, 2007, Japanese Patent Office.

* cited by examiner

TRANSFORMABLE TOY

FIELD OF THE DISCLOSURE

The present disclosure relates generally to transformable toys capable of spinning like a spinning top. In particular, the disclosure relates to a transformable toy for use on a playing surface.

BACKGROUND OF THE DISCLOSURE

It is known within the art to provide transforming toys that can transform or change their shape between spherical-shaped and character-shaped positions. For example, Chinese Patent Application No. 2011/47642 teaches a transformable toy that includes a spherical outer shell with a pivot member that allows it to be moved between a sphere and a figurine position. In another example, U.S. Pat. No. 7,306,504 teaches a toy with a first movable, spherical member, a second movable, spherical member and a coupler positioned between and coupled to the first and second spherical movable members for transforming the toy from an open, figurine shape to a closed, spherical shape.

It is also known within the art to provide a spherically shaped toys with internal flywheel mechanisms that are driven by a ripcord, and which spin independently of the toy to drive a spinning motion of the toy. For example, U.S. Pat. No. 9,643,095 teaches a spinning top that includes an internal flywheel mechanism to act as a gyroscope. Similarly, reference WO 2011/083313 teaches a spinning toy with spherical housing and a flywheel mounted on an axis in the housing. There is an opening in the housing for "charging" of the flywheel via a charging device in order to drive a spinning motion of the toy.

It is an object of the present disclosure to provide a novel transformable toy.

SUMMARY OF THE DISCLOSURE

According to an aspect, there is provided a transformable toy comprising a top housing portion including a connector and at least one movable housing element that is movable between a retracted position and an expanded position, the at least one movable housing element being biased towards the expanded position and including a catch, the connector being separably connectable to one of a first bottom housing portion and a second bottom housing portion, each of the first bottom housing portion and the second bottom housing portion including an latch and an actuator connected to the latch, the latch being positioned within each of the first bottom housing portion and second bottom housing portion such that when the top housing portion is separably connected to one of the first and second bottom housing portions, and when the at least one movable housing element is moved to the retracted position, the latch engages the catch to retain the at least one movable housing element in the retracted position, the actuator being actuatable, when the at least one movable housing element is retained in the retracted position, to disengage the latch from the catch and release the at least one movable housing element, the second bottom housing portion including a driving element operably mounted within the second bottom housing portion to drive a motion thereof.

According to another aspect, there is provided a transformable toy comprising a top housing portion including a connector and at least one movable housing element that is movable between a retracted position and an expanded position, the at least one movable housing element being biased towards the expanded position and including an latch and an actuator connected to the latch, the connector being separably connectable to one of a first bottom housing portion and a second bottom housing portion, each of the first bottom housing portion and the second bottom housing portion including a catch positioned such that when the top housing portion is separably connected to one of the first and second bottom housing portions, and when the at least one movable housing element is moved to the retracted position, the latch engages the catch to retain the at least one movable housing element in the retracted position, the actuator being actuatable, when the at least one movable housing element is retained in the retracted position, to disengage the latch from the catch and release the at least one movable housing element, the second bottom housing portion including a driving element operably mounted within the second bottom housing portion to drive a motion thereof.

According to another aspect, there is provided a transformable toy for use on a playing surface, the transformable toy comprising a top housing portion including at least one movable housing element that is movable between a retracted position and an expanded position, the at least one movable housing element including a catch and being biased towards the expanded position, and a bottom housing portion separably connected to the top housing portion, and including an latch mounted therein and an actuator connected to the latch, the latch being positioned within the bottom housing such that when the at least one movable housing element is moved to the retracted position, the latch engages the catch to retain the at least one movable housing element in the retracted position, the actuator being actuatable when the at least one movable housing element is retained in the retracted position, to disengage the latch from the catch and release the at least one movable housing element, the top housing portion and the bottom housing portion each being shaped such that when the top housing portion and bottom housing portion are separably connected, and when the at least one movable housing element is in the retracted position, the transformable toy is rollable along the playing surface about at least one rotational axis of the transformable toy, and when the at least one movable housing element is in the expanded position, the at least one movable housing element inhibits rolling of the transformable toy about the at least one rotational axis.

According to an additional aspect, there is provided a transformable toy for use on a toy playing surface, the transformable toy comprising a toy housing, a shaft assembly including a shaft rotatably mounted along a central axis of the toy housing and a flywheel mounted to the shaft, the shaft defining a spinning axis of the transformable toy and the flywheel being chargeable to drive a spinning motion of the transformable toy about the spinning axis such that the transformable toy is in a spinning orientation, an access aperture for charging the flywheel, at least one movable housing element that is movable between a retracted position and an expanded position, the at least one movable housing element including a catch and being biased towards the expanded position, a latch being positioned within the toy housing such that when the at least one movable housing element is moved to the retracted position, the latch engages the catch to retain the at least one movable housing element in the retracted position, and an actuator connected to the latch and including an interaction element, the actuator being actuatable, when the at least one movable housing element is retained in the retracted position, to disengage the latch from the catch and release the at least one movable housing element, the actuator being positioned within the toy housing such that when the transformable toy is spinning at or below a set speed, the transformable toy will tip from the spinning orientation such that the interaction element of the actuator interacts with at least a portion of the toy playing surface and drives an actuation of the actuator to disengage the latch from the catch.

According to yet another aspect, there is provided a spinning toy kit comprising a transformable toy including at least one movable housing element that is movable between a retracted position and an expanded position, the at least one movable housing element including a catch and being biased towards the expanded position, an latch being positioned within the transformable toy such that when the at least one movable housing element is moved to the retracted position, the latch engages the catch to retain the at least one movable housing element in the retracted position, and an actuator connected to the latch and being actuatable, when the at least one movable housing element is retained in the retracted position, to disengage the latch from the catch and release the at least one movable housing element. The transformable toy including a shaft assembly including a shaft rotatably mounted within the toy housing and positioned along a central axis thereof, and a flywheel mounted to the shaft, the flywheel including a gear portion, an access aperture for accessing the flywheel, and ripcord cardholder including a cardholder body including a recess formed to receive and removably hold at least one playing card associated with the spinning toy, a ripcord member including a length of triangular teeth extending along at least a portion of at least one side thereof, the ripcord member being movably mounted to a side of the card holder body and being sized for insertion into the access aperture of the transformable toy such that the triangular teeth of the ripcord member engage with the gear portion of the flywheel for driving a spinning motion of the flywheel.

According to yet another aspect, there is provided a modular arena for use with a spinning toy that is driven to spin via a ripcord with a length of triangular teeth, the modular arena comprising an inwardly disposed portion defining a surface for the spinning toy, at least one outer wall portions being interchangeably connectable to the inwardly disposed portion, and being shaped to at least partially surround the inwardly disposed portion, and at least one contact actuator connected to the at least one outer wall portion, the at least one contact actuator including a driving portion that is shaped to interface with the length of triangular teeth of the ripcord, and an actuating portion extending over a part of the surface for the spinning toy, the actuating portion being connected to the driving portion such that an interfacing of the ripcord and the driving portion actuates the actuating portion over the surface such that the actuating portion contacts the spinning toy and alters at least one of a spin speed and a direction of the spinning toy.

According to yet another aspect, there is provided a transformable toy that includes a top housing portion including a connector and at least one movable housing element that is movable between a retracted position and an expanded position. The at least one movable housing element is biased towards the expanded position and includes a catch. The connector is separably connectable to each of a first bottom housing portion and a second bottom housing portion. Each of the first bottom housing portion and the second bottom housing portion includes a latch and an actuator connected to the latch. The latch is positioned within each of the first bottom housing portion and second bottom housing portion such that when the top housing portion is separably connected to one of the first and second bottom housing portions, and when the at least one movable housing element is moved to the retracted position, the latch engages the catch to retain the at least one movable housing element in the retracted position. When the at least one movable housing element is retained in the retracted position by the latch, the actuator is actuatable to disengage the latch from the catch and release the at least one movable housing element. The second bottom housing portion includes a driving element operably mounted within the second bottom housing portion for driving a motion of the second bottom housing portion and the top housing portion along a support surface. The first bottom housing portion either is devoid of any driving element for driving motion of the first bottom housing portion, or includes a driving element that is different than the driving element of the second bottom housing portion and is operably mounted within the first bottom housing portion for driving a motion of the first bottom housing portion and the top housing portion along the support surface.

In yet another aspect, a transformable toy is provided and includes a top housing portion including a connector and at least one movable housing element that is movable between a retracted position and an expanded position. The at least one movable housing element is biased towards the expanded position and includes a latch and an actuator connected to the latch. The connector is separably connectable to one of a first bottom housing portion and a second bottom housing portion. Each of the first bottom housing portion and the second bottom housing portion includes a catch positioned such that when the top housing portion is separably connected to one of the first and second bottom housing portions. When the at least one movable housing element is moved to the retracted position, the latch engages the catch to retain the at least one movable housing element in the retracted position. The actuator is actuatable, when the at least one movable housing element is retained in the retracted position, to disengage the latch from the catch and release the at least one movable housing element. The second bottom housing portion includes a driving element operably mounted within the second bottom housing portion to drive a motion thereof.

In yet another aspect, a transformable toy is provided for use on a playing surface. The transformable toy includes a top housing portion including at least one movable housing element that is movable between a retracted position and an expanded position. The at least one movable housing element includes a catch and being biased towards the expanded position. The transformable toy includes a bottom housing portion that is separably connected to the top housing portion. The bottom housing portion includes a latch mounted therein and an actuator connected to the latch. The latch is positioned within the bottom housing such that when the at least one movable housing element is moved to the retracted position. The latch engages the catch to retain the at least one movable housing element in the retracted position. The actuator is actuatable when the at least one movable housing element is retained in the retracted position to disengage the latch from the catch and release the at least one movable housing element. The top housing portion and the bottom housing portion each are shaped such that when the top housing portion and bottom housing portion are separably connected and when the at least one movable housing element is in the retracted position, the transformable toy is rollable along the playing surface about at least one rotational axis of the transformable toy, and when the at least one movable housing element is in the expanded position, the at least one movable housing element inhibits rolling of the transformable toy about the at least one rotational axis.

In yet another aspect, a transformable toy is provided for use on a toy playing surface. The transformable toy includes a toy housing, a shaft assembly, an access aperture, at least one movable housing element, a latch, and an actuator. The shaft assembly includes a shaft rotatably mounted along a central axis of the toy housing and a flywheel mounted to the shaft. The shaft defines a spinning axis of the transformable toy and the flywheel is chargeable to drive a spinning motion of the transformable toy about the spinning axis such that the transformable toy is in a spinning orientation. The access aperture is for charging the flywheel. The at least one movable housing element is movable between a retracted position and an expanded position. The at least one movable housing element includes a catch and being biased towards the expanded position. The latch is positioned within the toy housing such that when the at least one movable housing element is moved to the retracted position. The latch engages the catch to retain the at least one movable housing element in the retracted position. The actuator is connected to the latch and includes an interaction element. The actuator is actuatable, when the at least one movable housing element is retained in the retracted position, to disengage the latch from the catch and release the at least one movable housing element. The actuator is positioned within the toy housing such that when the transformable toy is spinning at or below a set speed, the transformable toy will tip from the spinning orientation such that the interaction element of the actuator interacts with at least a portion of the toy playing surface and drives an actuation of the actuator.

BRIEF DESCRIPTION OF THE DRAWINGS

Embodiments will now be described, by way of example only, with reference to the attached Figures, wherein.

DETAILED DESCRIPTION OF THE EMBODIMENTS

Figure 1A:
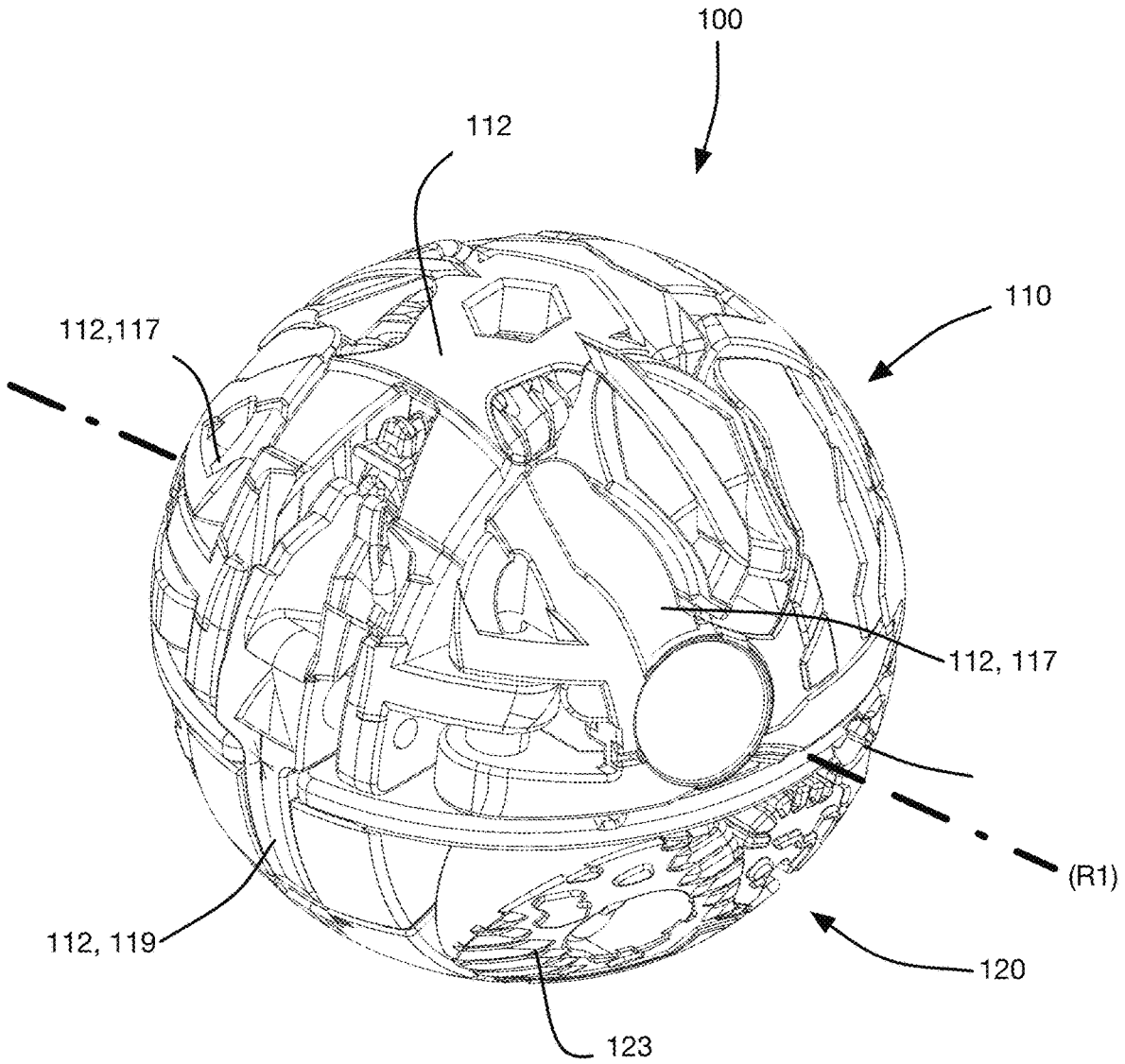
FIG. 1A shows an isometric view of an embodiment of the transformable toy including top and bottom housing portions, and movable housing elements in a retracted position.

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" or "an" will be understood to denote "at least one" in all instances unless explicitly stated otherwise or unless it would be understood to be obvious that it must mean "one".

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

The embodiments of the inventions described herein are exemplary (e.g., in terms of materials, shapes, dimensions, and constructional details) and do not limit by the claims appended hereto and any amendments made thereto. Persons skilled in the art will appreciate that there are yet more alternative implementations and modifications possible, and that the following examples are only illustrations of one or more implementations. The scope of the invention, therefore, is only to be limited by the claims appended hereto and any amendments made thereto.

Embodiment with Separate Top and Bottom Housing Portions:

In a first embodiment of the present disclosure shown in FIGS. 1A to 1H, there is provided a transformable toy 100 for use on a playing surface 102. The transformable toy 100 includes a top housing portion 110 and a bottom housing portion 120. The top housing portion 110 includes at least one movable housing element 112 that is movable between a retracted position (see FIGS. 1A and 1E) and an expanded position (see FIGS. 1B and 1G). The at least one movable housing element 112 includes a catch 112*a* and is biased towards the expanded position. The bottom housing portion 120 is separably connected to the top housing portion 110, and includes a latch 130 mounted therein, and an actuator 140 connected to the latch 130. The latch 130 is positioned within the bottom housing such that when the at least one movable housing element 112 is moved to the retracted position, the latch 130 engages the catch 112*a* to retain the at least one movable housing element 112 in the retracted position. The actuator 140 is actuatable when the at least one movable housing element 112 is retained in the retracted position, for disengaging the latch 130 from the catch 112*a* and releasing the at least one movable housing element 112.

The top housing portion 110 and the bottom housing portion 120 are each shaped to be separated (see FIGS. 10 and 1H), and are also shaped such that when the top housing portion 110 and bottom housing portion 120 are separably connected, and when the at least one movable housing element 112 is in the retracted position, the transformable toy 100 is rollable along the playing surface 102 about at least one rotational axis (R1) of the transformable toy 100. Conversely, when the top housing portion 110 and bottom housing portion 120 are separably connected and the at least one movable housing element 112 is in the expanded position, the at least one movable housing element 112 inhibits rolling of the transformable toy 100 about the at least one rotational axis (R1).

In an embodiment of the transformable toy 100 (shown in FIGS. 1A and 1H) a shape of the bottom housing portion 120 is substantially hemispherical and a shape of the top housing portion 110 when the at least one movable housing element 112 is in the retracted position is substantially hemispherical. The movement of the at least one movable housing elements 112 from the expanded to the retracted position results in the shape of the top housing portion 110 becoming substantially hemispherical. In this way, when the hemispherical top portion is connected to the bottom housing portion 120, the collective form of the transformable toy 100 is spherical (see FIGS. 1A and 1E).

Referring to the specific embodiment provided in FIGS. 10, a first embodiment of the transformable toy 100 includes the top housing portion 110 and bottom housing portion 120 which are separably connected together. The top housing portion 110 is hemispherical-shaped, having a curved top portion and a flat face formed as a bottom end thereof. The bottom housing portion 120 is also hemispherical-shaped, having a curved bottom portion and a generally flat face formed as a top end of the bottom housing portion 120.

As presented above, the transformable toy 100 includes the top housing portion 110, where the top housing portion 110 includes at least one movable housing element 112 that is movable between retracted and expanded positions. In an embodiment (such as the embodiments provided in FIGS. 1B), the top housing portion 110 includes a top housing body 114 to which the at least one movable housing element 112 is pivotably mounted.

In an embodiment, each of the at least one movable housing element 112 is mounted on a shaft 113 to define a pivot axis of the at least one movable housing element 112 for pivoting between the retracted and expanded positions. In a further embodiment, the at least one movable housing element 112 includes a spring 115 connected about the shaft 113 that defines the pivot axis. The spring 115 is positioned to bias the at least one movable housing element 112 towards the expanded position by applying a force which turns the at least one movable housing element 112 about the shaft 113. The spring 115 may be any suitable type of spring, such as a torsion spring that has a first end mounted to an element of the housing body 114 and a second end engaged with the at least one movable housing element 112.

Figure 1B:
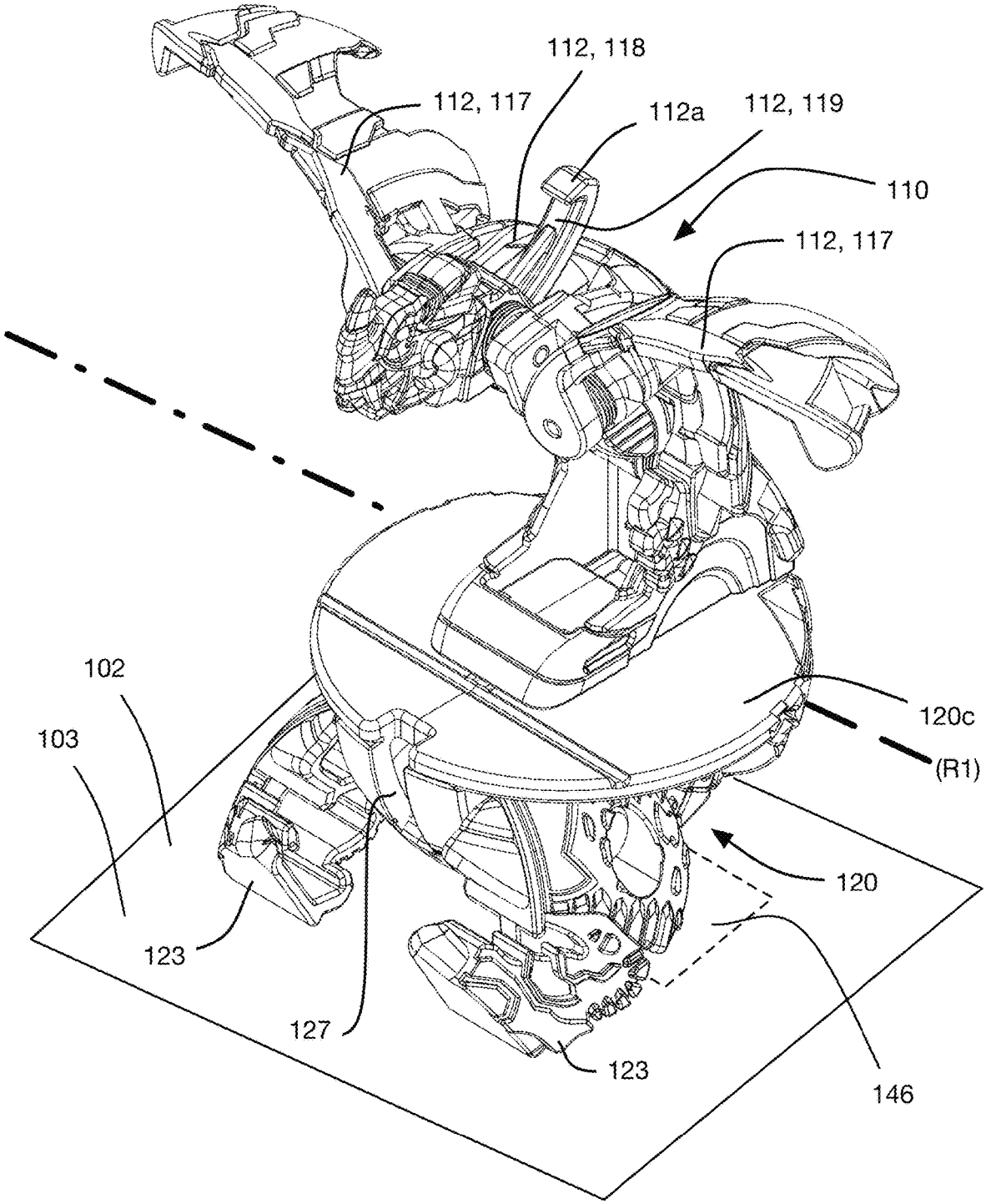
FIG. 1B shows an isometric view of the embodiment of the transformable toy of FIG. 1A, wherein the movable housing elements are in an expanded position.
Figure 1C:
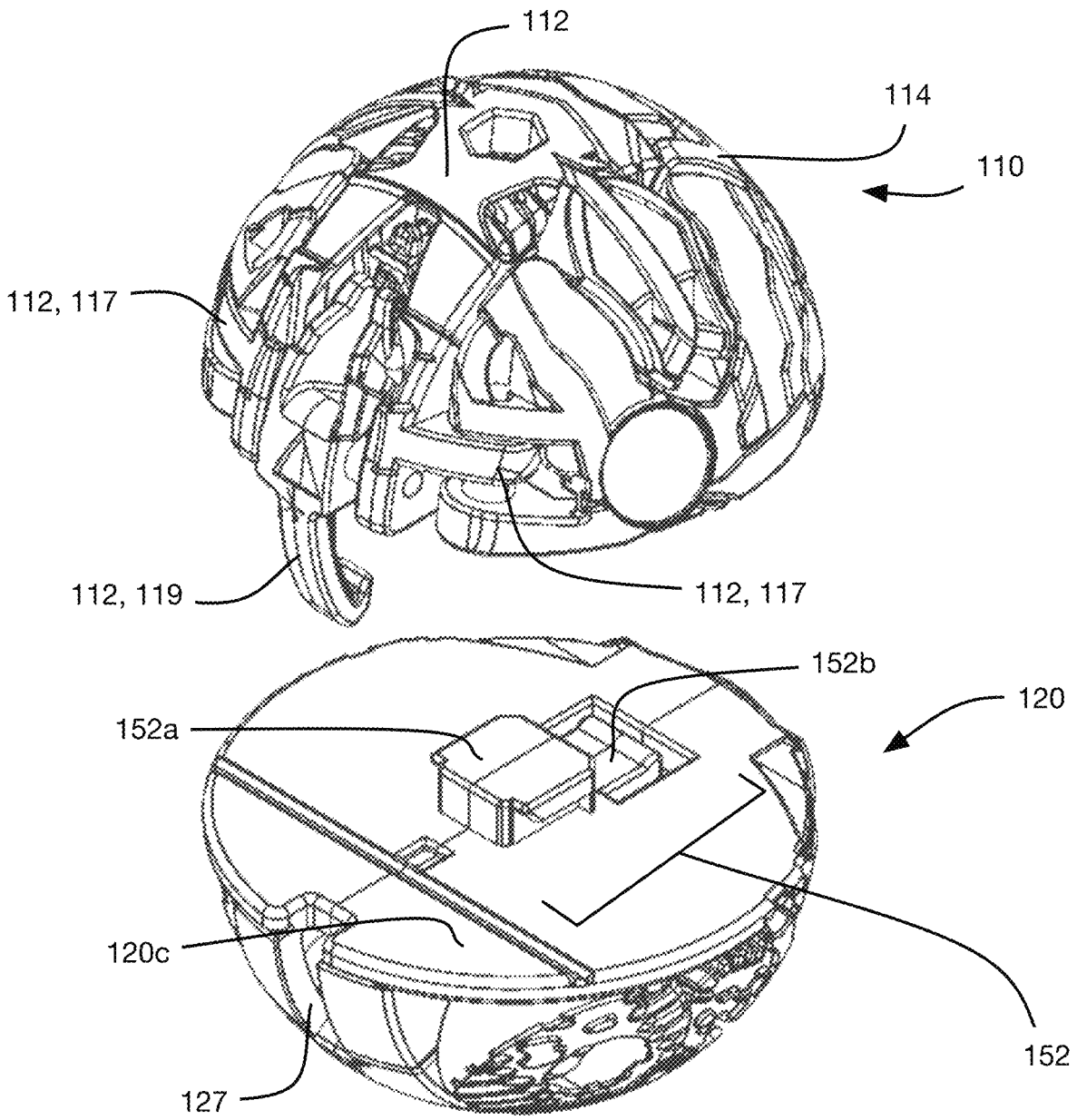
FIG. 1C shows a perspective exploded view of the embodiment of the transformable toy of FIG. 1A, showing separated top and bottom housing portions.
Figure 1D:
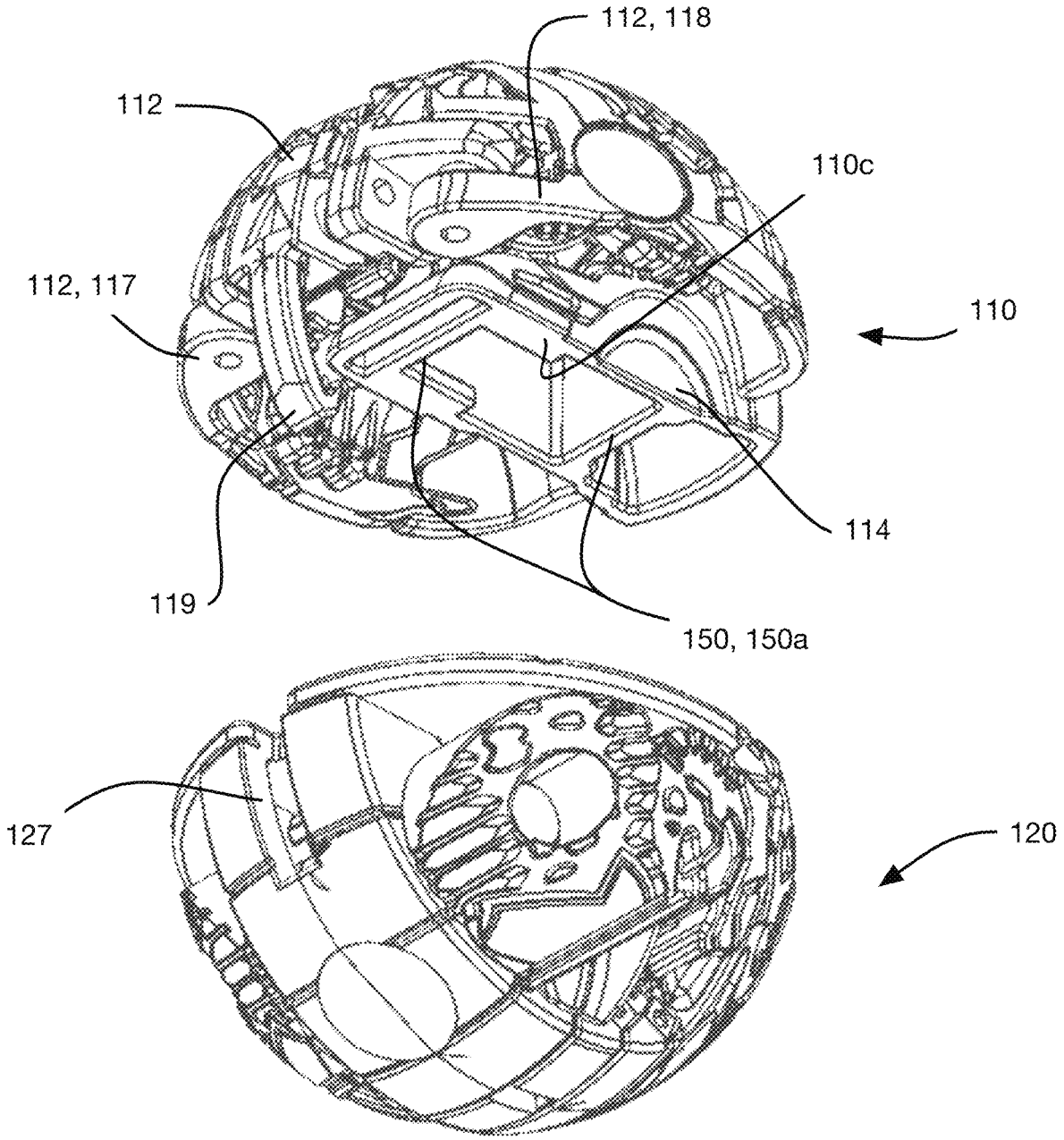
FIG. 1D shows another perspective exploded view of the embodiment of the transformable toy of FIG. 1A, showing the separated top and bottom housing portions.
Figure 1E:
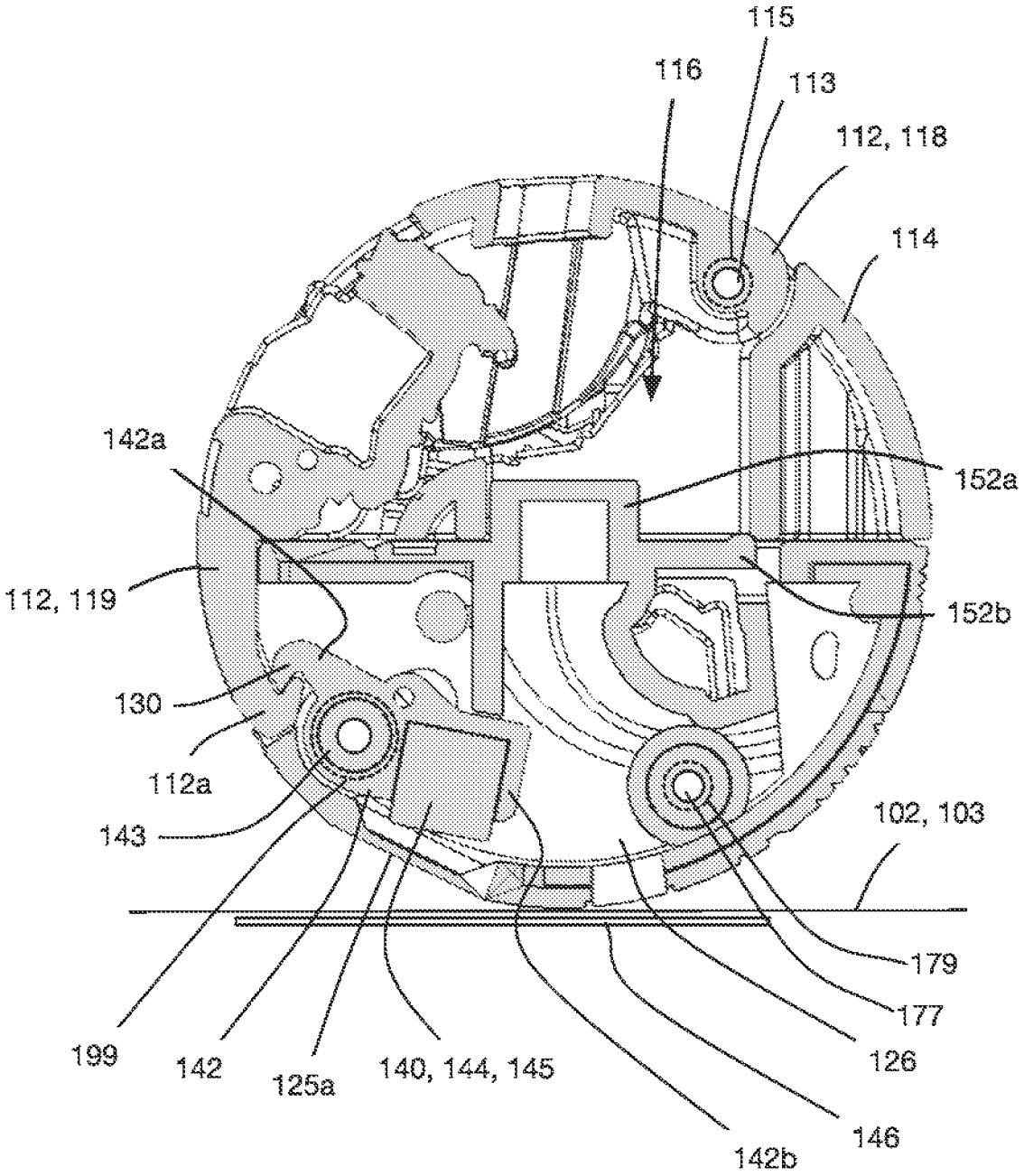
FIG. 1E shows a sectional view of the embodiment of the transformable toy of FIG. 1A, showing the movable housing elements in a retracted position.
Figure 1F:
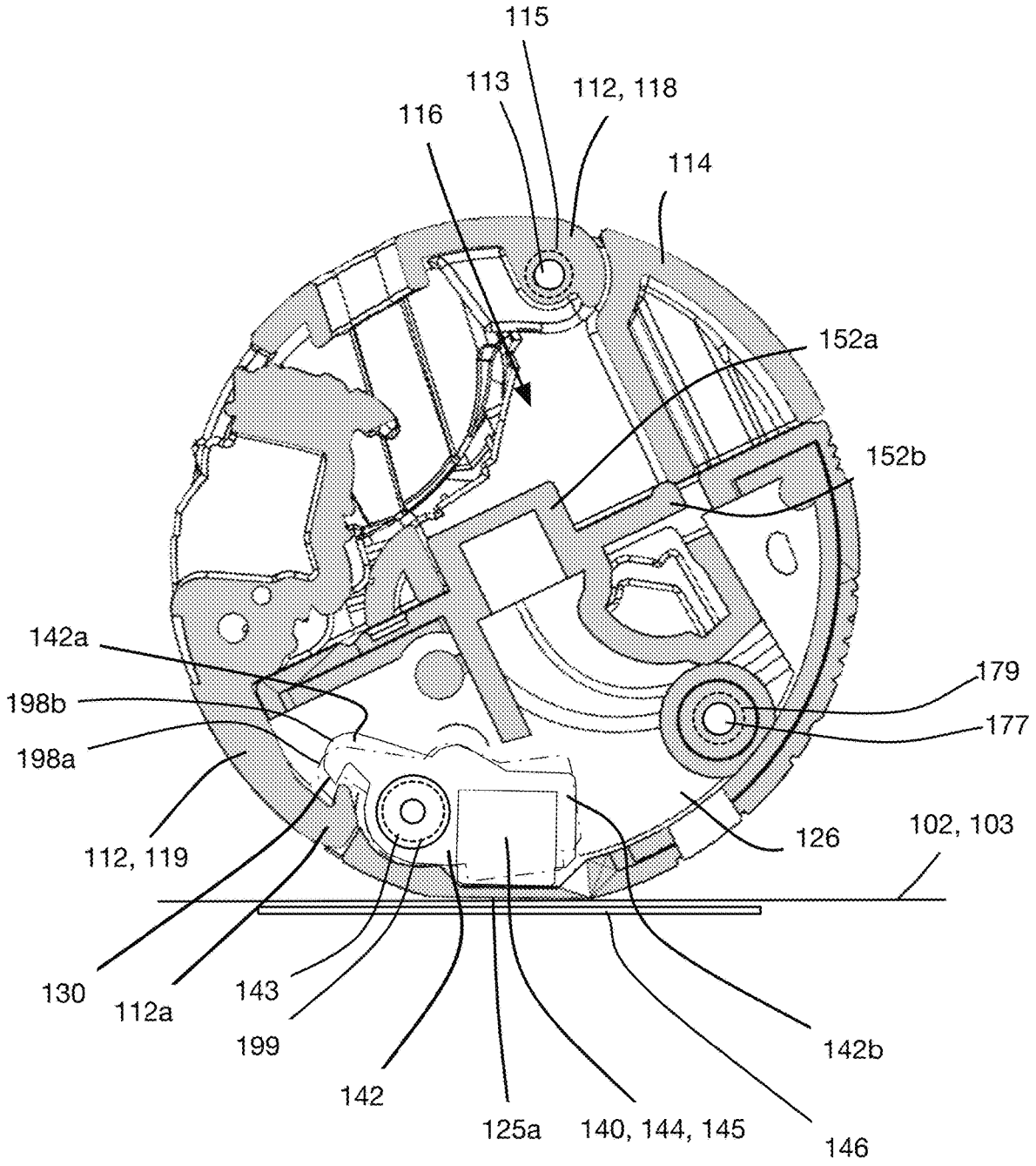
FIG. 1F shows a sectional view of the embodiment of the transformable toy of FIG. 1A, showing an interaction element being actuated.
Figure 1G:
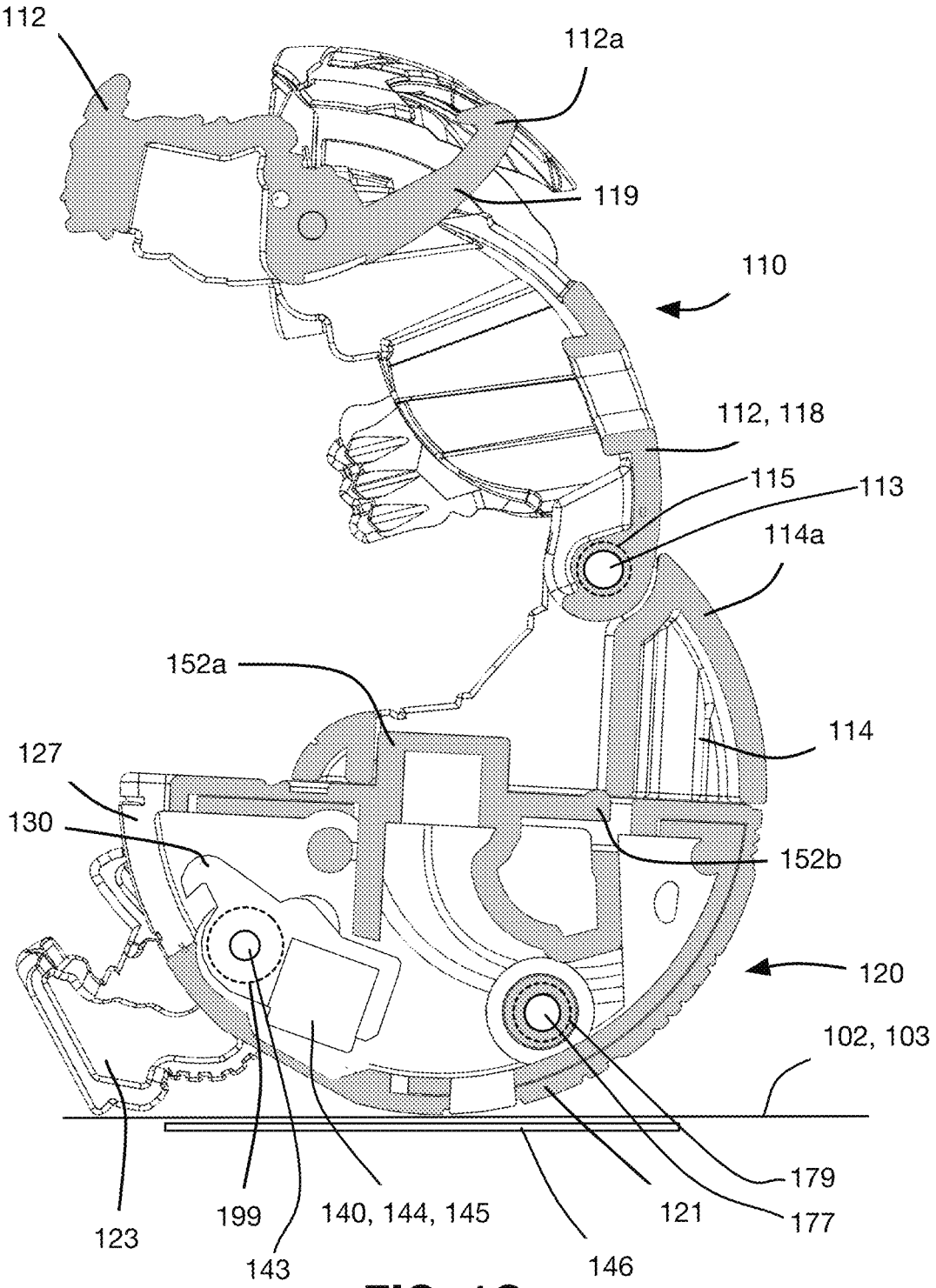
FIG. 1G shows a sectional view of the embodiment of the transformable toy of FIG. 1A, showing the movable housing elements in an expanded position.
Figure 1H:
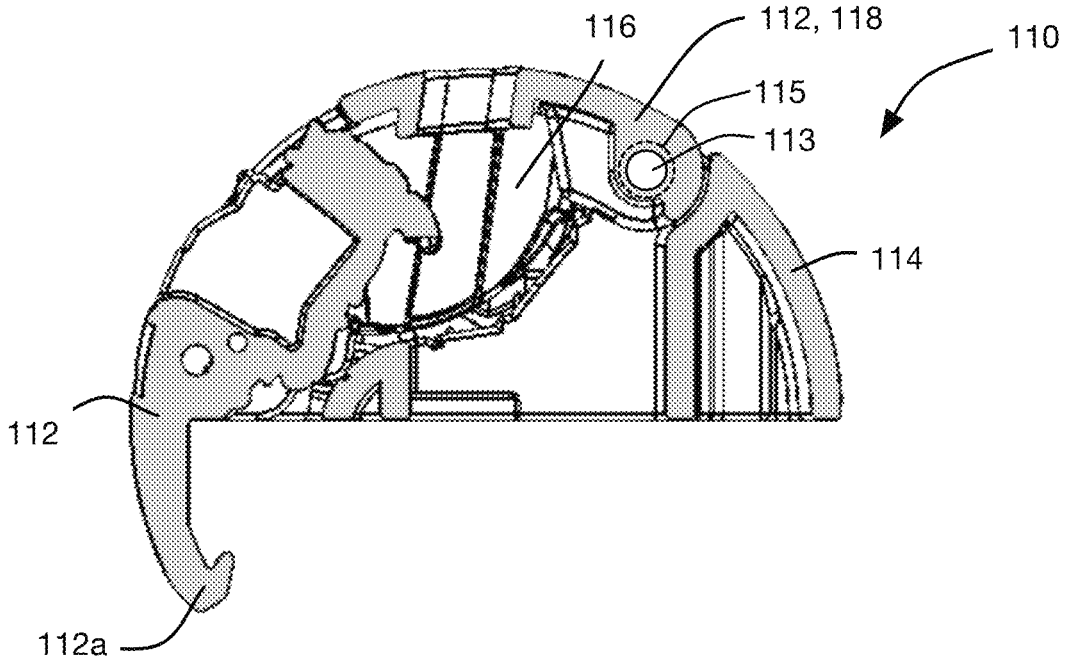
FIG. 1H shows a sectional exploded view of the embodiment of the transformable toy of FIG. 1A.
Figure 1H:
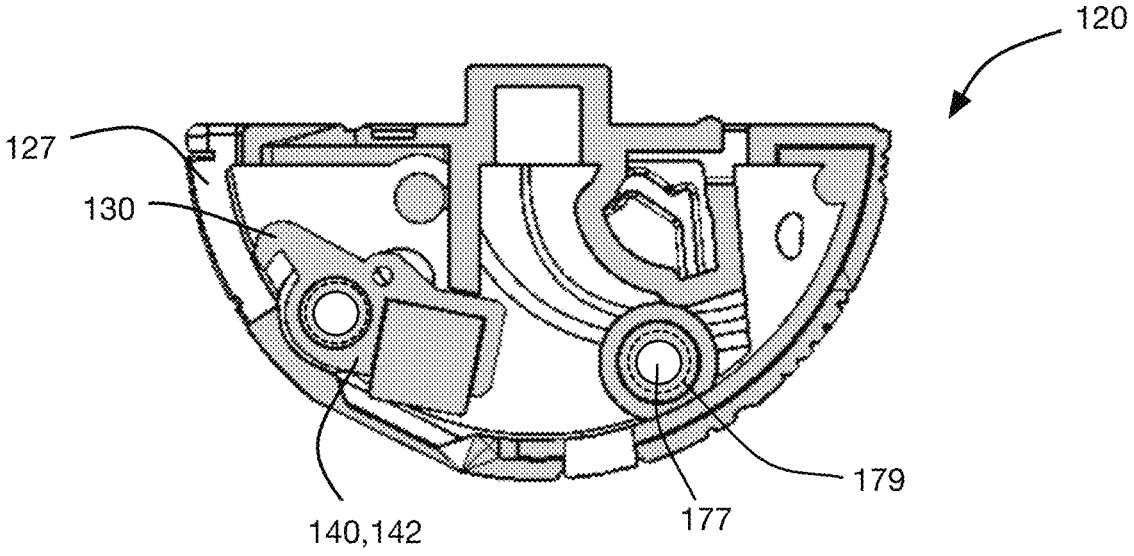

In an embodiment, the at least one movable housing element 112 is at least one pair of movable housing elements that are pivotably connected to the top housing body 114 so as to pivot between retracted positions in which the pair of movable housing elements 112 are disposed close to the top housing body 114, and expanded positions where the movable housing elements 112 are disposed away from the top housing body 114 (see FIGS. 1B and 1H).

In the specific embodiments provided in FIGS. 1A to 1H, the hemispherical-shaped top housing portion 110 includes the top housing body 114, where a side region 114*a* of the top housing body 114 is formed with an at least partial dome shape, as if it were a section of a sphere that has been cut off. A hollow cavity 116 is defined within the top housing portion 110 when the at least one movable housing element 112 is in the retracted position. The at least one movable housing element 112 includes a central movable housing element 118. The central movable housing element 118 is mounted onto an upper central portion of the top housing body 114 such that the central housing element 118 is pivotable relative to the top housing body 114. The central movable housing element 118 of the exterior structure is an approximately circular, arc-shaped component that has a thin profile to define portions of an exterior surface of the top housing portion 110. An exterior surface of the at least one movable housing elements 112 constitutes one section of the spherical shape of the transformable toy 100. In the same embodiment, the at least one pair of movable housing elements 112 include lateral movable housing elements 117 that are pivotably mounted onto upper left and right lateral portions of the top housing body 114. In the same embodiments, the at least one movable housing element 112 also includes a horn element 119 that is pivotably mounted to the top housing body 114 for movement between a retracted and expanded position. The horn element 119 has an arc-shaped member with a sharply curved end. As shown in FIG. 1A, when in its retracted position, the horn element 119 is disposed between the central movable housing elements 118 and is pivotably mounted to the top housing body 114.

In an embodiment, the horn element is connected to the central housing element 118 to pivot thereabout. In an additional embodiment, the catch 112*a* of the top housing portion 110 that is retained by the latch 130 of the bottom housing portion 120 is defined by the sharply curved end of the horn element 119.

It can be said generally that the at least one movable housing element 112 is provided for transforming the transformable toy 100 from a rollable, spherical form (as presented in FIG. 1A) to a character form (as presented in FIG. 1B) that symbolizes a "dragon" or any other suitable character.

As presented above, the transformable toy 100 includes the bottom housing portion 120. In the above-noted embodiments where the bottom housing portion 120 has a hemispherical shape, the housing of the bottom housing portion 120 defines the spherical portion of the hemisphere, and a hollow cavity 126 is formed within the bottom housing portion 120.

In an embodiment, the bottom housing portion 120 of the first embodiment of the transformable toy 100 includes the latch 130 mounted within the bottom housing portion 120, and an actuator 140. The latch 130 is movable to a latched position (FIG. 1E) in which the latch 130 is positioned to retain the catch 112*a* of the at least one movable housing element 112 when the at least one movable housing element 112 is moved to the retracted position. The latch 130 is movable to a release position (FIG. 1F) in which the latch 130 is positioned to release the catch 112*a* of the at least one movable housing element 112.

The actuator 140 is movable to drive the latch 130 between the latched and release positions, in order to retain or release the catch 112*a* of the at least one movable housing element 112.

In the specific embodiment provided in FIGS. 1B and 10, an exterior surface 120*a* of the bottom housing portion 120 includes a through-hole 127. This through-hole 127 is positioned in the bottom housing portion 120 and extends into the hollow cavity 126 of the bottom housing portion such that when the at least one movable housing element 112 moves from the expanded to the retracted position, the catch 112*a* of the at least one movable housing element 112 is received in the through-hole 127 to engage with the latch 130 in the bottom housing portion 120.

In the specific embodiment of FIGS. 1A to 1H, the catch 112*a* is formed as part of the horn element 119, and the through-hole 127 is positioned on a front side of the bottom housing portion 120 to receive the catch 112*a*.

In an embodiment, the top and bottom housing portions 110, 120 each include at least one connector 150, 152 that interfaces with the connector 150, 152 of the other housing portion for separably connecting the top and bottom housing portions 110, 120 together. In the specific embodiment provided in FIGS. 10 and 1D the connector 152 of the bottom housing portion 120 includes a projection 152*a* that extends upwards from a flat face 120*c* of the bottom housing portion 120, and a flexible tab 152*b*. The flexible tab 152*b* includes a substantially planar portion that extends parallel to the flat face 120*c* of the bottom housing portion 120 and a tab portion that projects upwards from the planar portion. A gap is defined between the flat face 120*c* and three sides of the flexible tab 152*b* such that the flexible tab 152*b* can be bent relative to the flat face 120*c*. In the same embodiment, the connector 150 of the top housing portion 110 is a connecting aperture 150*a* that extends into the hollow cavity 116 of the top housing portion 110, where the connecting aperture 150*a* is sized and shaped to receive the projection 152*a* and flexible tab 152*b* from the bottom housing portion 120.

For inserting the projection 152*a* and flexible tab 152*b* into the connecting aperture 150*a* (to connect the top and bottom housing portions 110, 120), the top housing portion 110 is tilted at an angle and a flat face 110*c* of the top housing portion 110 is advanced transversely along the flat face 120*c* of the bottom housing portion 120 until the flexible tab 152*b* is bent into and is received by the connecting aperture 150*a*. Once the flexible tab 152*b* is securely received in the connecting aperture 150*a*, the top housing portion 110 is tilted down such that the projection 152*a* is received in the connecting aperture 150*a* of the top housing portion 110. The top and bottom housing portions 110, 120 are brought together until the flat faces 110*c*, 120*c* of each housing portion are in solid contact. In this separably connected state, the flexible tab 152*b* inhibits the separation of the flat faces 110*c*, 120*c* of the top and bottom housing portions 110, 120, while the projection 152*a* prevents relative, side-to-side motion of the top housing portion 110 and bottom housing portion 120.

In the embodiment shown in FIGS. 1E, 1F, 1G and 1H the latch 130 and actuator 140 are both mounted on a pivot member 142. In the embodiment shown, the pivot member 142 has first and second free ends 142*a*, 142*b*, and is pivotally mounted within the hollow cavity 126 of the bottom housing portion 120 to pivot relative to the bottom housing portion 120.

In the embodiment shown, the latch 130 is mounted at the first free end 142*a* of the pivot member 142, and the actuator 140 is mounted at the second free end 142*b*. In this embodiment, the pivot member 142 is mounted on a shaft 143 to define a pivot axis of the pivot member 142. The pivot member 142 is pivotable about the pivot axis between a latched position shown in FIG. 1E and a release position shown in FIG. 1F. In a further embodiment, the pivot member 142 includes a spring 199 connected about the shaft 143 that defines the pivot axis. The spring 199 is positioned to bias the pivot member 142 towards the latched position by applying a force which turns the pivot member 142 about the shaft 143. The spring 199 may be any suitable type of spring, such as a torsion spring that has a first end mounted to an element of the bottom housing portion 120 and a second end engaged with the pivot member 142.

In an additional embodiment, the actuator 140 includes an interaction element 144, which is positioned to interact with an object that is external to the transformable toy 100 in order to drive movement of the latch 130. In an embodiment, the interaction member is a first magnetically responsive element 145 that is positioned for interacting with a second magnetically responsive member 146 (FIG. 1B) that is external to the transformable toy 100. For all embodiments described in the present disclosure, a magnetically responsive member is a member that is urged to move, either by attraction or repulsion, by the presence of a magnetic field. A magnetically responsive member may be any suitable type of member, such as, for example, a magnet, or a ferromagnetic member (such as a piece of carbon steel). In all of the embodiments described in the present disclosure, at least one of the first and second magnetically responsive elements is a magnet, while the other of the first and second magnetically responsive elements is an element that is attracted to a magnet, such as another magnet, or an element that is ferromagnetic, paramagnetic or that exhibits any other suitable type of magnetism.

Thus, in the embodiment shown in FIGS. 1E, 1F, 1G and 1H, at least one of the first and second magnetically responsive elements 145, 146 is a magnet. The other of the first and second magnetically responsive elements 145, 146 may be a magnet or may be some other type of magnetically responsive member such as the aforementioned piece of carbon steel.

Interaction of the first magnetically responsive element 145 with the second magnetically responsive member 146 causes actuation of the actuator 140. As the transformable toy 100 is rolled along the support surface 102, if the transformable toy 100 reaches a selected orientation as shown in FIG. 1F when rolling over the second magnetically responsive element 146, the first magnetically responsive element 145 is positioned within sufficiently close proximity to the second magnetically responsive element 146 to cause actuation of the first magnetically responsive element 145, moving the first magnetically responsive element 145 from the position shown at 198*a* (in broken lines), to the position shown at 198*b* (in solid lines).

In a specific embodiment (shown in FIGS. 1A to 1H) the first magnetically responsive element 145 is a magnet and the second magnetically responsive element 146 is a strip of a magnetizable steel, such as carbon steel, that is included in a toy support member 103 (FIG. 1B). The toy support member 103 may be a card or the like, or any other suitable support member, and defines the toy playing surface 102. As shown in FIG. 1E, the magnet is mounted on a lower section of the second free end 142*b* of the pivot member 142, while the other end of the pivot member 142 has the latch 130 mounted thereon. The magnet is mounted such that it projects slightly out from the aperture in which it is retained, and faces substantially downwards on the pivot member 142.

In a further embodiment where the interaction element 144 is the first magnetically responsive element 145, the bottom housing portion 120 may include a thin-wall portion 125*a*. The thin-wall portion 125*a* is formed on a lower section of the hemispherical form of the bottom housing portion 120. The thin-wall portion 125*a* is shaped with a thickness such that the second magnetically responsive member 146 can act on, and attract the first magnetically responsive element 145 of the pivot member 142 through the thin-wall portion 125*a*. The thin-wall portion 125*a* is positioned along the bottom housing portion 120 such that when the pivot member 142 is in an unactuated position, the first magnetically responsive element 145 is spaced apart from the thin-wall portion 125*a*, and when the second magnetically responsive element is brought into proximity to the thin-wall portion 125*a* on the outside of the transformable toy 100, the first magnetically responsive element 145 is attracted to the second magnetically responsive element 146 and moves towards it, driving the pivot member 142 to move from the unactuated to an actuated position, thereby moving the latch 130 from the latching position to the release position.

In an alternate embodiment, the bottom housing portion 120 includes an aperture in place of the thin-wall portion 125*a*. In this embodiment, the first magnetically responsive element 145 of the pivot member 142 will be attracted to the second magnetically responsive element 146 without there being any part of the bottom housing portion 120 between them.

Providing either the thin-wall portion 125*a*, or the aforementioned aperture permits the first magnetically responsive element 145 to be positioned closer to the second magnetically responsive element 146 when the pivot member 142 is in the unactuated position, then would be possible if the wall of the bottom housing portion 120 did not have the thin-wall portion 125*a* or the aperture. This may, in some embodiments, increase the distance that the transformable toy 100 can be from the second magnetically responsive element 146 while still applying a sufficiently strong attractive force on the second magnetically responsive element 146 to drive movement of the first magnetically responsive element 145 thereby moving the latch 130 to the release position.

In an embodiment of the transformable toy 100, the "transforming" features of the transformable toy 100 are defined in both the top housing portion 110 and the bottom housing portion 120. In this embodiment, the at least one movable housing element 112, as presented above, defines at least one top movable housing element. The bottom housing portion 120 includes at least one bottom movable housing element 123 that is movable between a retracted position (see FIG. 1A) and an expanded position (see FIG. 1B). The at least one bottom movable housing element 123 is biased towards the expanded position. The latch 130 may be operatively connected to the at least one bottom movable housing element 123 in some embodiments, in the sense that. when the latch 130 engages the catch 112*a* of the top movable housing portion 112, the latch 130 also retains the at least one bottom movable housing element 123 in the retracted position. In this way, the actuator 140 may be said to be actuatable to disengage the latch 130 from the catch 112*a*, which in turn releases the at least one bottom movable housing element 123.

In the specific embodiment provided in FIG. 1B, the bottom housing portion 120 includes a bottom housing body 121 to which the at least one bottom movable housing element 123 is pivotably mounted. An exterior surface of the bottom housing body 121 has a slight dome shape, as if it were a section of a sphere that has been cut off, and the exterior surface thereof constitutes one section of the spherical shape. In the same embodiments of FIG. 1B, the at least one bottom movable housing element 123 is two bottom movable housing elements that are pivotably mounted on opposing sides of the bottom housing body 121. In this way, the two bottom movable housing elements 123 form "leg" components of the character represented by the transformable toy 100, when the elements 123 are in an expanded position.

In an embodiment, the at least one bottom movable housing element 123 may be biased towards the exposed position by a spring 179. The spring 179 may be any suitable type of spring such as a torsion spring mounted about a shaft 177 that defines a pivot axis of the at least one bottom movable housing element 123. The spring 179 is positioned to bias the at least one bottom movable housing element 123 towards the exposed position by applying a force which pivots the at least bottom movable housing element 123 about the shaft 177 towards the exposed position.

It will be noted that, when the bottom movable housing elements 123 move to their expanded positions, they may push the transformable toy 100 so as to space the first magnetically responsive element 145 away from the second magnetically responsive element 146, as shown in FIG. 1G. As a result, the transformable toy 100 may be positioned such that the first magnetically responsive element 145 is sufficiently spaced apart from the second magnetically responsive element 146 that the card 103 is not magnetically adhered to the transformable toy 100. Among other benefits, this may permit the transformable toy 100 to be picked up by the user without the card 103 adhering to it due to magnetic attraction.

Embodiments of Spinning Transformable Toy:

In several embodiments of the transformable toy which are described in greater detail below (including transformable toy 200*a*, transformable toy 200*b*, transformable toy 400 and transformable toy 500) the transformable toy 200*a*, 200*b*, 400, 500 is formed to be spun via a flywheel or similar driving element, about a spinning axis S1 of the transformable toy 200*a*, 200*b*, 400, 500, on a playing surface 300. Referring to FIGS. 3A and 3F, in the embodiments where the transformable toy 200*a*, 200*b*, 400, 500 is driven to spin about the spinning axis S1, the transformable toy 200*a*, 200*b*, 400, 500 can be said to be in a spinning orientation. This spinning orientation can be defined where the transformable toy 200*a*, 200*b*, 400, 500 is spinning in an upright position such that the spinning axis S1 is substantially vertical (see FIGS. 3A and 3E).

Referring to FIGS. 3A to 3D, the combined spinning and transforming motion will now be described. As the transformable toy 200*a*, 200*b*, 400, 500 is driven to spin by the flywheel or similar driving element, a spin speed of the transformable toy 200*a*, 200*b*, 400, 500 about the spin point of the toy will decrease from the point when the transformable toy first starts spinning. When the transformable toy 200*a*, 200*b*, 400, 500 is initially spinning at an elevated spin speed (see FIG. 3A), it is oriented in the relatively upright spinning orientation and its spinning axis S1 is relatively vertical. In this orientation, an angular momentum of the transformable toy 200*a*, 200*b*, 400, 500 maintains the transformable toy in the spinning orientation.

Figure 3B:
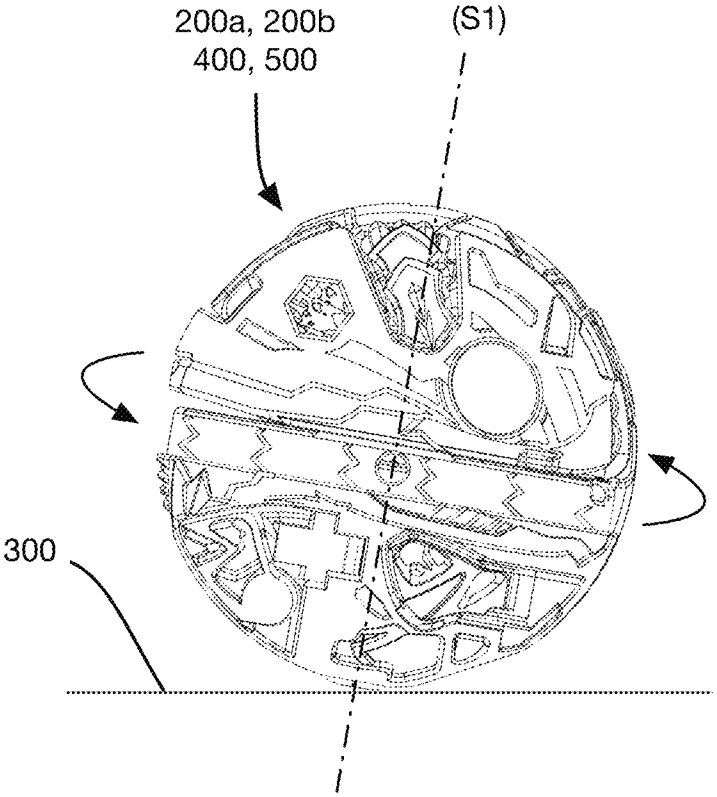
FIG. 3B shows a diagram of an embodiment of the transformable toy spinning on a playing surface about a spinning axis such that the spinning axis is tilting relative to the playing surface.
Figure 3A:
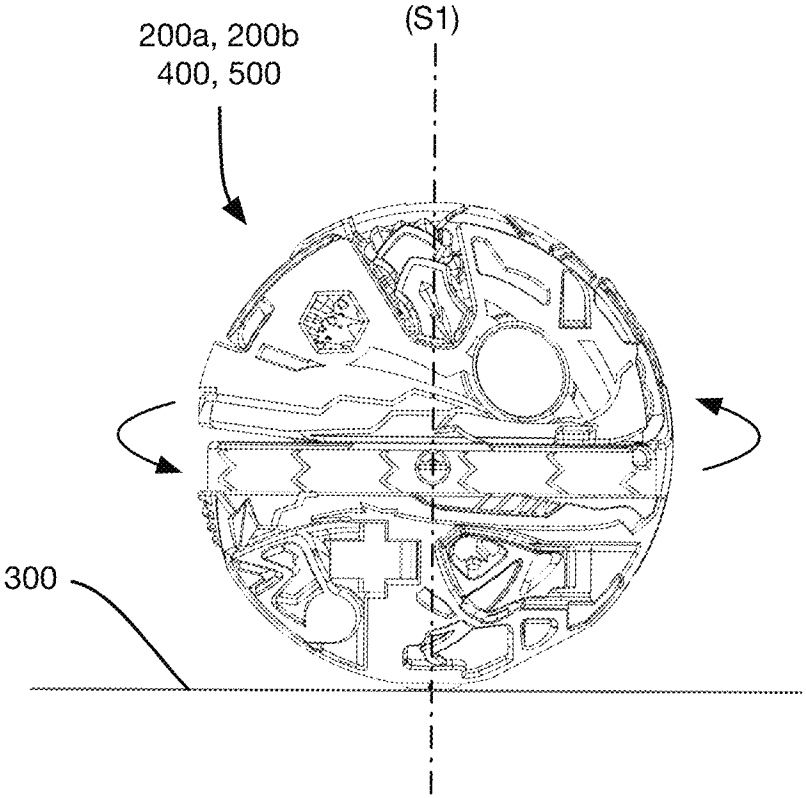
FIG. 3A shows a diagram of an embodiment of the transformable toy spinning on a playing surface about a spinning axis of the transformable toy.
Figure 3D:
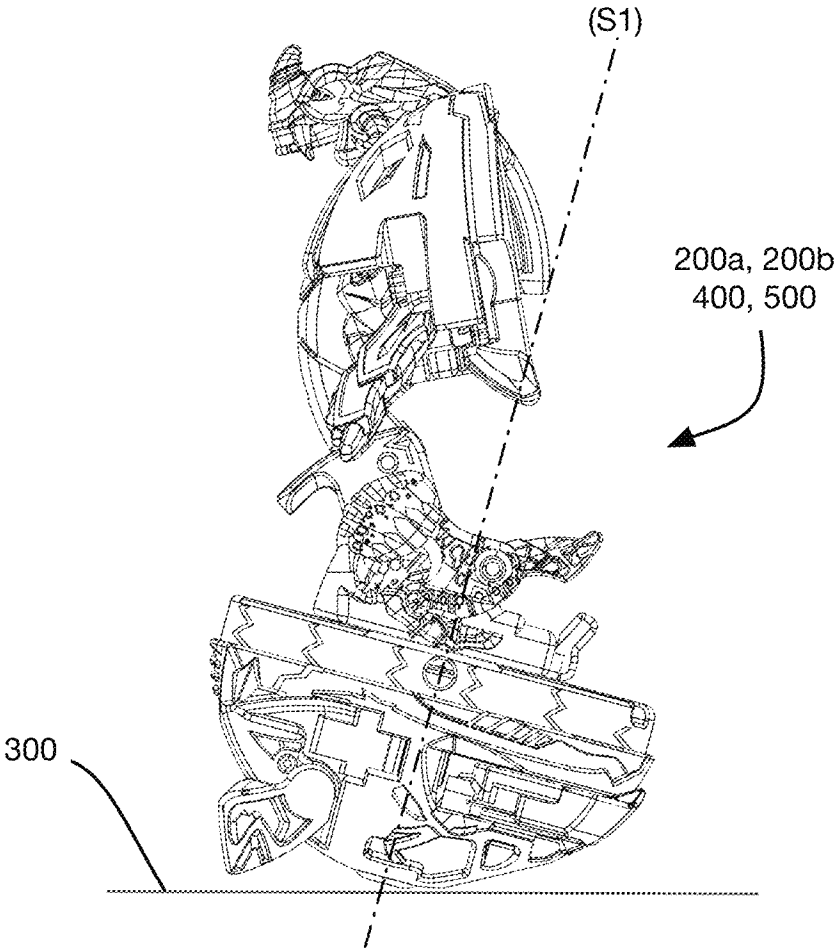
FIG. 3D shows a diagram of an embodiment of the transformable toy in FIG. 3A that has stop spinning and is in an expanded position.
Figure 3C:
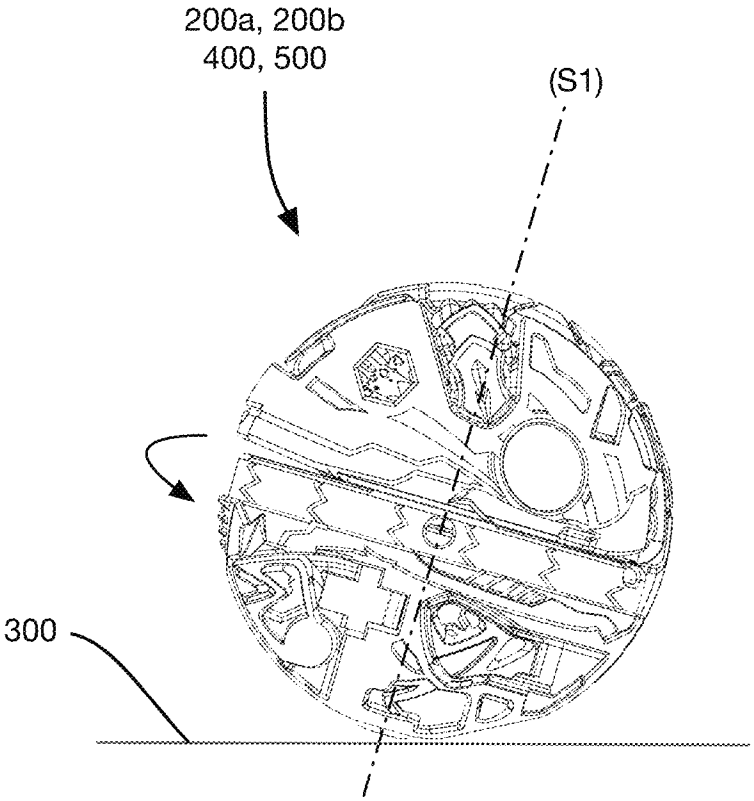
FIG. 3C shows a diagram of an embodiment of the transformable toy spinning on a playing surface about a spinning axis, and tilting relative to the playing surface to a greater extent than in FIG. 3B.
Figure 3E:
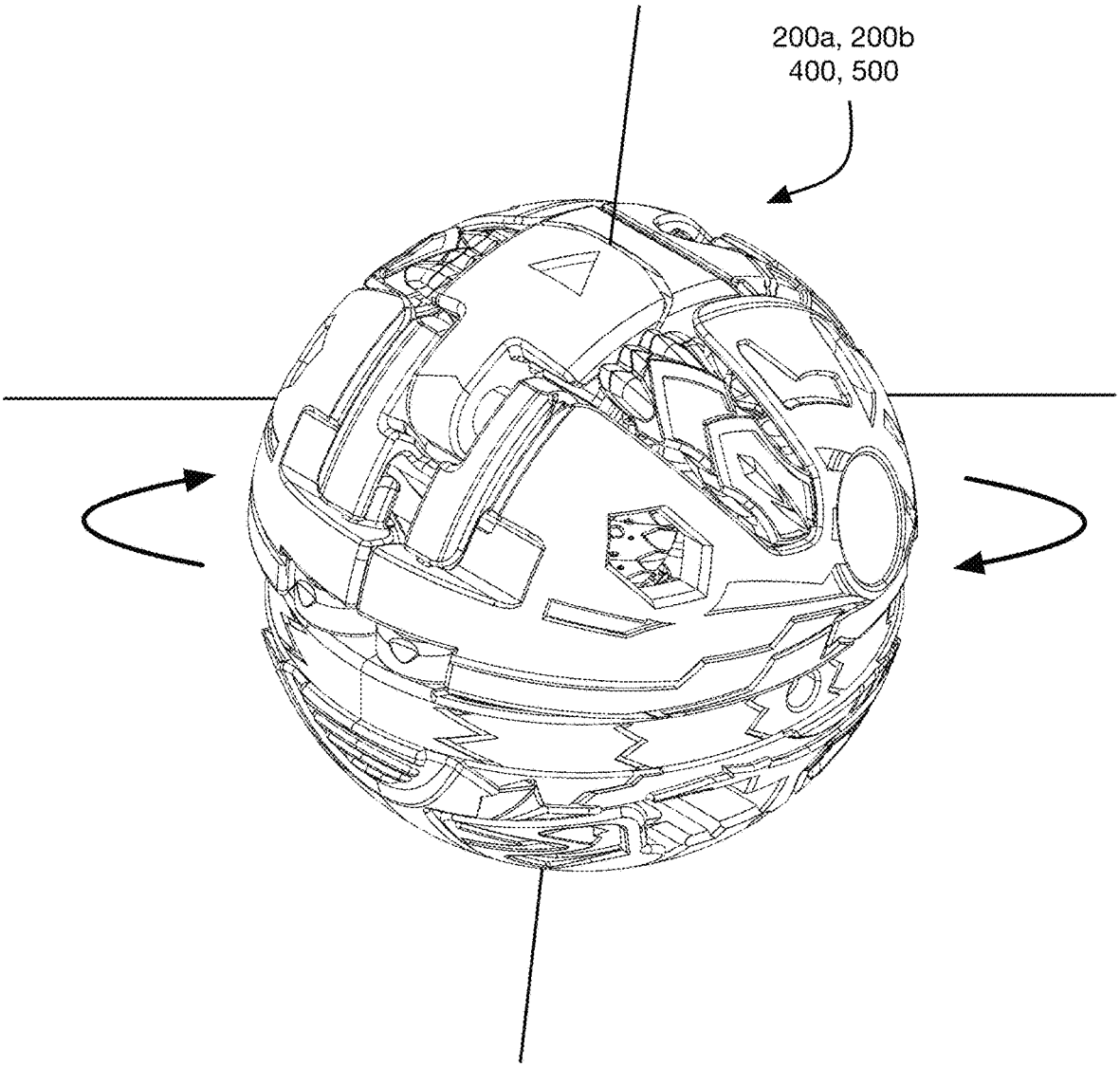
FIG. 3E shows an isometric view of the transformable toy in FIG. 3A.
Figure 3F:
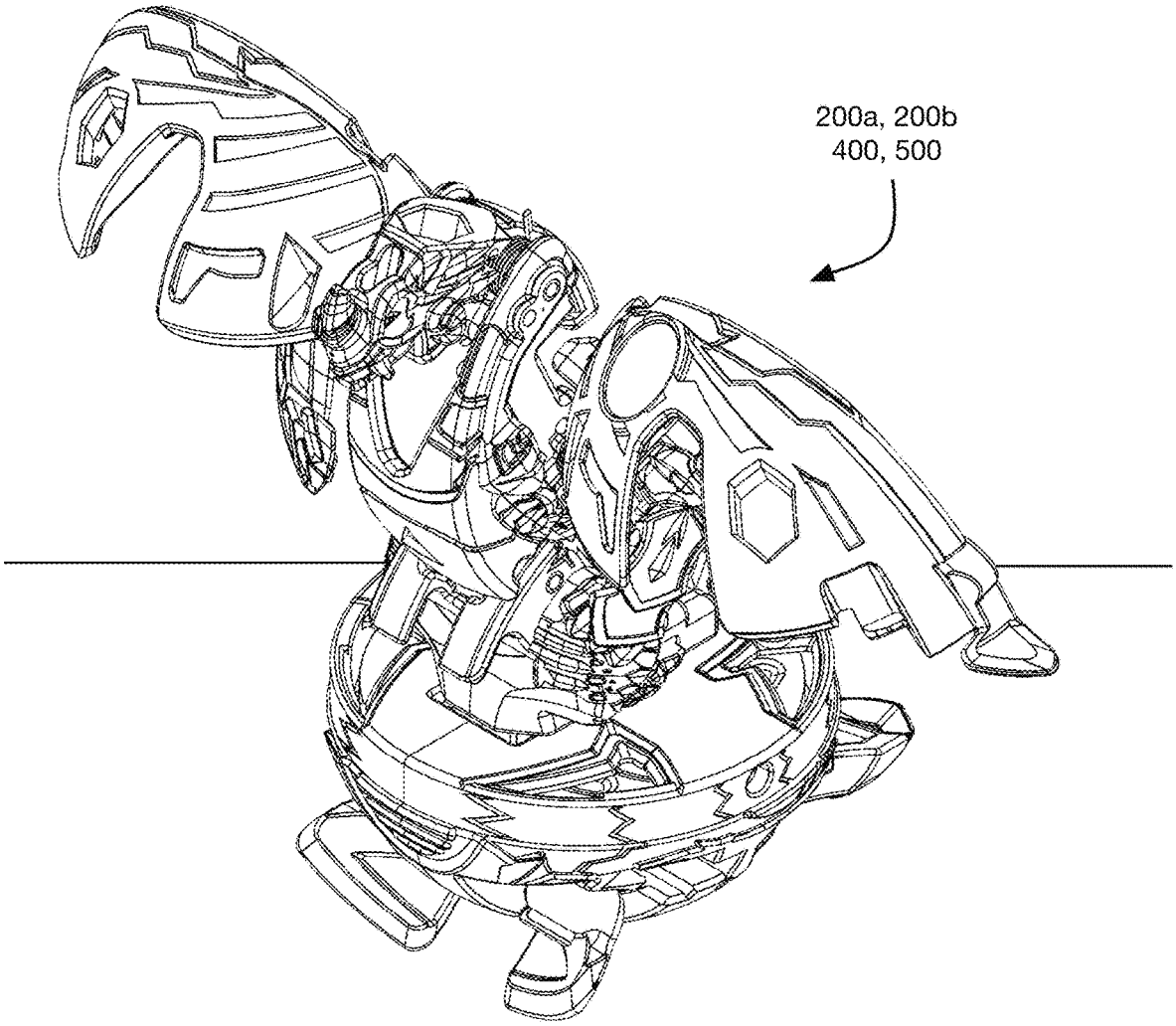
FIG. 3F shows an isometric view of the transformable toy in FIG. 3D.

As a spin speed of the transformable toy 200*a*, 200*b*, 400, 500 decreases (due to gravity and the weight of the toy itself) the angular momentum of the transformable toy 200*a*, 200*b*, 400, 500 decreases, and a rate of precession of the toys spinning axis (S1) will increase, thereby causing the spinning axis S1 of the transformable toy 200*a*, 200*b*, 400, 500 to become progressively less vertical (see FIGS. 3B and 3C). The spinning speed of the transformable toy 200*a*, 200*b*, 400, 500 will continue to decrease until the spinning speed of the transformable toy 200*a*, 200*b*, 400, 500 is at or below a set speed.

In an embodiment such as the embodiment provided in FIG. 3D, the set speed is defined such that when the transformable toy 200*a*, 200*b*, 400, 500 is spinning about the spinning axis S1 at or below the set speed, the interaction element of the actuator will interact with at least a portion of the toy playing surface and drives an actuation of the actuator to disengage the latch from the catch In an embodiment, the set speed is defined such that when the transformable toy 200*a*, 200*b*, 400, 500 is spinning about the spinning axis S1, at or below the set speed, the transformable toy 200*a*, 200*b*, 400, 500 will tip from the spinning orientation and the interaction element of the actuator will interact with at least a portion of the toy playing surface and drives an actuation of the actuator to disengage the latch from the catch.

In an additional embodiment, the spinning speed is defined such that the transformable toy 200*a*, 200*b*, 400, 500 will tip from the spinning orientation to such an extent that the spinning motion of the transformable toy 200*a*, 200*b*, 400, 500 is stopped.

The set speed of the transformable toy 200*a*, 200*b*, 400, 500 can be further defined as the speed at which a component of the angular momentum of the transformable toy

200*a*, 200*b*, 400, 500 that is maintaining the transformable toy 200*a*, 200*b*, 400, 500 in the spinning orientation is overcome by a component of the weight of the transformable toy 200*a*, 200*b*, 400, 500 that is pulling the transformable toy 200*a*, 200*b*, 400, 500 out of the spinning orientation.

Several embodiments of the transformable toy that can be driven to spin will now be described in greater detail, with reference to the drawings.

In another embodiment of the transformable toy of the present disclosure, the transformable toy is shown at 200*a* and includes a top housing portion 210 which is connectable to one of at least first and second bottom housing portions 220, 230. The top housing portion 210 of the transformable toy 200*a* includes a connector 211 and at least one movable housing element 212 that is movable between a retracted position (see FIGS. 2B, 2D and 2F) and an expanded position (see FIGS. 2A, 2C and 2E). It will be noted that the top housing portion 210 shown in FIGS. 2A, 2E and 2F differs aesthetically from the top housing portion 210 shown in FIGS. 2B, 2C, 2D, 2G and 2H, however for the purposes of the description of the functional elements of these figures, all of FIGS. 2A-2H are to be considered the same as one another, and represent a single effective embodiment of the top housing portion 210.

The at least one movable housing element 212 is biased towards the expanded position and includes a catch 212*a*. In this embodiment, the connector 211 is formed to be separably connectable to one of a first bottom housing portion 220 and a second bottom housing portion, the second bottom housing portion 230 including a driving element 260 operably mounted within the second bottom housing portion 230 to drive a motion of the second bottom housing portion.

The first bottom housing portion 220 and the second bottom housing portion 230 each include a latch 222, 232 and an actuator 224, 234 that is connected to the latch 222, 232. Within each of the first and second bottom housing portions 220, 230, the latch 222, 232 is positioned such that when the top housing portion 210 is separably connected to one of the bottom housing portions (first and second bottom housing portions 220, 230) via the connector 211, and when the at least one movable housing element 212 is moved to the retracted position, the latch 222, 232 engages the catch 212*a* to retain the at least one movable housing element 212 in the retracted position. As with the first embodiment of the transformable toy 200*a*, the second embodiment of the transformable toy 200*a* includes an actuator 224, 234 that is actuatable, when the at least one movable housing element 212 is retained in the retracted position, to disengage the latch 222, 232 from the catch 212*a* and release the at least one movable housing element 212.

In an embodiment of the transformable toy 200*a*, the top housing portion 210 and each of the first bottom housing portion 220 and second bottom housing portion 230 are individually shaped such that when the top housing portion 210 and one of the first and second bottom housing portions 220, 230 are separably connected, and when the at least one movable housing element 212 is in the retracted position, the transformable toy 200*a* is rollable along a playing surface 290 about at least one rotational axis of the transformable toy 200*a*. In this way, when the at least one movable housing element 212 of the top housing portion 210 is moved to the expanded position, the at least one movable housing element 212 inhibits rolling of the transformable toy 200*a* about the at least one rotational axis.

In the embodiment of the transformable toy 200*a* shown in FIGS. 2A to 2D, the shape of each the first and second bottom housing portions 220, 230 is substantially hemispherical and the shape of the top housing portion 210 when the at least one movable housing element 212 is in the retracted position is substantially hemispherical. In this embodiment, the movement of the at least one movable housing elements 212 from the expanded to the retracted position results in the shape of the top housing portion 210 becoming substantially hemispherical. In this way, when the hemispherical top portion is connected to the either the first or second bottom housing portions 220, 230, the collective form of the transformable toy 200*a* is substantially spherical.

Referring to the specific embodiment provided in FIGS. 2A to 2D, the transformable toy 200*a* includes a hemispherical top housing portion 210 and hemispherical first and second bottom housing portions 220, 230. As presented above, the second embodiment of the transformable toy 200*a* includes a top housing portion 210, where the top housing portion 210 includes at least one movable housing element 212 that is movable between retracted and expanded positions.

In an embodiment (such as the embodiments provided in FIGS. 2A to 2H), the top housing portion 210 includes a top housing body 214 to which the at least one movable housing element 212 is pivotably mounted.

The at least one movable housing element 212 may be biased towards the expanded position by a spring 215. The spring 215 may be any suitable type of spring such as a torsion spring mounted about a shaft 213 that defines a pivot axis of the at least one movable housing element 212 and may be similar to the spring 115. The spring 215 is positioned to bias the at least one movable housing element 212 towards the expanded position by applying a force which pivots the at least one movable housing element 212 about the shaft 213 towards the expanded position.

In an embodiment, the at least one movable housing element 212 is one or more pairs of movable housing elements that are pivotably connected to the top housing body 214 so as to pivot between retracted positions in which the pairs of movable housing elements are disposed close to the top housing body 214, and expanded positions where the movable housing elements are disposed away from the top housing body 214.

Figure 2A:
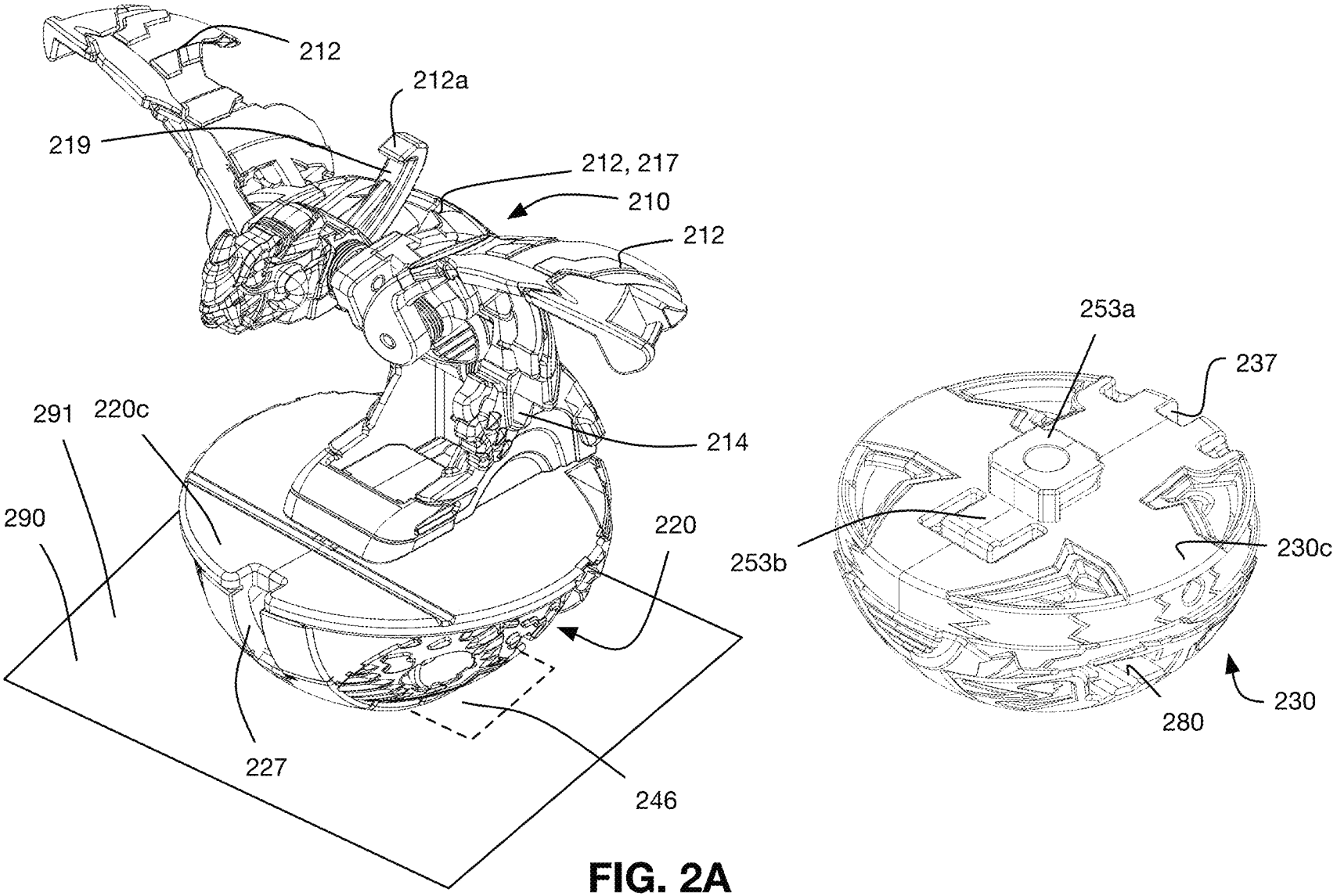
FIG. 2A shows an isometric view of another embodiment of a transformable toy including a top housing portion, and separate first and second bottom housing portions, wherein the top housing portion includes movable housing elements in an expanded position.
Figure 2B:
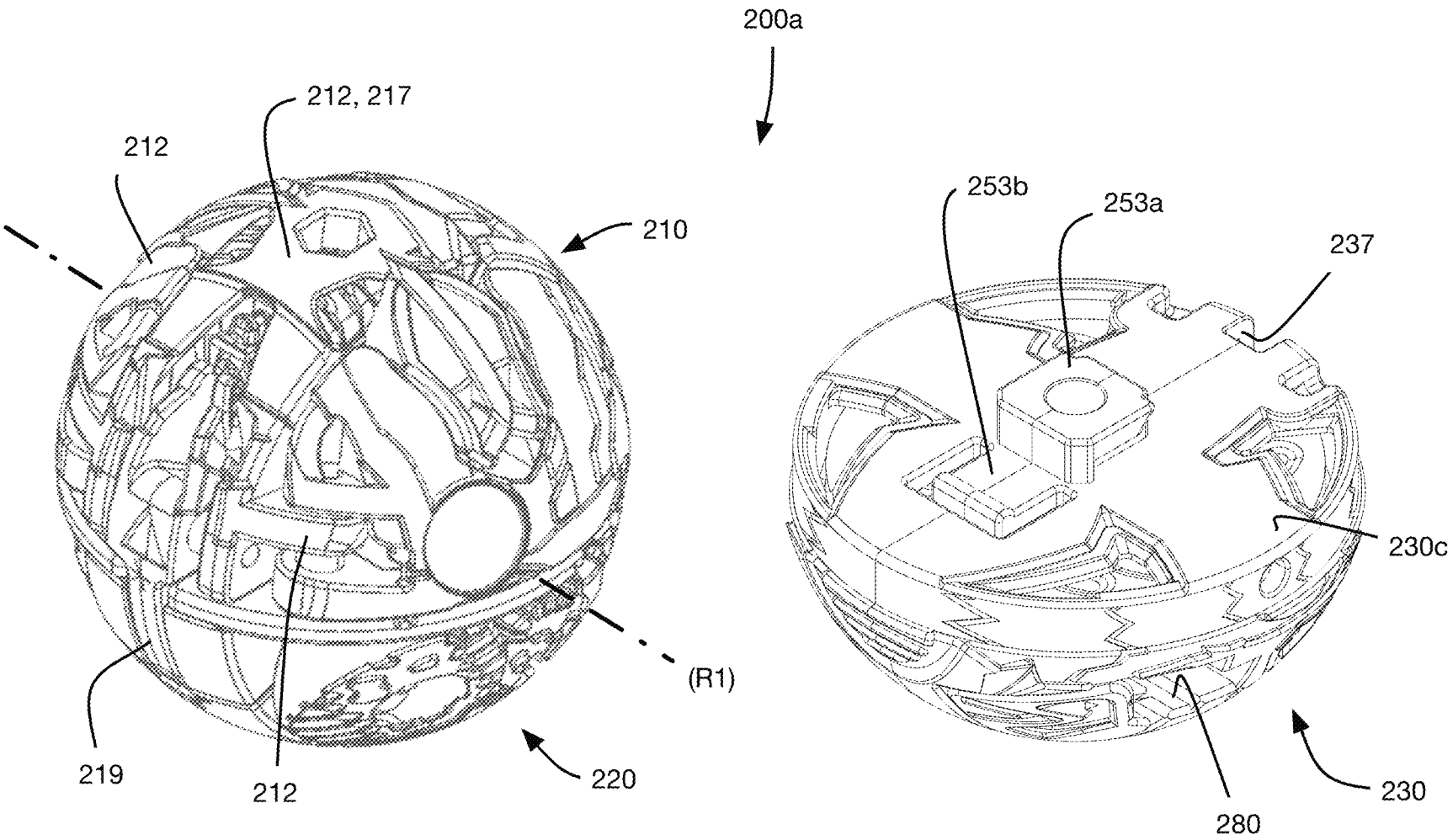
FIG. 2B shows another isometric view of the embodiment shown in FIG. 2A, showing the movable housing elements in a retracted position.
Figure 2C:
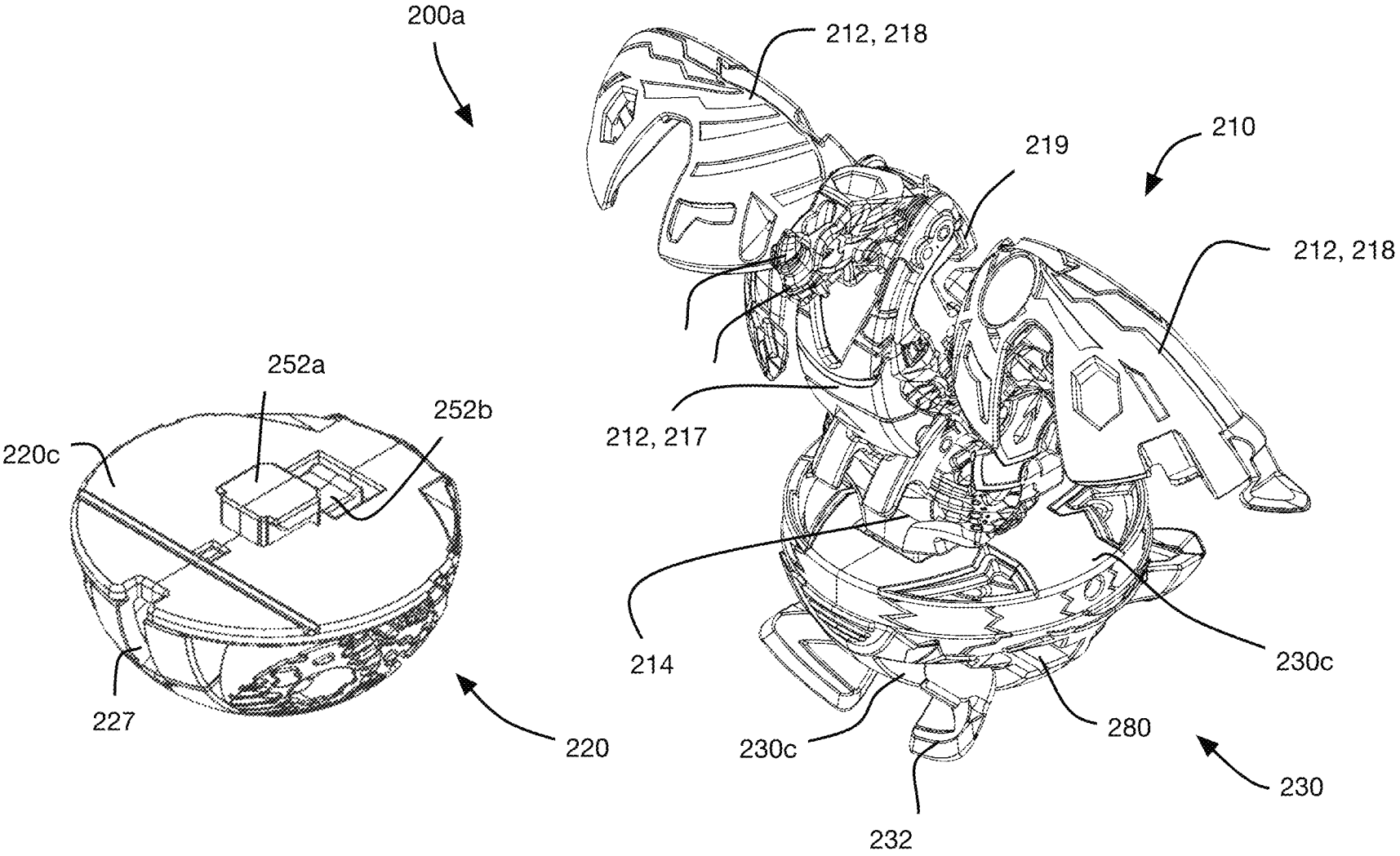
FIG. 2C shows a perspective view of the embodiment shown in FIG. 2A (with minor aesthetic differences between similar components), but which shows the second bottom housing portion connected to the top housing portion, showing the movable housing components in an expanded position.
Figure 2D:
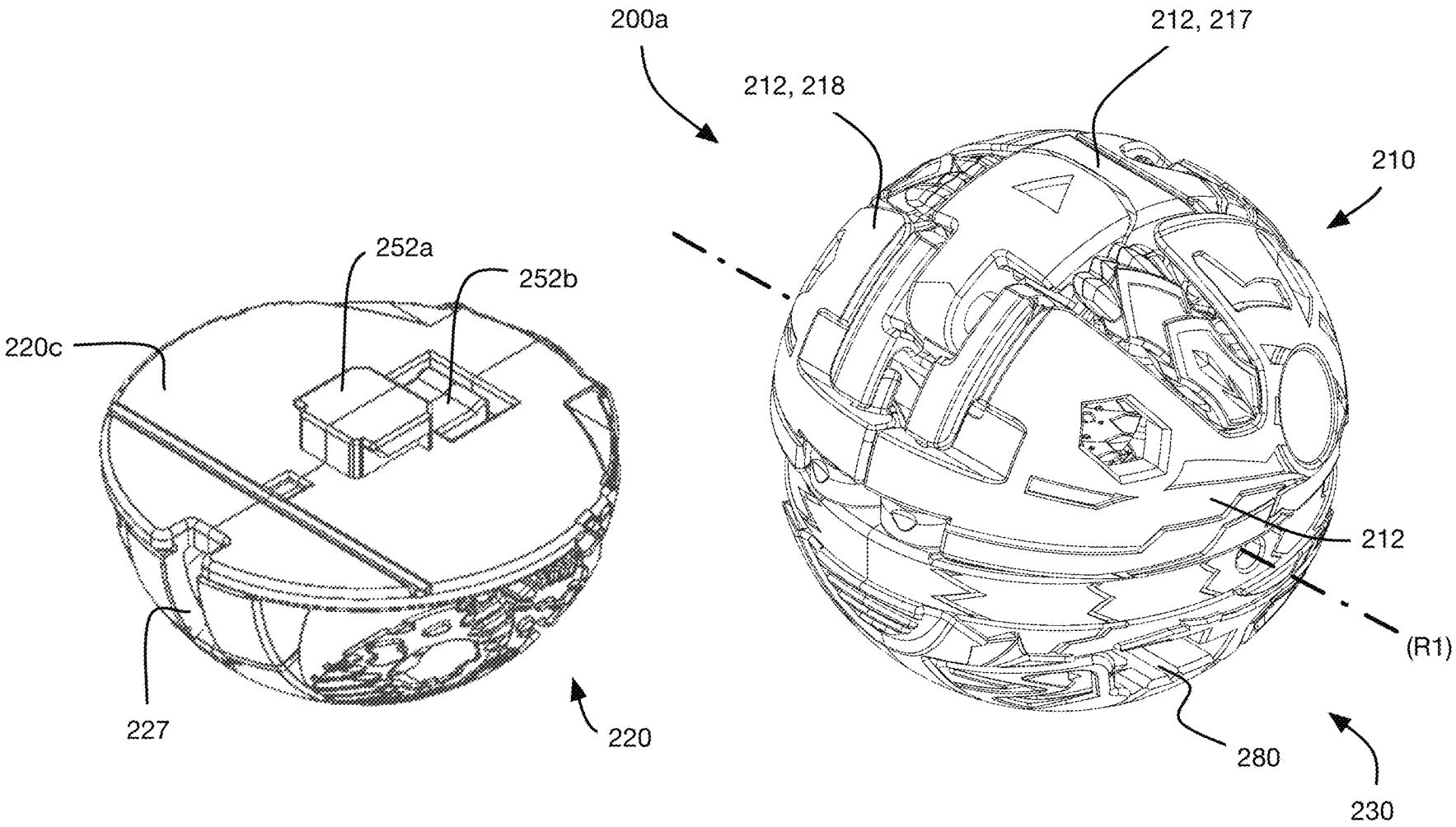
FIG. 2D another isometric view of the embodiment shown in FIG. 2C, showing the movable housing elements in the retracted position.
Figure 2E:
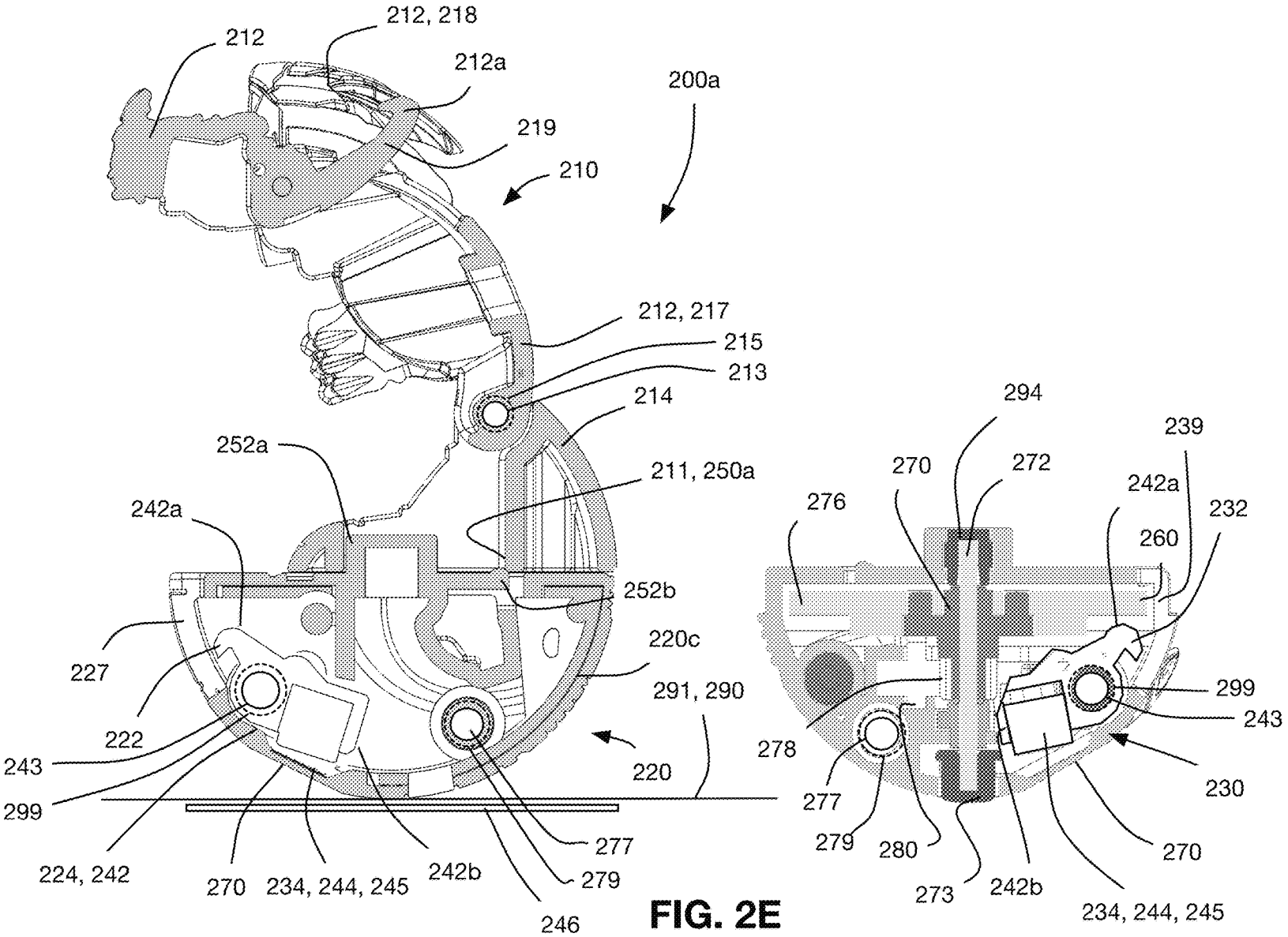
FIG. 2E shows a sectional view of the embodiment as shown in FIG. 2A.
Figure 2F:
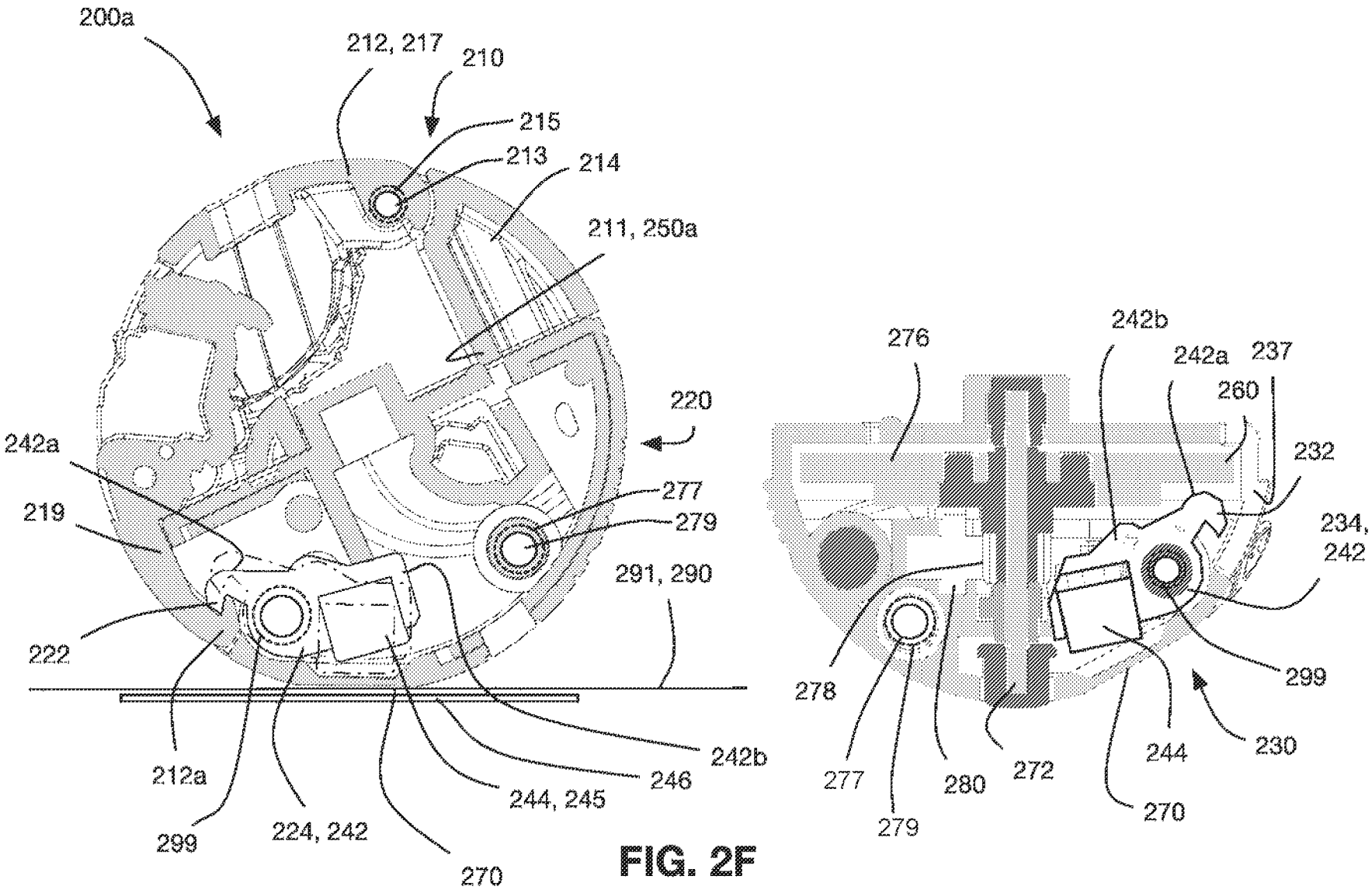
FIG. 2F shows a sectional view of the embodiment as shown in FIG. 2B.
Figure 2G:
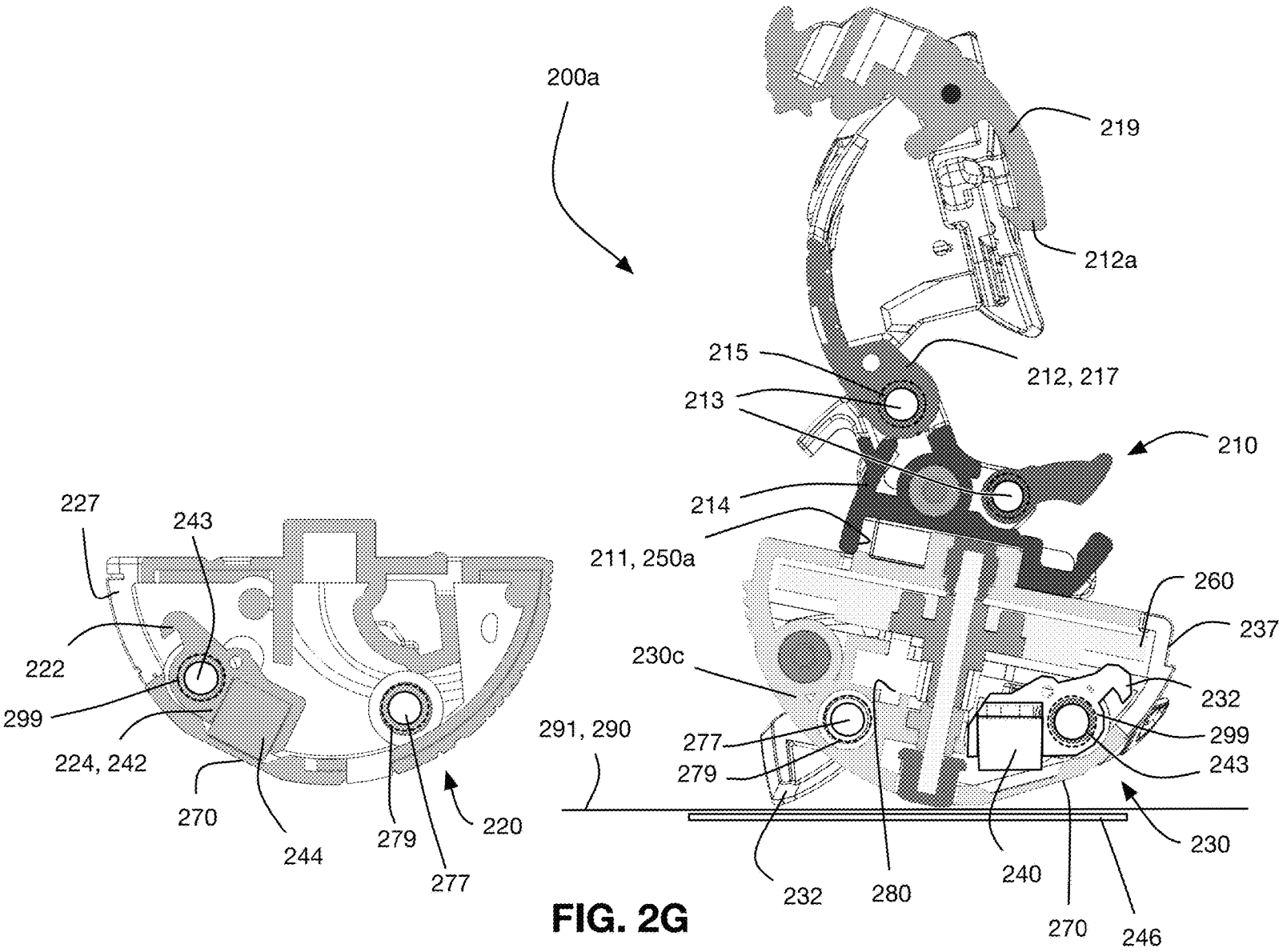
FIG. 2G shows a sectional view of the embodiment as shown in FIG. 2C.
Figure 2H:
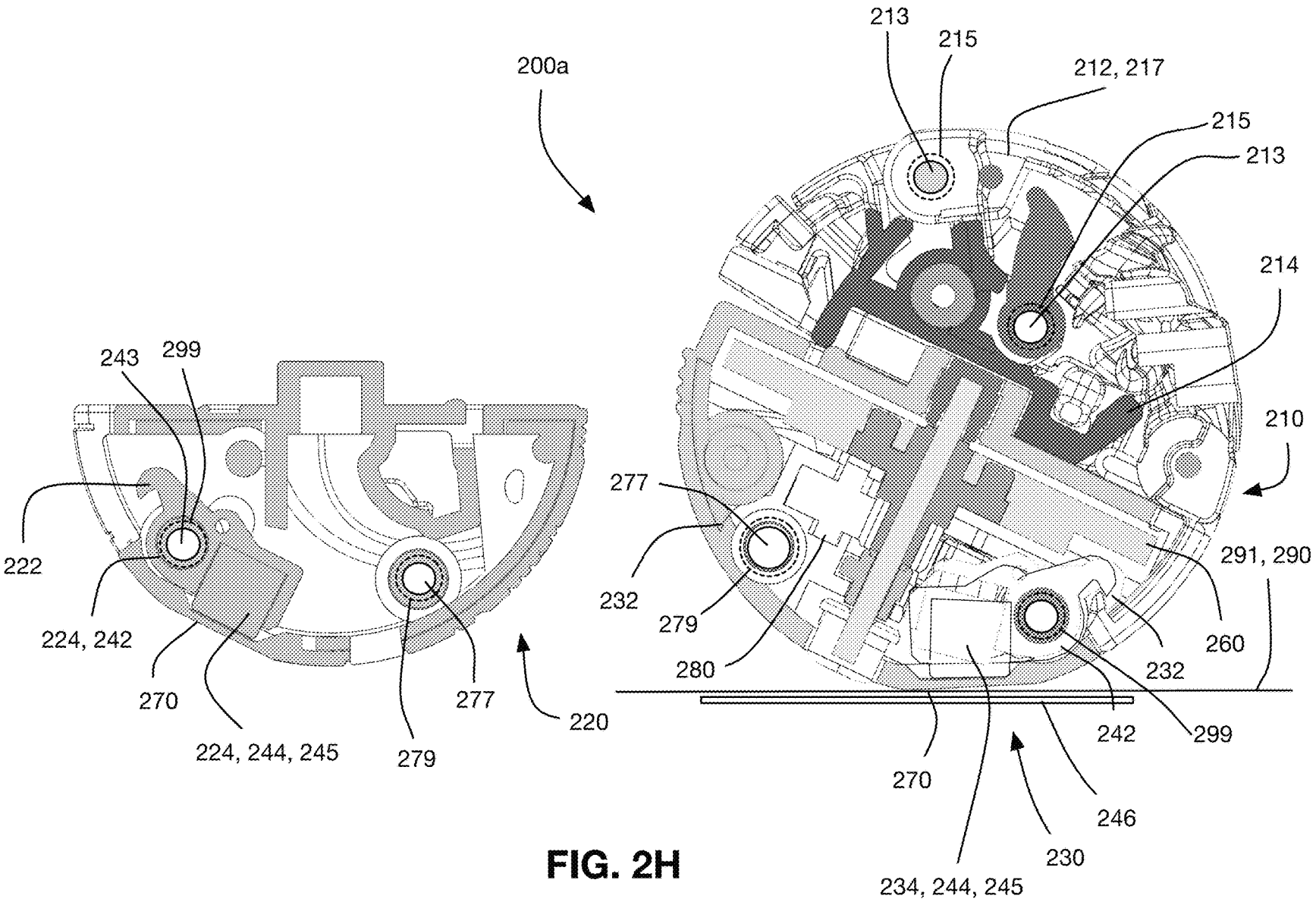
FIG. 2H shows a sectional view of the embodiment as shown in FIG. 2D.

In the specific embodiments provided in FIGS. 2B and 2F, the hemispherical-shaped top housing portion 210 includes the top housing body 214, where a region 214*a* of the top housing body 214 is formed with an at least partial dome shape, as if it were a section of a sphere that has been cut off. A hollow cavity 216 is formed within the top housing portion 210. In these specific embodiments, the at least one movable housing element 212 includes a central movable housing element 217. The central movable housing element 217 is mounted onto an upper central portion of the top housing body 214 such that the central housing element 217 is pivotable relative to the top housing body 214. In the same embodiment, the at least one movable housing element also includes lateral movable housing elements 218 that are pivotably mounted onto upper left and right lateral portions of the top housing body 214. The central movable housing element 217 has an exterior structure that is arc-shaped, and the central movable housing element 217 has a thin profile that defines portions of an exterior surface of the top housing portion 210. An exterior surface of the at least one movable housing element 212*s* constitute one section of the spherical shape of the transformable toy 200*a* provided in FIGS. 2B and 2D.

In the same embodiments, the at least one movable housing element 212 also includes a horn element 219 that is pivotably mounted to either the central housing element 217 or the top housing body 214 for movement between the retracted and expanded positions. The horn element 219 has a roughly circular, arc-shape with a sharply curved end-portion. As shown in FIGS. 2B, 2D and 2F, when in its retracted position, the horn element 219 is disposed in a space that is defined between the lateral movable housing elements 218

In an additional embodiment, the catch 212*a* of the top housing portion 210 that is retained by the latch 222, 232 of the bottom housing portion is defined by the sharply curved end of the horn element 219.

It can be said generally that the at least one movable housing element 212 is provided for transforming the transformable toy 200*a* from a rollable, spherical shape to a character shape as presented in FIGS. 2A to 2D.

Referring to FIGS. 2E to 2H, the first and second bottom housing portions 220, 230 are each presented as the substantially hemispherical first and second bottom housing portions 220, 230, each of which include a hollow cavity 216, is formed therewithin. Each of the first and second bottom housing portions 220, 230 of this embodiment of the transformable toy 200*a* include the latch 222, 232 mounted within the bottom housing portion, and the actuator 224, 234 connected to the latch 222, 232. As noted above, the latch 222, 232 is positioned to retain the catch 212*a* of the at least one movable housing element 212 when the at least one movable housing element 212 is moved to the retracted position. Together with the actuator 224, 234, the latch 222, 232 is moved to retain and release the catch 212*a* of the at least one movable housing element 212.

In the embodiment provided in FIGS. 2A and 2C, an exterior surface of each of the first and second bottom housing portions 220, 230 include a through-hole 227, 237. The through-hole 227, 237 of each housing portion 220, 230 is positioned in each housing portion 220, 230 and is formed such that when the at least one movable housing element 212 moves from the expanded to the retracted position, the catch 212*a* of the at least one movable housing element 212 is received in the through-hole 227, 237 to engage with the latch 222, 232 in the bottom housing portion.

In an embodiment, the catch 212*a* is formed as part of the horn element 219, and the through-hole is positioned on a front side of the bottom housing portion to receive a portion of the horn element 219.

In an embodiment, each of the first and second bottom housing portions 220, 230 include a connecting element 252, 253 that corresponds to, and interfaces with, the connector 211 of the top housing portion 210 for connecting the top and one of the first and second bottom housing portions 220, 230. Through the connector 211 and the connecting element 252, 253, the top housing portion 210 can be separably coupled to either the first bottom housing portion 220 or second bottom housing portions 230.

In the specific embodiment provided in FIGS. 2A, the connecting element 252, 253 of each of the first and second bottom housing portions 220, 230 includes a projection 252*a*, 253*a* that extends upwards from the flat face of the first or second bottom housing portion, and a flexible tab 252*b*, 253*b*. The flexible tab 252*b*, 253*b* of each bottom housing portion 220, 230 extends towards a back part of the first or second bottom housing portions 220, 230 and includes a substantially planar portion that rests parallel to a flat face of the first or second bottom housing portions and a tab portion that projects upwards from the substantially planar portion. A gap is defined between the flat face and three sides of the flexible tab 252*b*, 253*b* such that the flexible tab 252*b*, 253*b* can bend relative to the flat face. In the same embodiment, the connector 211 of the top housing portion 210 is a connecting aperture 250*a* that extends into the hollow cavity 216 of the top housing portion 210 where the aperture is sized and shaped to receive the projection 252*a*, 253*a* and flexible tab 252*b*, 253*b* from the one of the first and second bottom housing portions 220, 230. For inserting the projection 252*a*, 253*a* and flexible tab 252*b*, 253*b* into the connecting aperture 250*a*, to connect the top housing portion 210 and first or second bottom housing portions 220, 230, the top 210 and bottom housing portion (220 or 230) are oriented such that a front part of a flat face of the top housing portion 210 is positioned atop a back part of the flat face 220*c*, 230*c* of the first or second bottom housing portions. The top housing portion 210 is then tilted at an angle and advanced transversely along the flat face 220*c*, 230*c* of the first or second bottom housing portions 220, 230 until the flexible tab 252*b* bends into and is received by the connecting aperture 250*a*. Once the flexible tab 252*b* is securely received in the connecting aperture 250*a*, the top housing portion 210 is tilted down such that the projection 252*a* is received in the connecting aperture 250*a* of the top housing portion 210. The top and bottom housing portions (210 and 220 or 230) are brought together until the flat faces of each housing portion are in solid contact. In this separably connected state, the flexible tab 252*b*, 253*b* inhibits the separation of the flat faces of the top and bottom housing portions, while the projection 252*a*, 253*a* prevents relative, side-to-side motion of the top housing portion 210 and first or second bottom housing portions 220, 230.

In the embodiments of the first and second bottom housing portions 220, 230 provided in FIGS. 2E to 2H, the latch 222, 232 and actuator 224, 234 of at least one of the bottom housing portions 220, 230 is mounted on a pivot member 242 with free first and second ends, the pivot member 242 being pivotally mounted within the bottom housing portion within the hollow cavity 226 of the first or second bottom housing portions 220, 230 to pivot relative to the first or second bottom housing portions 220, 230. The free first end of pivot member 242 includes the latch 222, 232 and the free second end of the pivot member 242 includes the interaction element 244.

In an embodiment, the pivot member 242 is positioned in the interior of each of the first and second bottom housing portions 220, 230. The pivot member 242 has a first free end 242*a* at which the latch 222, 232 is mounted, and the second free end 242*b* at which the interaction element 244 is mounted.

In this embodiment, a hollow portion of the pivot member 242 is mounted about the shaft shown at 243 to define a pivot axis of the pivot member 242. The pivot member 242 is pivotable about the pivot axis in both a clockwise and anti-clockwise direction. The pivot member 242 is pivoted in a clockwise direction (in the views shown in FIGS. 2E and 2G) to a latched position, and is moved in the anti-clockwise direction (in the views shown in FIGS. 2F and 2H) to an unlatched or release position. The pivot member 242 may be biased towards the latched position by a spring 299 (FIG. 2E). The spring 299 may be any suitable type of spring such as a torsion spring mounted about the shaft 243 and may be similar to the spring 199. The spring 299 is positioned to bias the pivot member 242 towards the latched position by applying a force which pivots the pivot member 242 about the shaft 243 towards the latched position.

In an additional embodiment, the interaction element 244 of the actuator 224, 234 is a first magnetically responsive element 245 that is positioned on the second free end 242*b* of the pivot member for interacting with a second magnetically responsive element 246, wherein at least one of the first and second magnetically responsive elements 245 and 246 is a magnet. In this way, an interaction of the first magnetically responsive element 245 with the second magnetically responsive element 246 generates an actuation of the actuator 224, 234.

In a specific embodiment the first magnetically responsive element 245 may be a magnet and the second magnetically responsive element 246 is a strip of steel that is included in a toy support member 291 (FIG. 2F). The toy support member 291 may be a card or the like, or any other suitable support member, and defines the toy playing surface 290. The magnet is mounted on a lower section of the second free end 242*b* of the pivot member 242, while the other end of the pivot member 242 has the latch 222, 232 mounted thereon. The magnet is mounted such that it projects slightly from the aperture in which it is held on the pivot member 242.

In a further embodiment of the embodiment where the interaction element 244 is the first magnetically responsive element 245, at least one of the first and second bottom housing portions 220, 230 includes a thin-wall portion 270. As described above in relation to the thin-wall portion 125*a* of the bottom housing portion 120, the thin-wall portion 270 is formed on a lower section of the hemispherical form of the first and/or second bottom housing portion 220, 230. The thin-wall portion 270 is shaped with a thickness such that the second magnetically responsive element 246 can attract the magnet of the pivot member 242 through the thin-wall portion 270, thereby driving the pivot member 242 from the unactuated position to an actuated position and bringing the magnet closer to the thin-wall portion 270.

In an embodiment, at least one of the first of second bottom housing portions 220, 230 includes an aperture in place of the thin-wall portion 270.

Figure 9A:
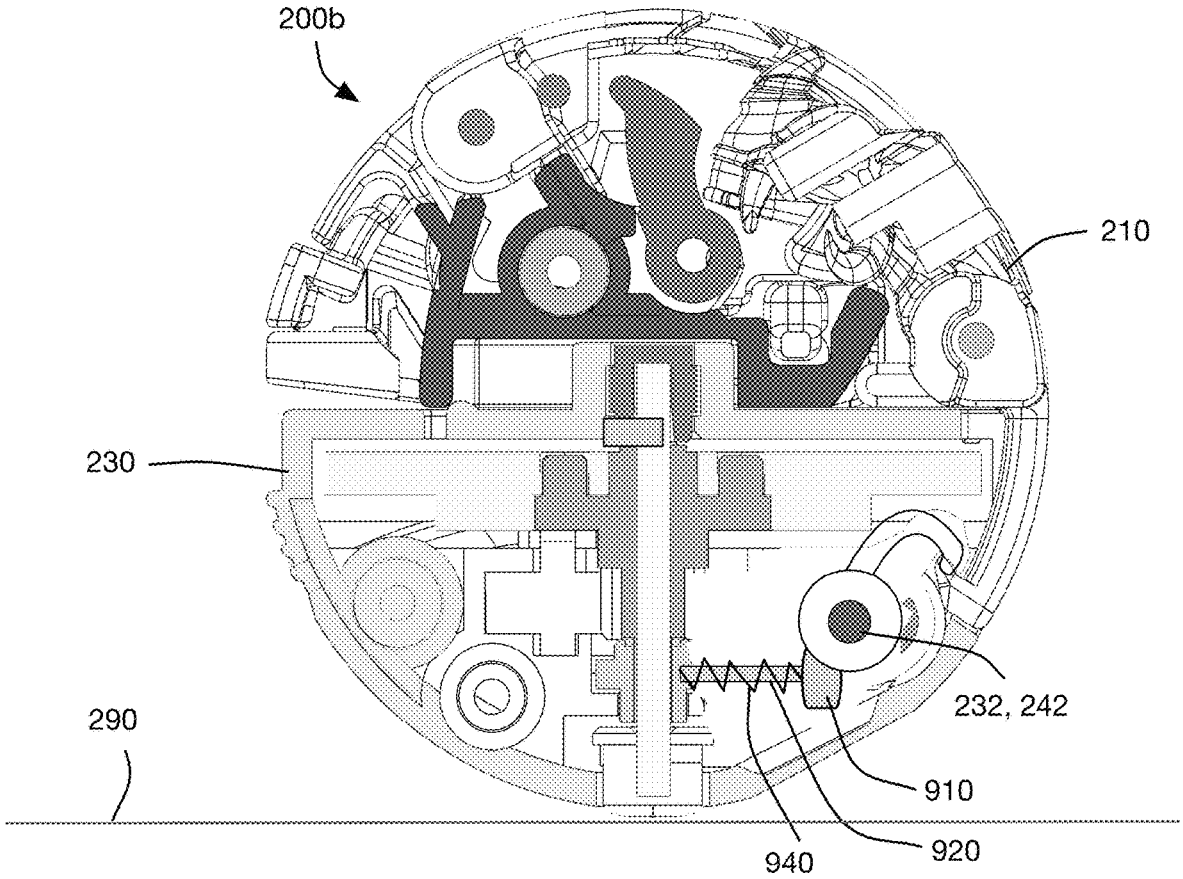
FIG. 9A shows an embodiment of a transformable toy including an actuator with a movable weight, where the movable weight is in a retracted position.
Figure 9B:
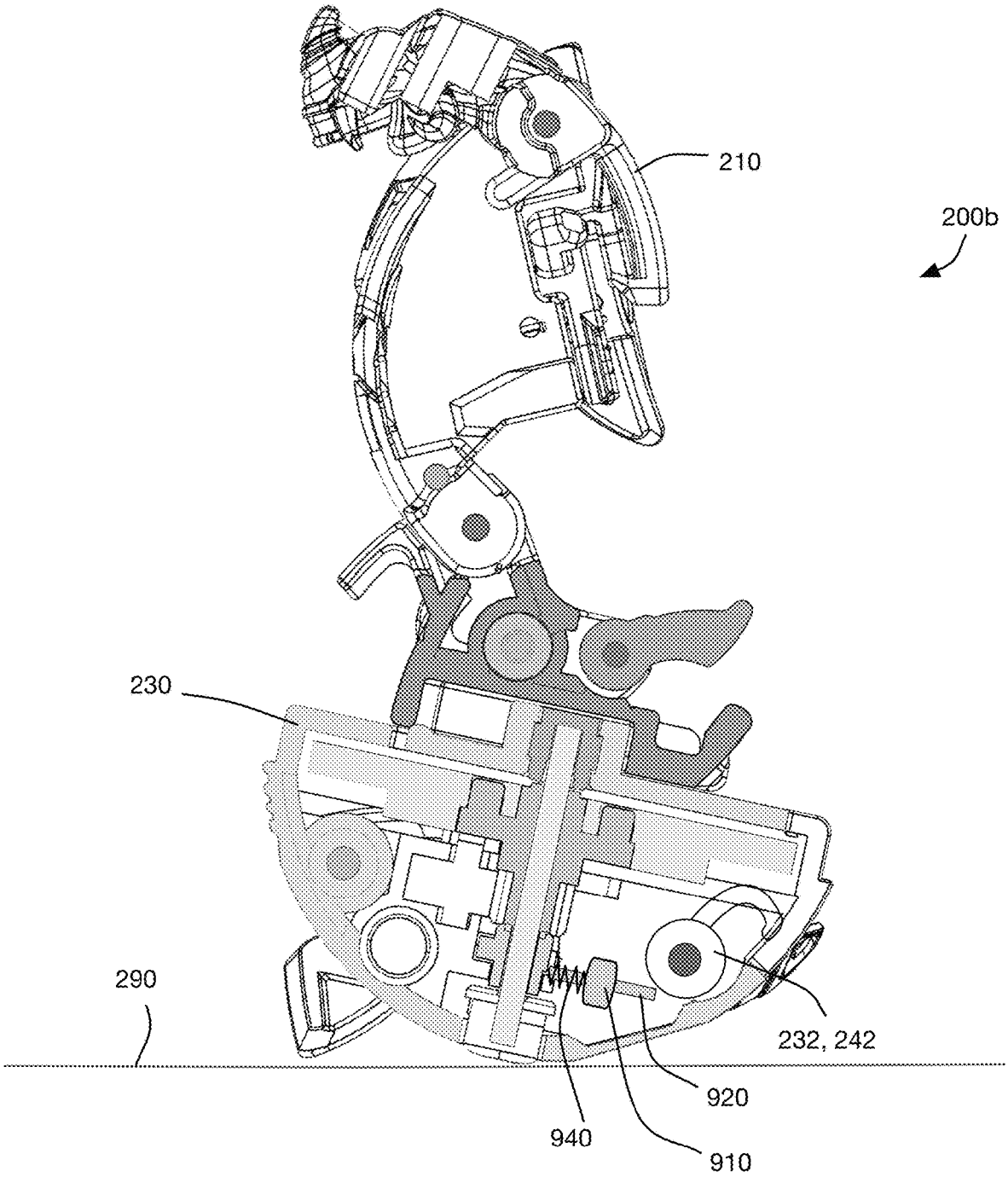
FIG. 9B shows an embodiment of the transformable toy of FIG. 9A, where the movable weight is in an expanded position.

In an embodiment of the transformable toy 200*a* shown in FIGS. 9A and 9B, the transformable toy 200*a* is a transformable toy 200*b* that includes the top housing portion 210, where the top housing portion is connectable, via the connector 211, to a second bottom housing portion 230 that includes an actuator 934 formed of at least one movable weight 910 that is movable between an inner radial position (FIG. 9B) and an outer radial position (FIG. 9A) relative to a central axis (C1) of the transformable toy 200*b*. The at least one movable weight 910 is connected within the second bottom housing portion 230 such that when the transformable toy 200*a* is spinning at or below the set speed, the movable weight 910 will be in the inner radial position, and when the transformable toy 200*a* is spinning above the set speed, the at least one movable weight 910 will be in the outer radial position. When the at least one movable weight 910 is in the inner radial position and when the at least one movable housing element 212 is retained in the retracted position, the latch 222, 232 will disengage from the catch 212*a* and release the at least one movable housing element 212.

In the embodiment provided in FIG. 9A and FIG. 9B, the movable weight 910 is slidably mounted along a shaft 920 that is fixed within the second bottom housing portion 230. The movable weight is biased towards the outer radial position along the shaft 920 by a biasing member 940. In the specific embodiment of FIGS. 9A and 9B, the biasing member 940 is a spring that is mounted around the shaft 920.

In an additional embodiment of the transformable toy 200*a*, the second bottom housing portion 230 also includes an access aperture 280 for accessing and driving a motion of the driving element 260. The access aperture 280 is sized for insertion therethrough of a charging element for driving a motion of the driving element 260 within the second bottom housing portion 230.

In an additional embodiment, at least one of the first bottom housing portion 220 or second bottom housing portion 230 of the transformable toy 200*a* include at least one bottom movable housing element 233. In this embodiment, the at least one movable housing element 212 is at least one top movable housing element. The at least one bottom movable housing element 233 of the first or second bottom housing portions 220, 230 is formed to be movable between a retracted position and an exposed position. The at least one bottom movable housing element 233 being biased towards the exposed position and is operatively connected to the latch 222, 232 such that when the latch 232 engages the catch 212*a* of the top movable housing element, the at least one bottom movable housing element 233 is retained in the retracted position. In this way, the actuator 224, 234 of either the first or second bottom housing portions is also actuatable to disengage the latch 222, 232 from the catch 212*a* to release the at least one bottom movable housing element 233.

In a further embodiment of the bottom housing portions 220, 230 including at least one bottom movable housing element 233, the at least one bottom movable housing element 233 is mounted on a shaft 277 to define a pivot axis of the at least one bottom movable housing element 233 for pivoting between the retracted and exposed positions. In a further embodiment, the at least one bottom movable housing element 233 includes a spring 279 connected about the shaft 277 that defines the pivot axis. The spring 279 is positioned to bias the at least one bottom movable housing element 233 towards the exposed position by applying a force which turns the at least one bottom movable housing element 233 about the shaft 277. The spring 279 may be any suitable type of spring, such as a torsion spring that has an end engaged with the at least one bottom movable housing element 233.

In the specific embodiment provided in FIGS. 2B and 2D, the first and second bottom housing portions 220, 230 each include a bottom housing body 220*c*, 230*c* to which the at least one bottom movable housing element 233 is pivotably mounted. An exterior surface of each of the bottom housing bodies 220*c*, 230*c* has a slight dome shape, as if it were a section of a sphere that has been cut off, and the exterior surface thereof constitutes one section of the spherical shape of the transformable toy 200*a*. The at least one bottom movable housing element 233 is two bottom movable housing elements 233 that are pivotably mounted on opposing sides of the bottom housing bodies 220*c*, 230*c* that form "leg" components of the character represented by the transformable toy 200*a*, when in the expanded position.

In a further embodiment of the second bottom housing element including an access aperture 280, the driving element 260 of the second bottom housing portion 230 is a shaft assembly 270 including a shaft 272 rotatably mounted within the second bottom housing portion 230, along a central axis of the second bottom housing portion, and a flywheel 276 mounted to the shaft 272.

In the specific embodiment provided in FIG. 2E to 2H, the shaft 272 is rotatably mounted inside the second bottom housing portion 230. A lower end of the shaft 272 rotatably engages a first bearing 273 in a lower side of the second bottom housing portion 230, and rotatably engages a second bearing 274 in an upper side of the second bottom housing portion 230. The flywheel 276 is mounted to the shaft 272 and rotates with the shaft 272. A gear element 278 is also mounted to the shaft 272 below the flywheel 276 such that the shaft 272, gear element 278 and flywheel 276 will rotate together when a force is applied to drive a rotation of the gear element 278 and shaft 272. The gear element 278 includes a plurality of triangular teeth that are sized to interface with triangular teeth of a charging element for imparting a force to the gear element 278. In a further alternate embodiment (not shown), the shaft 272 is fixedly mounted inside the second bottom housing portion 230 so that it will not rotate, and the gear element 278 and flywheel 276 are rotatably coupled to the fixedly mounted shaft 272 such that the gear element 278 and flywheel 276 are coupled to rotate together about the shaft 272. By mounting the shaft assembly 270 within the second bottom housing portion, the second bottom housing portion 230 (and the rest of the transformable toy 200*a*) can be driven to spin about the spinning axis of the transformable toy 200*a*.

In alternative embodiments, the gear element 278, flywheel 276 and shaft 272 are formed as an integral piece.

In an embodiment, the second bottom housing portion 230 includes a downward projection 252*a* formed on a bottom extent of the second bottom housing portion 230 which defines a spin point about which the second bottom housing portion 230 is driven to spin. In this embodiment, the spin point is positioned such that as the transformable toy 200*a* is driven to spin about a spinning axis by the flywheel 276, the transformable toy 200*a* will spin about the spin point.

In an alternate embodiment, the bearing 273 of the second bottom housing portion 230 extends through the second bottom housing portion 230 and defines the spin point of the transformable toy about which the transformable toy 200*a* will spin. In this way, the shaft and the central axis of the transformable toy 200*a* defines the spinning axis of the transformable toy 200*a*.

In the specific embodiment provided in FIGS. 2E to 2H, the spin point is located at a bottommost extend of the hemispherical second bottom housing portion 230. In this way, the spin point intersects a central axis of the transformable toy 200*a* such that the central axis of the transformable toy 200*a* defines the spinning axis of the transformable toy 200*a* when spinning about the spin point.

In some embodiments, the spinning axis is defined along the shaft 272 of the shaft assembly 270.

In an additional embodiment where the spinning axis is defined along the shaft of the shaft assembly 270, the shaft is rotatably mounted within the second bottom housing portion 230 such that an end of the shaft extends through the toy housing to define spin point on which the transformable toy 200*a* spins about the spinning axis.

In an embodiment, the transformable toy 200*a* includes a weighted section that is disposed eccentrically about the spinning axis S1. The weighted section is relatively positioned within the second bottom housing portion 230 such that when the transformable toy 200*a* (including the second bottom housing portion 230) is spinning about the spinning axis S1 at or below the set speed, the transformable toy 200*a* will tip somewhat, and may continue spinning. Once tipped, if the transformable toy 200*a* reaches an orientation in which the first magnetically responsive member 245 is within a selected proximity of the second magnetically responsive member 246, the magnetic attraction therebetween will cause the pivot member 242 to be actuated from the latched position shown at 299 in solid lines in FIG. 2F, to the release position shown in broken lines at 298 in FIG. 2F.

In the specific embodiments provided in FIGS. 2E to 2H the transformable toy 200*a* is formed such that the weighted section is constituted by the latch 232 and actuator 234. In this embodiment, the latch 232 and actuator 234 are positioned offset from the central, spinning axis S1 of the transformable toy 200*a*.

In an alternate embodiment of the transformable toy 200*a* that includes the top housing portion 210 connectable to one of the first or second bottom housing portion 220, 230, the positioning of the latch and catch for retaining and releasing the at least one movable housing element is altered.

In this embodiment, the transformable toy includes a top housing portion that is connectable to one of at least first and second bottom housing portions. In this embodiment, the top housing portion includes the connector and at least one movable housing element that is movable between a retracted position and an expanded position. The at least one movable housing element is biased towards the expanded position and includes a latch and an actuator connected to the latch. The connector of the top housing portion is separably connectable to one of a first bottom housing portion and a second bottom housing portion, where each of the first bottom housing portion and the second bottom housing portion include a catch that is positioned such that when the top housing portion is separably connected to one of the first and second bottom housing portions, and when the at least one movable housing element is moved to the retracted position, the latch engages the catch to retain the at least one movable housing element in the retracted position. The actuator is actuatable, when the at least one movable housing element is retained in the retracted position, to disengage the latch from the catch and release the at least one movable housing element. The second bottom housing portion includes a driving element operably mounted within the second bottom housing portion for driving a motion of the second bottom housing portion and the top housing portion along a support surface. The first bottom housing portion either is devoid of any driving element for driving motion of the first bottom housing portion, or includes a driving element that is different than the driving element of the second bottom housing portion and is operably mounted within the first bottom housing portion for driving a motion of the first bottom housing portion and the top housing portion along the support surface.

Figure 4A:
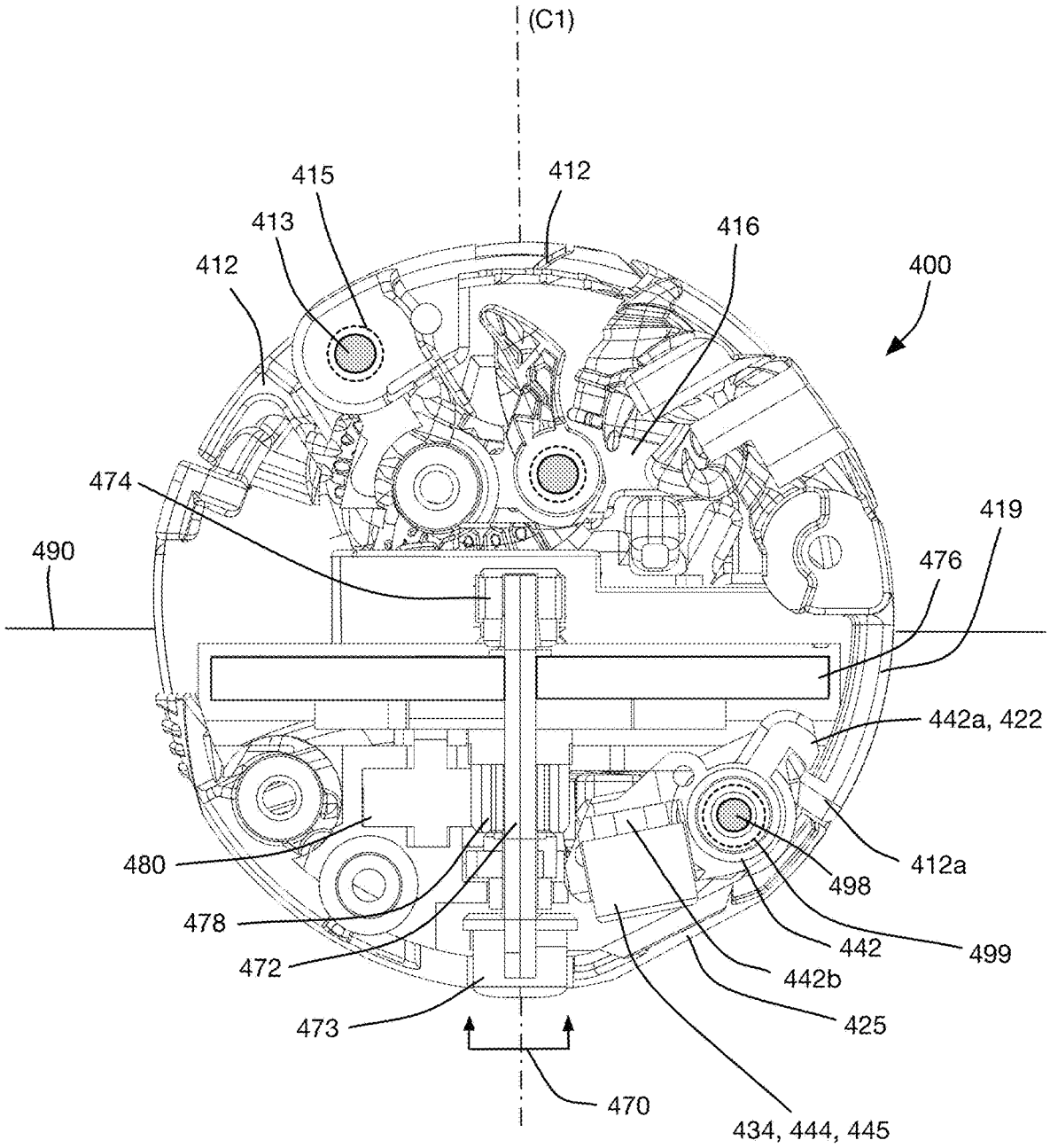
FIG. 4A shows a sectional view of an additional embodiment of the transformable toy.
Figure 4B:
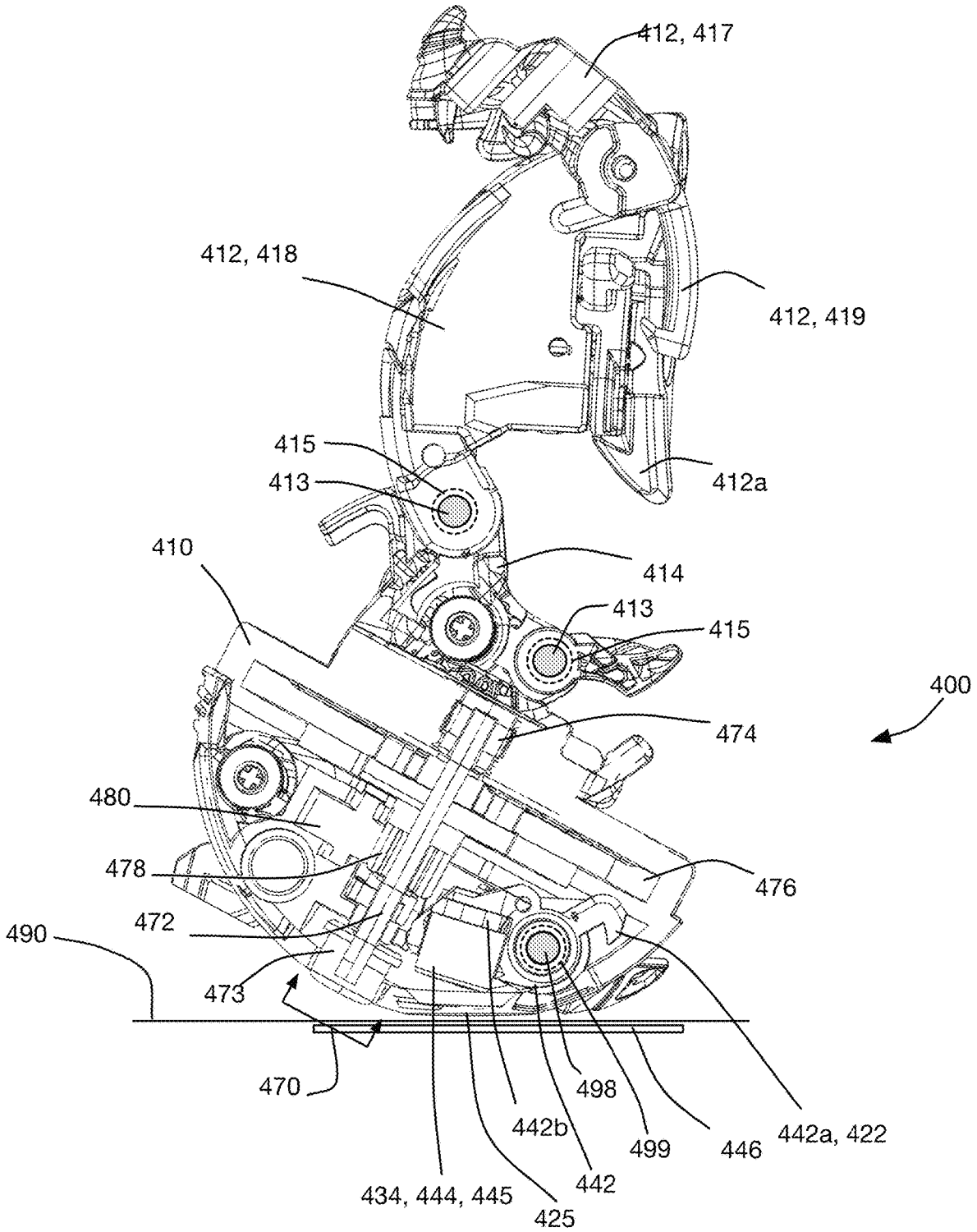
FIG. 4B shows a transformed, sectional view of the transformable toy of FIG. 4A.

Referring to the embodiments provided in FIGS. 4A and 4B, the transformable toy is a transformable toy 400 for use on a toy playing surface 490, which comprises a toy housing 410, a shaft assembly 470 that includes a flywheel 476, at least one movable housing element 412, a latch 422 and an actuator 434. The toy housing 410 includes at least one movable housing element 412 that is movable between a retracted position (see FIG. 4A) and an expanded position (see FIG. 4A), the at least one movable housing element 412 including a catch 412*a* and being biased towards the expanded position, and the latch 422 being positioned within the toy housing 410 such that when the at least one movable housing element 412 is moved to the retracted position, the latch 422 engages the catch 412*a* to retain the at least one movable housing element 412 in the retracted position. The actuator 434 of the transformable toy 400 is connected to the latch 422 and includes an interaction element 444. When the at least one movable housing element 412 is retained in the retracted position, the actuator 434 is actuatable to disengage the latch 422 from the catch 412*a* and release the at least one movable housing element 412. The actuator 434 is positioned within the toy housing 410 such that when the transformable toy 400 is spinning at or below a set speed, the interaction element 444 of the actuator 434 interacts with at least a portion of the toy playing surface 490 and drives an actuation of the actuator 434 to disengage the latch 422 member from the catch 412*a*. The transformable toy 400 also includes an access aperture 480 for charging the flywheel 476.

In an embodiment, the toy housing 410 and at least one movable housing element 412 are formed such that when the at least one movable housing element 412 is in the retracted position, a collective shape of the transformable toy 400 is substantially spherical.

In an embodiment, the toy housing 410 includes a housing body 414 to which the at least one movable housing element 412 is pivotably mounted. In this embodiment, the at least one movable housing element 412 is pivotably mounted so as to pivot between a retracted position in which the at least one movable housing element 412 is disposed close to the housing body 414, and an expanded position where the at least one movable housing elements 412 is disposed away from the housing body 414.

In an embodiment, each of the at least one movable housing element 412 is mounted on a shaft 413 to define a pivot axis of the at least one movable housing element 412 for pivoting between the retracted and expanded positions. In a further embodiment, the at least one movable housing element 412 includes a spring 415 connected about the shaft 413 that defines the pivot axis. The spring 415 is positioned to bias the at least one movable housing element 412 towards the expanded position by applying a force which turns the at least one movable housing element 412 about the shaft 413. The spring 415 may be any suitable type of spring, such as a torsion spring that has a first end mounted to an element of the housing body 414 and a second end engaged with the at least one movable housing element 412.

In the specific embodiments provided in FIG. 4A, a hollow cavity 416 is formed within the housing body 414. The at least one movable housing element 412 includes central movable housing element 417 and lateral movable housing elements 418. The central movable housing element 417 is pivotably mounted onto an upper portion of the housing body 414 and the lateral movable housing elements 418 are pivotably mounted onto upper left and right lateral portions of the housing body 414 such that the housing elements are pivotable relative to the housing body 414. The at least one movable housing element 412 also includes a horn element 419 that is pivotably mounted to the housing body 414 for movement between a retracted and expanded position. The horn element 419 has an arc-shape with a sharply curved end-portion. As shown in FIG. 4A, when in its retracted position, the horn element 419 is disposed in a space that is define between the central movable housing elements 417. The pivotable mounting of the horn element 419 to the top housing body 414 is about a first pivoting axis.

In an additional embodiment, the catch 412*a* of the at least one movable housing element 412 is defined by the sharply curved end of the horn element 419.

In an embodiment, the latch 422 and actuator 434 of the transformable toy 400 are formed on a pivot member 442 with free first and second ends 442*a*, 442*b*, the pivot member 442 being pivotally mounted within the toy housing 410 to pivot relative to the toy housing 410. The free first end 442*a* of pivot member 442 includes the latch 422 and the free second end 442*b* of the pivot member 442 includes an interaction element 444.

In this embodiment, the pivot member 442 is positioned in the interior of the toy housing 410, and the pivot member 442 is mounted about a pivot shaft 498 to define a pivot axis of the pivot member 442. The pivot member 442 is pivotable about the pivot axis in both a clockwise and anti-clockwise direction, to move the latch 422 between a latched position and an unlatched (or release) position, respectively.

In an additional embodiment, a spring 499 is connected about the pivot shaft 498 on which the pivot member 442 is mounted. The spring 499 is positioned to bias the pivot member 442 towards the latched position by applying a force which turns the pivot member 442 about the pivot shaft 498 towards the latched position.

In an additional embodiment, the interaction element 444 of the actuator 434 is a first magnetically responsive element 445 that is positioned on the free second end 442*b* of the pivot member for interacting with a second magnetically responsive element 446, wherein at least one of the first and second magnetically responsive elements 445, 446 is a magnet. In this way, an interaction of the first magnetically responsive element 445 with the second magnetically responsive element 446 produces an actuation of the actuator 434. In this same embodiment, the second magnetically responsive element 446 extends along or underneath at least a portion of the toy playing surface 490. The first magnetically responsive element 445 is mounted on a lower section of the free second end 442*b* of the pivot member 442, while the latch 422 is mounted at the free first end of the pivot member 442.

In a further embodiment of the embodiment where the interaction element 444 is the first magnetically responsive element 445, the toy housing 410 may include a thin-wall portion 425. As described above in relation to the thin-wall portion 125*a* of the bottom housing portion 120, the thin-wall portion 425 is formed on a lower section of the spherical form of the toy housing 410. The thin-wall portion 425 is shaped with a thickness such that the second magnetically responsive element 446 can act on, and attract the magnet of the pivot member 442 through the thin-wall portion, thereby driving the pivot member 442 from the unactuated to an actuated position and brining the magnet closer to the thin-wall portion 425.

In an embodiment, the toy housing 410 includes an aperture in place of the thin-wall portion 425. In this embodiment, the first magnetically responsive element 445 of the pivot member 442 will be attracted to the second magnetically responsive element 446 without having a structure between.

In an embodiment, the toy housing 410 is a continuous toy housing that contains the shaft assembly 470. By mounting the shaft assembly 470 within the toy housing 410, the transformable toy 400 can be driven to spin about the spinning axis S1 of the transformable toy 400 via the spinning of the flywheel.

In the specific embodiment of the transformable toy 400 provided in FIG. 4A, the shaft assembly 470 includes a shaft 472 that is rotatably mounted along a central axis of the toy housing 410, and a flywheel 476 mounted to the shaft 472. The shaft 472 defines a spinning axis S1 of the toy the flywheel 476, and the shaft 472 is rotatably mounted inside the toy housing 410. The flywheel 476 is chargeable to drive a spinning motion of the toy housing 410 about a spinning axis S1 in a spinning orientation. A lower end of the shaft 472 rotatably engages a first bearing 473 and an upper end of the shaft 472 rotatably engages a second bearing 474 within the toy housing 410. The flywheel 476 is mounted to the shaft 472 and rotates with the shaft 472, and a gear element 478 is also mounted to the shaft 472 such that the shaft 472, gear element 478 and flywheel 476 will rotate together when a force is applied to drive a rotation of the gear element 478 on the shaft 472. The gear element 478 includes a plurality of triangular teeth that are sized to interface with triangular teeth of a charging element for imparting a force to the gear element 478.

In an embodiment, the bearing 473 in the toy housing 410 extends through the toy housing 410 and projects through a bottom outer surface of the toy housing 410 to define a spin point formed on a bottom extent of the toy housing 410. The spin point is positioned such that as the transformable toy 400 is driven to spin about the spinning axis S1 by the flywheel 476, the transformable toy 400 will spin about the spin point.

In an additional embodiment where the spinning axis S1 is defined along the shaft 472 of the shaft assembly 470, the shaft 472 is rotatably mounted within the second bottom housing portion such that an end of the shaft 472 extends through the toy housing 410 to define spin point on which the transformable toy 400 spins about the spinning axis S1.

In an embodiment, the transformable toy 400 includes a weighted section that is disposed eccentrically about the spinning axis S1. The weighted section is relatively positioned within the toy housing 410 such that when the transformable toy 400 is spinning about the spinning axis S1 at or below the set speed, the transformable toy 400 will tip from the spinning orientation such that the spinning motion of the transformable toy 400 is stopped, and such that the interaction element 444 of the actuator 434 is interacted with.

In an embodiment, the transformable toy 400 is formed such that the weighted section is constituted by the latch 422 and actuator 434 on the pivot member 442. In this embodiment, the pivot member 442 including the latch 422 and actuator 434 are positioned offset from the central, spinning axis S1 of the transformable toy 400.

While the above embodiment was described with specific to one toy housing 410, it will be readily understood that the above-described mechanism of the toys spinning motion, and the opening of the toy at low spinning speeds, can be applied to any of the above embodiments where the transformable toy 400 includes multiple housing portions (e.g., the top housing portion and the second bottom housing portion) and where one of the multiple housing portions includes a flywheel 476 or similar driving element (e.g., the flywheel 476 in the second bottom housing portion).

In an additional embodiment, the transformable toy is a transformable toy 500 that includes a toy housing 510 and a shaft 572 assembly with a flywheel 576 for imparting a spinning motion to the transformable toy 500. In this embodiment, the toy 500 can be utilized as a spinning top as part of a spinning toy kit 501.

In an embodiment, spinning toy kit 501 is employed as part of a larger board and spinning top game, where the board and spinning top game includes playing cards associated with different game events and game characters, and where the spinning toy of the spinning toy kit 501 includes at least one spinning top that is associated with one or more playing cards of the game.

Figure 5A:
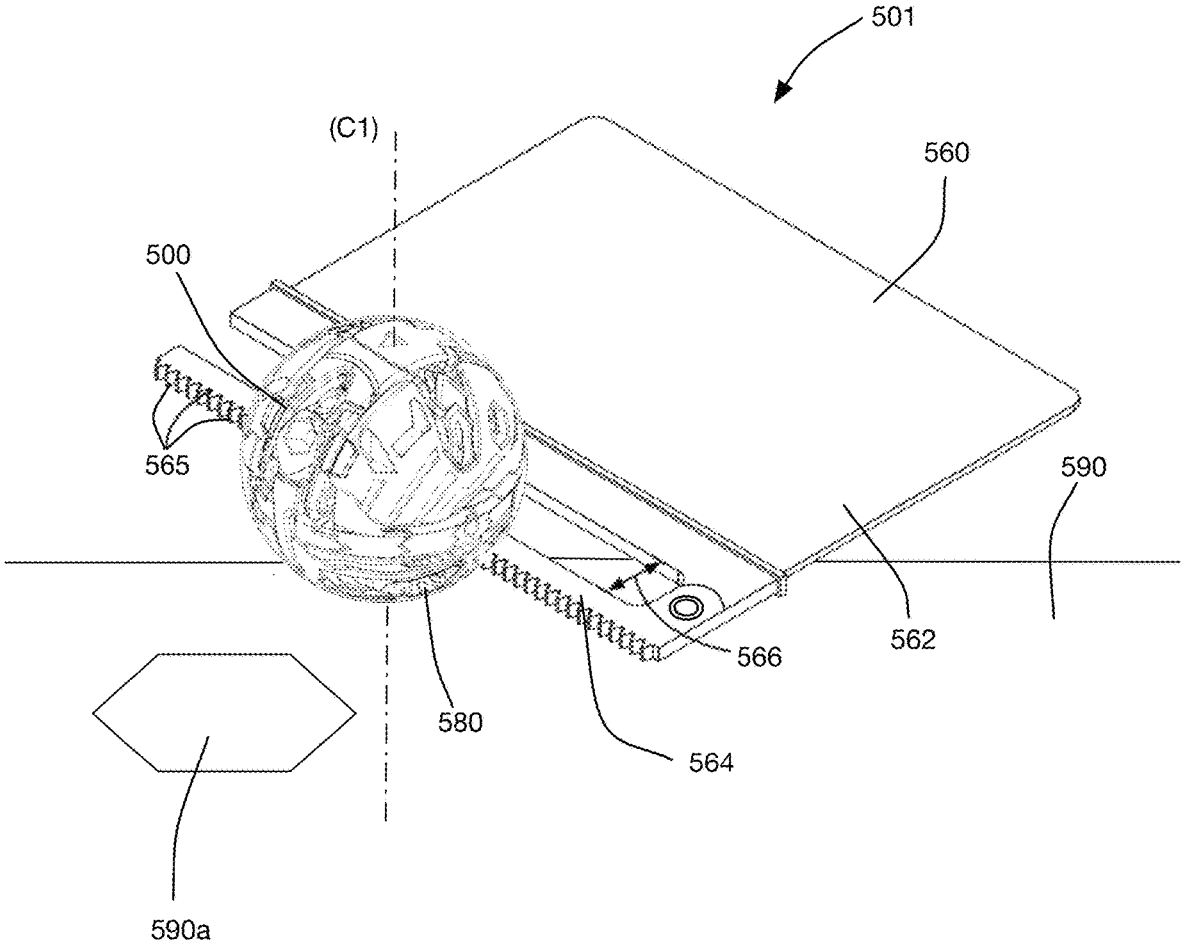
FIG. 5A shows an embodiment of the spinning toy kit including the transformable toy and the ripcord cardholder.
Figure 5B:
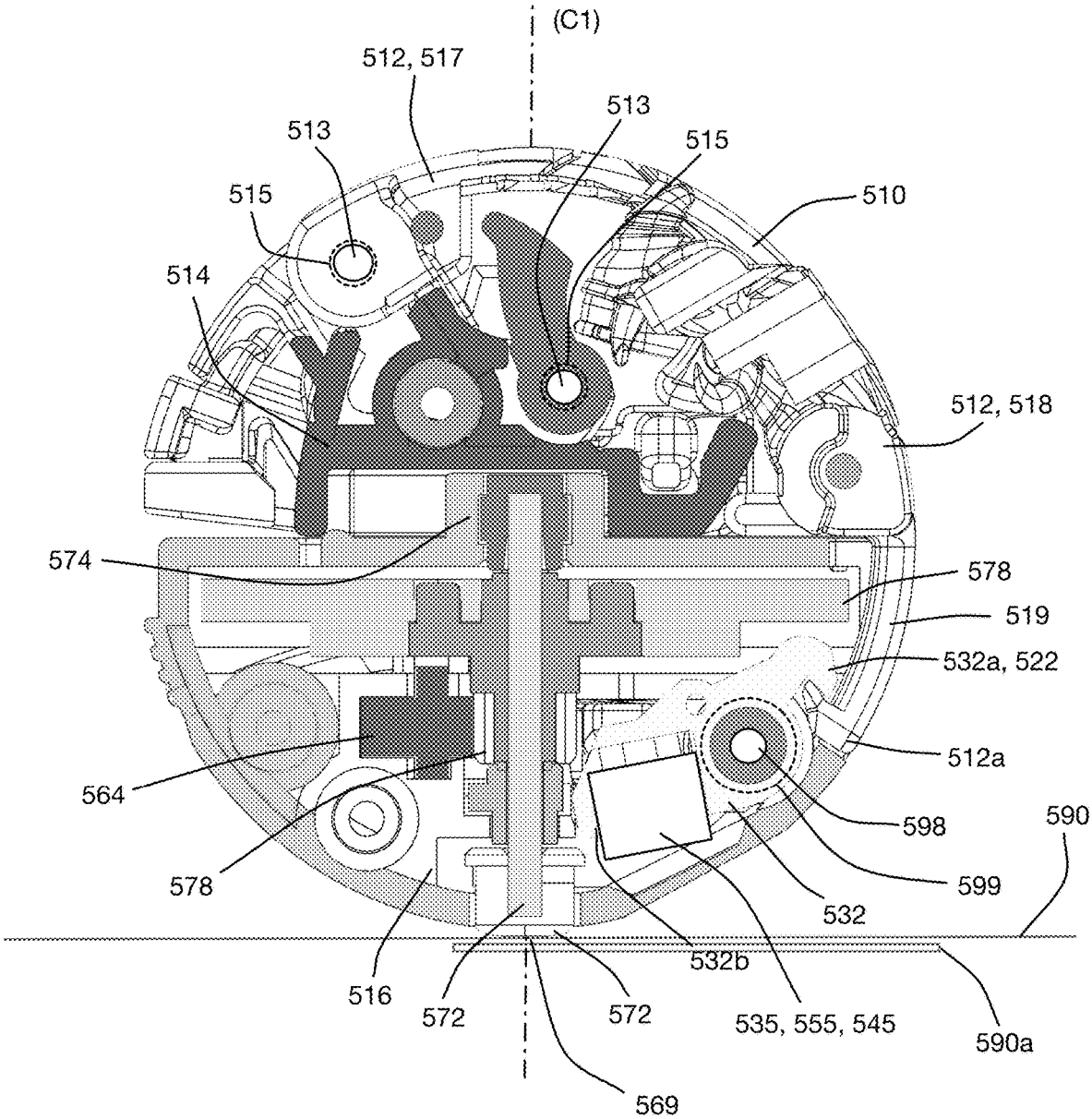
FIG. 5B shows a sectional view of an embodiment of the transformable toy and the ripcord member of the ripcord cardholder.
Figure 5C:
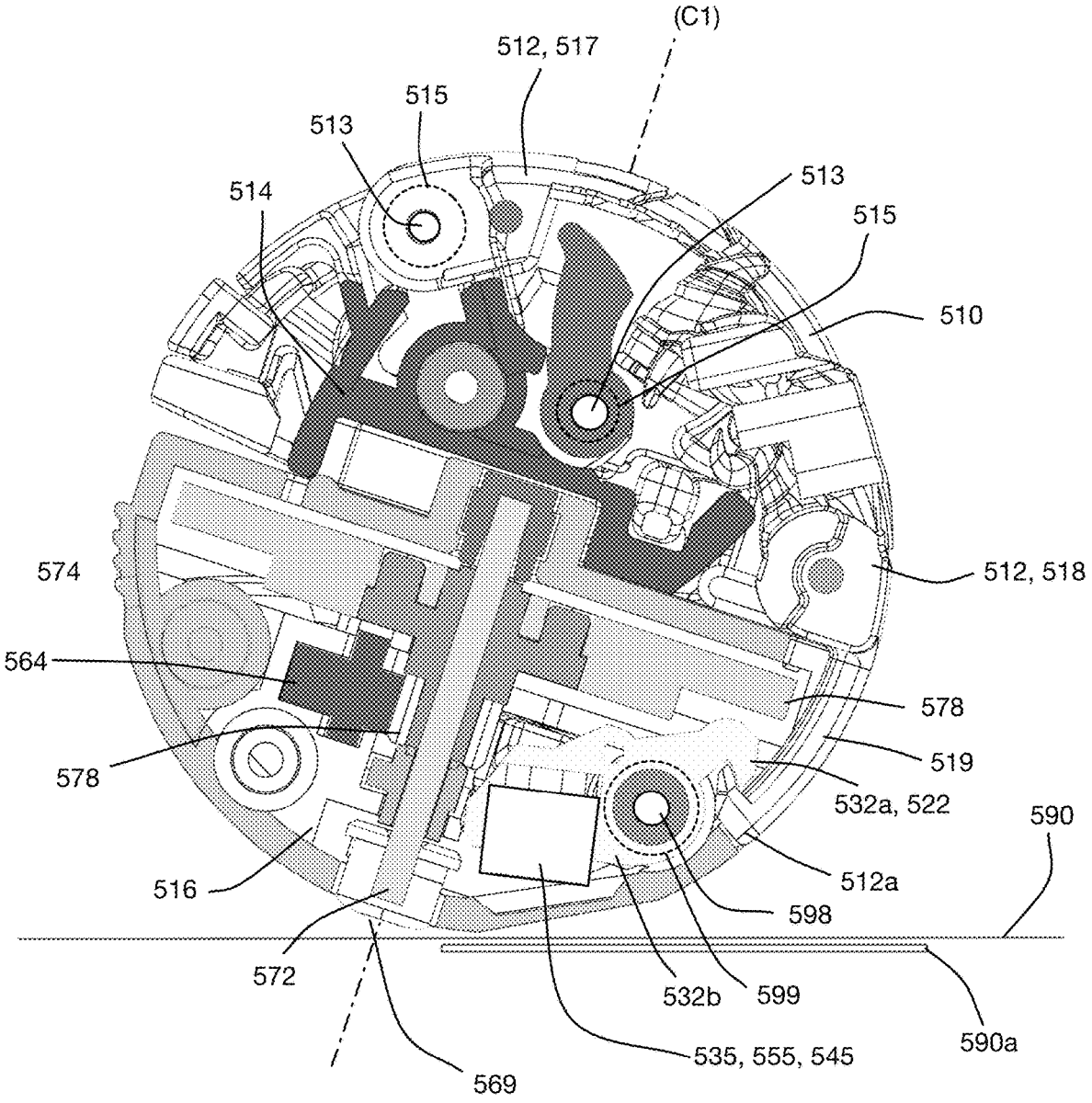
FIG. 5C shows a sectional view of an embodiment of the transformable toy and the ripcord member of the ripcord cardholder.
Figure 5D:
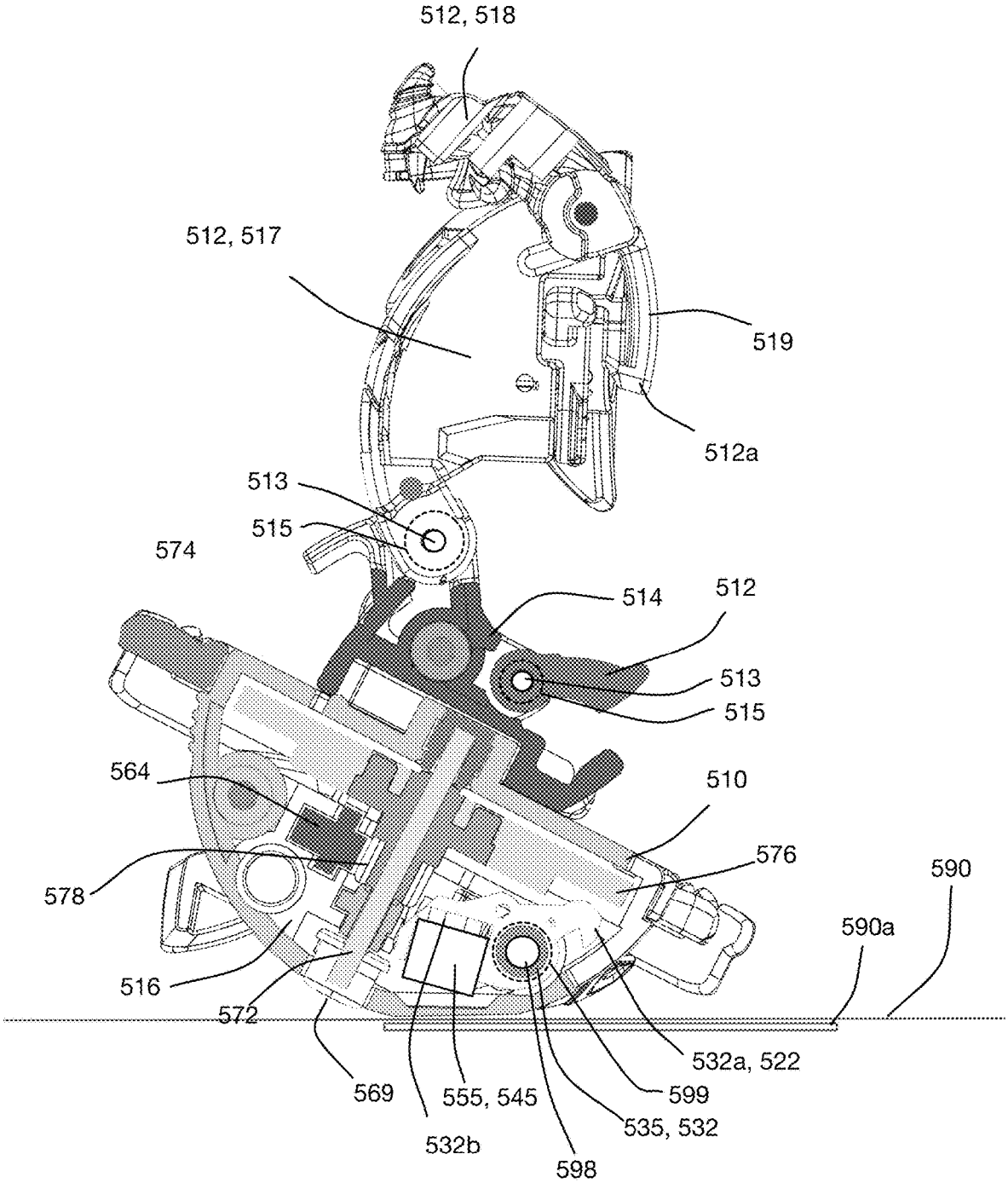
FIG. 5D shows a sectional view of an embodiment of the transformable toy and the ripcord member of the ripcord cardholder.
Figure 5E:
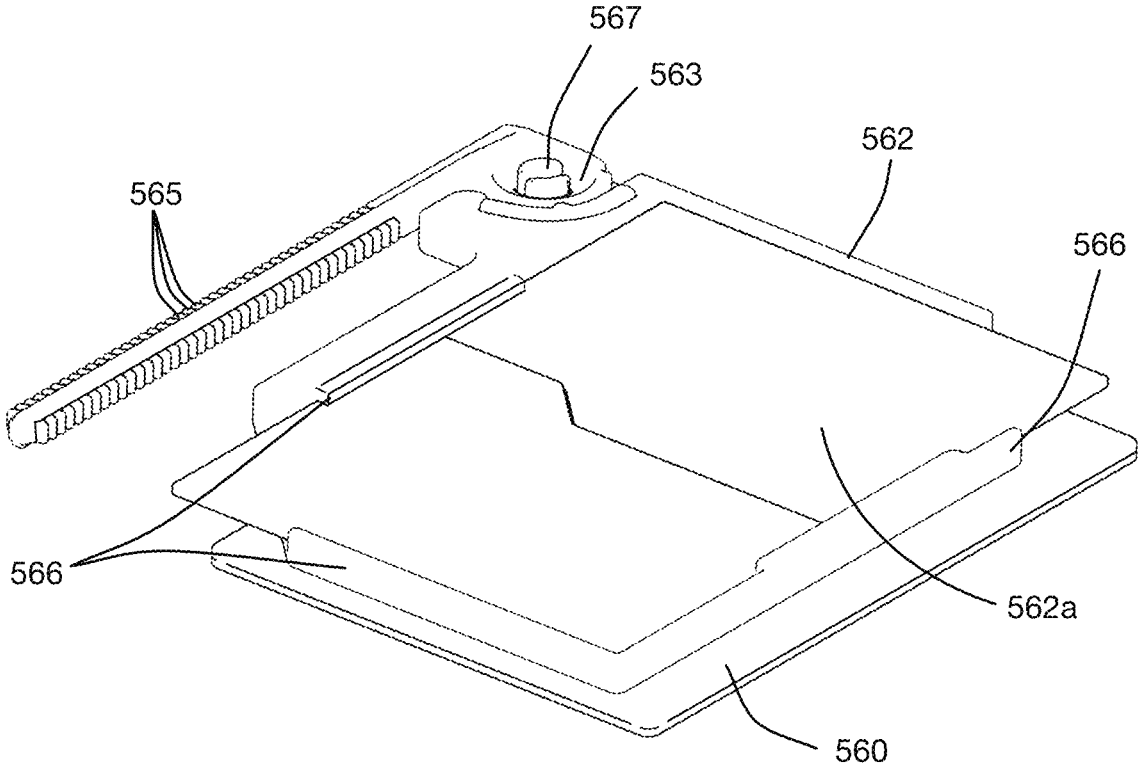
FIG. 5E shows an isometric view of an embodiment of the ripcord cardholder.

In an embodiment of the spinning toy kit 501 shown in FIGS. 5A and 5B, the spinning toy kit 501 includes a transformable toy 500 that includes at least one movable housing element 512 that is movable between a retracted position (See FIG. 5B, 5C) and an expanded position (See FIG. 5E). The at least one movable housing element 512 includes a catch 512*a* and is biased towards the expanded position. The transformable toy 500 also includes a latch 522 that is positioned within the transformable toy 500 such that when the at least one movable housing element 512 is moved to the retracted position, the latch 522 engages the catch 512*a* to retain the at least one movable housing element 512 in the retracted position. The transformable toy 500 also includes an actuator 535 connected to the latch 522 and being actuatable, when the at least one movable housing element 512 is retained in the retracted position, to disengage the latch 522 from the catch 512*a* and release the at least one movable housing element 512.

The at least one movable housing element 512 is mounted on a shaft 513 to define a pivot axis of the at least one movable housing element 512 for pivoting between the retracted and expanded positions. In a further embodiment, the at least one movable housing element 512 includes a spring 515 connected about the shaft 513 that defines the pivot axis. The spring 515 is positioned to bias the at least one movable housing element 512 towards the expanded position by applying a force which turns the at least one movable housing element 512 about the shaft 513 The spring 515 may be any suitable type of spring, such as a torsion spring that has a first end mounted to an element of the toy housing 510 and a second end engaged with the at least one movable housing element 512.

In addition, the transformable toy 500 includes a shaft assembly including a shaft 572 rotatably mounted within the toy housing 510 and positioned along a central axis C1 of the toy housing 510. In the specific embodiment provided in FIGS. 5B, 5C and 5D, the shaft 572 is rotatably mounted between two bearings 574 and 573. The shaft 572 assembly also includes a flywheel 576 mounted to the shaft 572, where the flywheel 576 includes a gear portion 578. The toy housing 510 also includes an access aperture 580 for accessing the flywheel of the shaft 572 assembly. By mounting the shaft 572 assembly within the toy housing 510, the transformable toy 500 can be driven to spin about the central axis C1 of the transformable toy 500.

In this same embodiment the spinning toy kit 501 also includes a ripcord cardholder 560 including a cardholder body 562 with a card holder formed to receive and removably hold at least one playing card associated with the spinning toy, and a ripcord member 564 including a length of triangular teeth 565 extending along at least a portion of at least one side thereof. The ripcord member 564 is movably mounted to a side of the card holder body and is sized for insertion into the access aperture 580 of the transformable toy 500 such that the triangular teeth 565 of the ripcord member 564 engage with the gear portion 578 of the flywheel 576 for driving a spinning motion of the flywheel 576.

In an additional embodiment, the toy 500 includes a downward projection formed on a bottom extent of the bearing 573 which defines a spin point 569 about which the toy housing 510 is driven to spin. In this embodiment, the spin point 569 is positioned such that as the transformable toy 500 is driven to spin about the central axis C1 by the flywheel 576, the transformable toy 500 will spin about the spin point 569.

In the specific embodiments provided in FIG. 5A and FIG. 5B, a hollow cavity 516 is formed within the toy housing 510. The at least one movable housing element 512 includes a central movable housing element 517 and lateral movable housing elements 518. The central movable housing element 517 is pivotably mounted onto an upper central portion of a housing body 514 of the toy housing 510 and the lateral movable housing elements 518 are pivotably mounted onto upper left and right lateral portions of the housing body 514 such that the housing elements are pivotable relative to the housing body. The at least one movable housing element 512 also includes a horn element 519 that is pivotably mounted to the top housing body 514 for movement between a retracted and expanded position. The horn element 519 has a roughly circular, arc-shape with a sharply curved end-portion. As shown in FIGS. 5B, when in its retracted position, the horn element 519 is disposed in a space that is define between the central movable housing elements 517. The pivotable mounting of the horn element 519 to the top housing body 514 is about a first pivoting axis.

In an additional embodiment, the catch 512*a* of the at least one movable housing element 512 that is retained by the latch 522 is defined by the sharply curved end of the horn element 519.

In an embodiment such as the embodiment provided in FIGS. 5B, 5C and 5D, the latch 522 and actuator 535 of the transformable toy 500 are formed on a pivot member 552 with free first and second ends, the pivot member 552 being pivotally mounted within the hollow cavity 516 of the toy housing 510 to pivot relative to the toy housing 510. The latch 522 is mounted at the free first end 552*a* of the pivot member 552 and an interaction element 555 is mounted at the free second end 552*b* of the pivot member 552. The pivot member 552 is positioned in the interior of either of the first and second bottom housing portions.

In this embodiment, a hollow portion of the pivot member 552 is mounted about a pivoting shaft to define a pivot axis of the pivot member 552. The pivot member 552 is pivotable about the pivot axis in both a clockwise and anti-clockwise direction. The pivot member 552 is pivoted in a clockwise direction (in the view shown in FIG. 5B) to a latched position, and is pivoted in the anti-clockwise direction to an unlatched or release position. The pivot member 552 includes a spring 599 connected about the shaft 572. The spring 599 is positioned to bias the pivot member 552 towards the latched position by applying a force which turns the pivot member 552 about the shaft 572 towards the latched position.

In an additional embodiment, the interaction element 555 of the actuator 535 is a first magnetically responsive element 545 that is positioned on the free second end 552*b* of the pivot member 552 for interacting with a second magnetically responsive element 546, wherein at least one of the first and second magnetically responsive elements 545 and 546 is a magnet. In this way, an interaction of the first magnetically responsive element 545 with a second magnetically responsive element drives an actuation of the actuator 535.

In an embodiment where the interaction element 555 is a first magnetically responsive element 545, the first magnetically responsive element 545 is a solid magnet. In this same embodiment, the second magnetically responsive element is defined by at least a portion of the toy playing surface 590 that is a magnetic portion 590*a* of the toy playing surface 590. As shown in the specific example of FIG. 5B, the magnet is mounted on a lower section of the free second end 552*b* of the pivot member 552, where the other end of the pivot member 552 includes the latch 522 hook. The magnet is mounted such that it is partially exposed on the pivot member 552.

In an embodiment of the transformable toy 500, the access aperture 580 of the toy housing 510 extends between opposing sides of the toy housing 510. The access aperture 580 is positioned in a lower half of the toy housing 510 such that some of the triangular teeth 565 of the gear element 578 at least partially extending into a path defined along the length of the access aperture 580. In this way, a suitably sized ripcord member 564 with a length of triangular teeth 565 can be inserted along the access aperture 580 such that the teeth of the gear element 578 interface with the teeth of the charging element. The interfacing of the gear element 578 and charging element causes the gear element 578 and shaft 572 to rotate inside the toy housing. The flywheel will then rotate with the shaft 572 and from this rotation, can transfer a spinning motion to the toy housing 510 when the transformable toy 500 is placed on the playing surface 590.

Figure 5F:
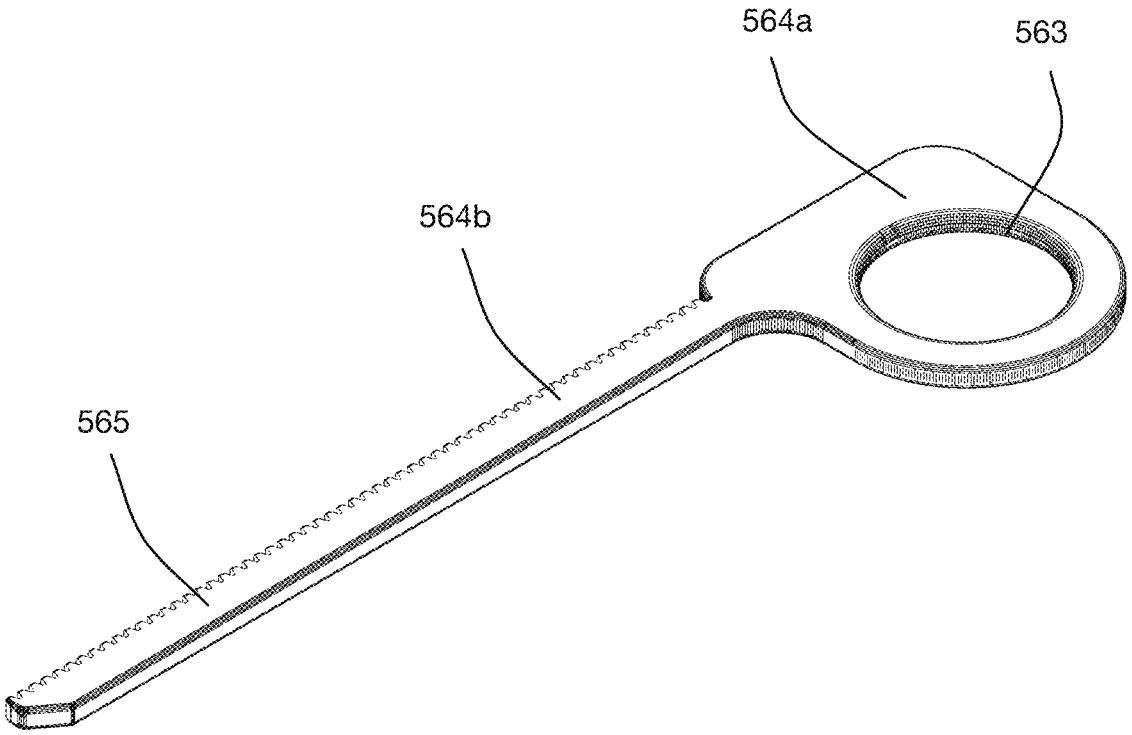
FIG. 5F shows an isometric view of an embodiment of the ripcord member of the ripcord cardholder.

In the embodiment provided in FIGS. 5A, 5D and 5F, the ripcord member 564 has a length that is greater than a length of the access aperture 580 such that the ripcord member 564 can extend all the way through and beyond the access aperture 580 of the toy housing 510 when inserted into the access aperture 580. In this way, the ripcord member 564 provides an extended length of teeth 565 for applying a large torque to the gear element 578 of the shaft assembly 570.

In the embodiments provided in FIGS. 5E and 5F, the ripcord member 564 of the ripcord cardholder 560 includes a connecting section 564*a* and a ripcord section 564*b*. The ripcord section 564*b* is a relatively long and thin extension of the ripcord member 564 that includes at least one set of triangular teeth extending along the ripcord section. The connecting section 564*a* of the ripcord member 564 includes a connecting aperture 563 extending through the connecting section 564*a*. In the specific embodiment of FIG. 5E, the at least one set of triangular teeth is two sets of the triangular teeth 565 extending along opposing sides of the ripcord section 564*b*.

In this same embodiment, the ripcord cardholder 560 includes a rectangular cardholder body 562. The cardholder body 562 includes a connecting projection 567 that extends outward from a surface of the cardholder body 562, where the projection 567 that is sized to receive in the connecting aperture 563 of the ripcord member 564. The connecting projection 567 of the cardholder body 562 is rotatably connected within the connecting aperture 563 of the ripcord member 564 such that the ripcord member 564 can be pivoted relative to the cardholder body 562. The cardholder body 562 also includes a substantially planar surface 562*a* and a plurality of tabs 566 that are slightly raised from the surface of the substantially planar surface 562*a*. In this way, a portion of the at least one playing card can be removably secured on the cardholder by sliding a portion of the at least one playing card between one of the plurality of tabs 566 and the substantially planar surface 562*a*.

In the embodiments of the transformable toy where the transformable toy includes a driving element, and where the driving element imparts a spinning motion to the transformable toy, the toy can be utilized as a spinning top for spinning games. In an embodiment, the spinning, transformable toy is used as a battling, spinning toy that is spun in proximity to other spinning toys, and contacts the other spinning toys.

In some embodiments, the transformable toy 200*a*, 200*b*, 400, 500 is defined as a battling, spinning toy 600. In an additional embodiment, the battling, spinning toy 600 includes at least one removably connectable battling accessory for altering an appearance, shape, weight or spinning characteristic of the spinning toy 600.

Figure 7A:
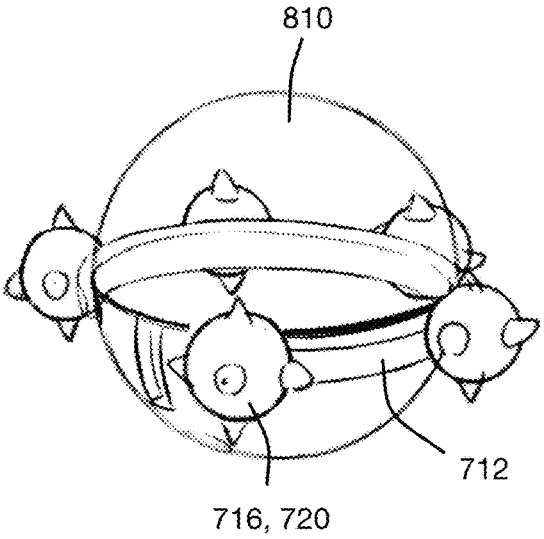
FIG. 7A shows a first exemplary embodiment of an adaptor ring on a spinning, transformable toy as presented herein.
Figure 7B:
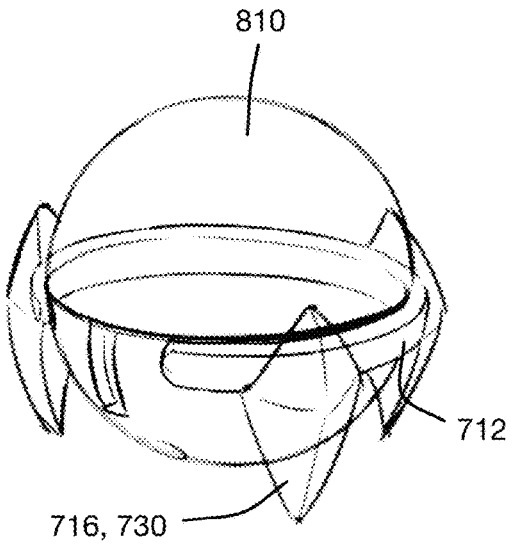
FIG. 7B shows a second exemplary embodiment of an adaptor ring on a spinning, transformable toy, as presented herein.
Figure 7C:
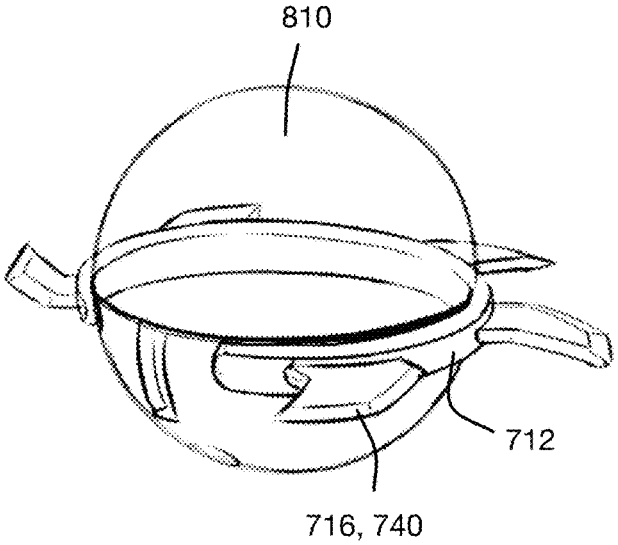
FIG. 7C shows a third exemplary embodiment of the adaptor ring on a spinning, transformable toy, as presented herein.

Referring to the embodiments provided in FIGS. 7A to 7C, the at least one removably connectable battling accessory is one or more removably connectable adaptor rings 710. The removably connectable adaptor ring 710 includes a body member 712 with a hollow, inner circular form. In an embodiment, the adaptor ring 710 includes a plurality of projections 716 that extend outward from the body member 712, and which are equally spaced around the circumference of the body member 712.

The specific examples provided in FIGS. 7A, 7B and 7C show three embodiments of the projections 716 of the body member 712, including an adaptor ring 810 with a plurality of spherical, uneven projections 716, 720, an adaptor ring 810 with a plurality of wedge-shaped projections 716, 730, and an adaptor ring 810 with a plurality of "fin" shaped projections 716, 740.

In the embodiments where the transformable toy includes an adaptor ring, the toy housing is formed to include circumferential channel 720 sized to extend around at least half of the circumference of the transformable toy. The circumferential channel 720 is sized for receiving and removably holding an adaptor ring. In this way, multiple adaptor rings 710 can be interchangeably provided to the transformable toy to realize different appearances and spinning characteristics of the toy.

Figure 6A:
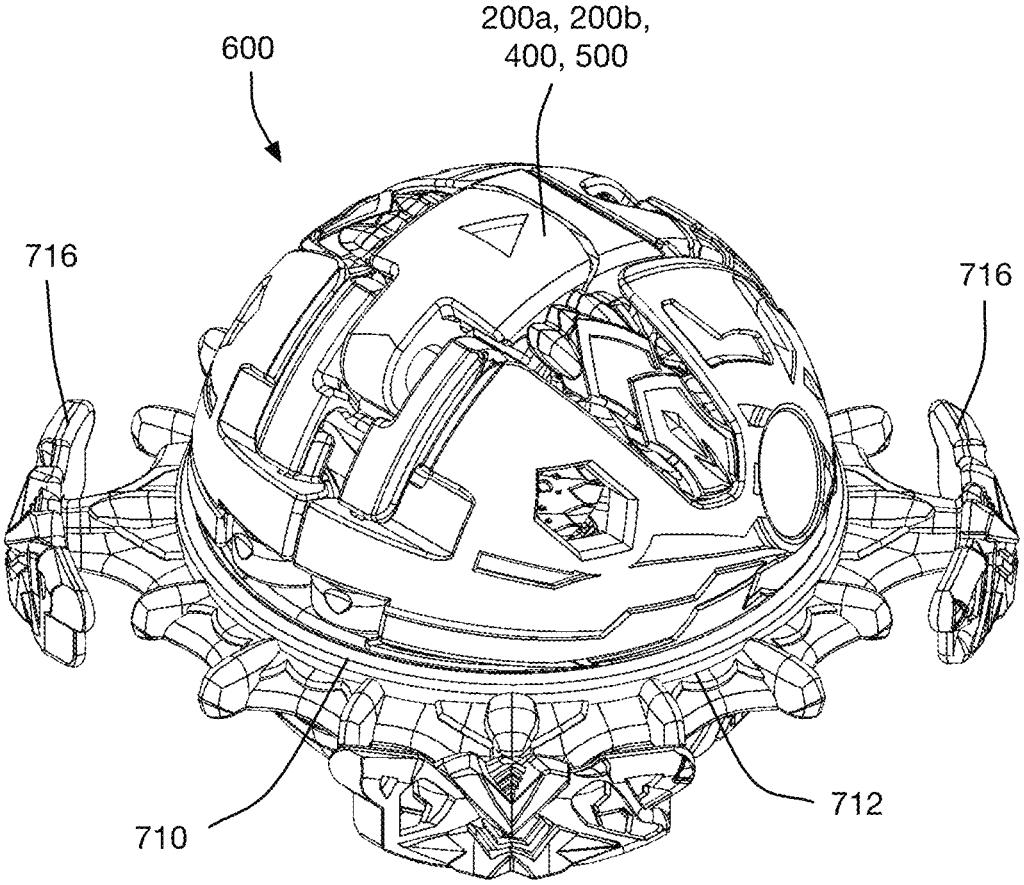
FIG. 6A shows an isometric view of an embodiment of the spinning, transformable toy that includes an attached adaptor ring.
Figure 6B:
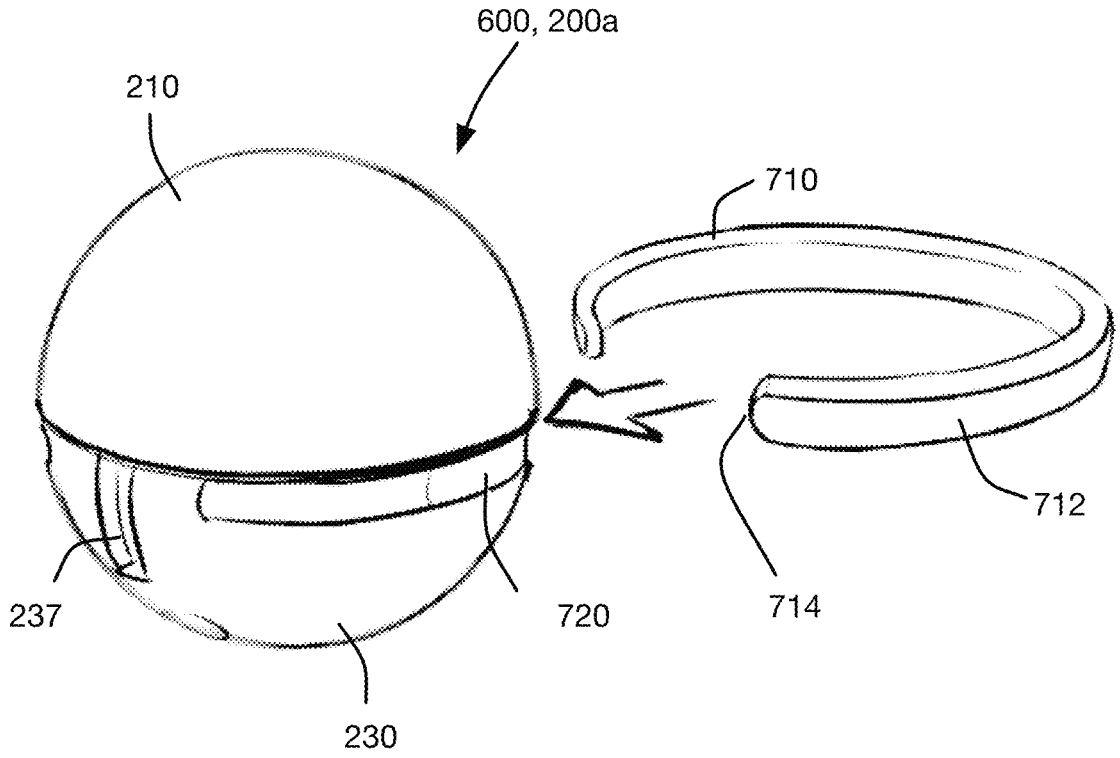
FIG. 6B shows a schematic diagram of an embodiment of the adaptor ring being attached to an embodiment of a spinning toy.
Figure 6C:
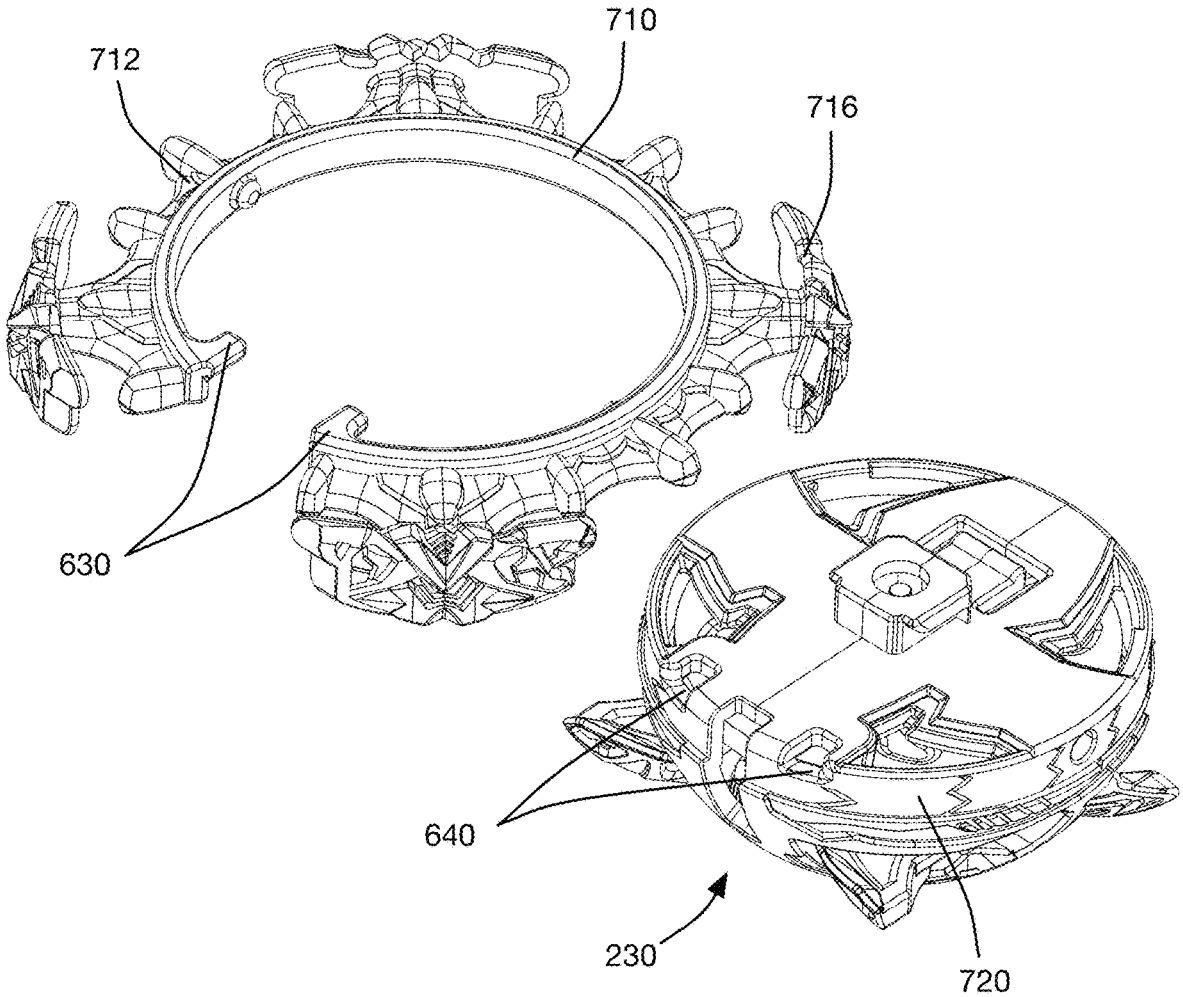
FIG. 6C shows an isometric, transformed view of the transformable toy of FIG. 6A.

In the specific embodiment provided in FIG. 6C, the circumferential channel 720 is formed in the bottom housing portion and includes a pair of inwardly extending slots 640 positioned at each end of the circumferential channel 720. In this embodiment, the adaptor rings 710 each includes pairs of corresponding tabs 630 on the ends thereof, where the inwardly extending slots 640 are sized to receive the tabs 630 of the adaptor ring 710 to prevent relative rotation of adaptor ring 710 about the transformable toy.

In the specific embodiment provided in FIG. 7C, the body member 712 of the adaptor rings 710 defines an opening 714 in the inner circular form of the adaptor ring 710 for inserting the adaptor ring 710 around one of the transformable toys, such as transformable toy 200*a*. In this embodiment, adaptor ring 710 of the transformable toy 200*a* is formed to be resiliently flexible such that the inner circular form of the adaptor ring 710 can be bent around the transformable toy 200*a* when the opening 714 in the adaptor ring 710 is inserted around the transformable toy 200*a*.

Embodiments of Toy Arena:

In an additional aspect of the present disclosure, there is provided a modular arena 800 that includes one or more modular components. The modular arena 800 is formed for use in a battling spinning top game, where multiple battling, spinning toys are spun in proximity to one another within the arena, and where the spinning toys spin and contact each other as part of a battling game.

In an embodiment of the modular arena 800, the modular arena 800 is provided for use with at least one spinning toy that is driven to spin via a ripcord member 810 including a length of triangular teeth extending along at least one edge of the ripcord member 810. The modular arena 800 includes an inwardly disposed portion 820 that defines a playing surface 822 for the at least one spinning top. The modular arena 800 also includes at least one outer wall portion 830. In this embodiment, the at least one of the outer wall portion 830 includes a contact actuator 840 mounted to the at least one outer wall portion 830. The contact actuator 840 includes a driving portion 842 that interfaces with the triangular teeth of the ripcord member 88, and an actuating portion 844 that extends over the playing surface 822 of the modular arena 800. The actuating portion 844 is connected to the driving portion 842 such that an interaction of the ripcord member 810 and the driving portion 842 drives an actuation of the actuating portion 844 between at least a first position and a second position about the surface of the modular arena. The actuating portion 844 is connected to the driving portion 842 such that an interfacing of the ripcord 810 and the driving portion 842 actuates the actuating portion 844 between the first position and the second position about the surface such that the actuating portion 844 contacts the spinning toy and alters at least one of a spin speed and a direction of the spinning toy.

In an embodiment, the ripcord member 810 the drives the at least one spinning top to spin is the ripcord member 564 of the ripcord cardholder 560 described previously.

In an additional embodiment, the at least one outer wall portion 830 is removably connectable to the inwardly disposed portion 820 of the modular arena 800 to at least partially surround a portion of the playing surface 822.

In an embodiment, the plurality of spinning tops are a plurality of the transformable toys as described herein, where the transformable toys can be any one or combinations of the various spinnable embodiments of the transformable toy as disclosed herein (including transformable toy 200*a*, transformable toy 200*b*, transformable toy 400 and transformable toy 500.

In an embodiment, the modular arena 800 includes one or more modular components that are removably connectable to and about the inwardly disposed portion 820 of the modular arena 800. In an additional embodiment, the one or more modular components of then modular arena 800 includes at least one contact actuator 840, where the contact actuator 840 is operated by a ripcord member 810 that is also used for driving at least one of the plurality of spinning tops to spin.

Figure 8A:
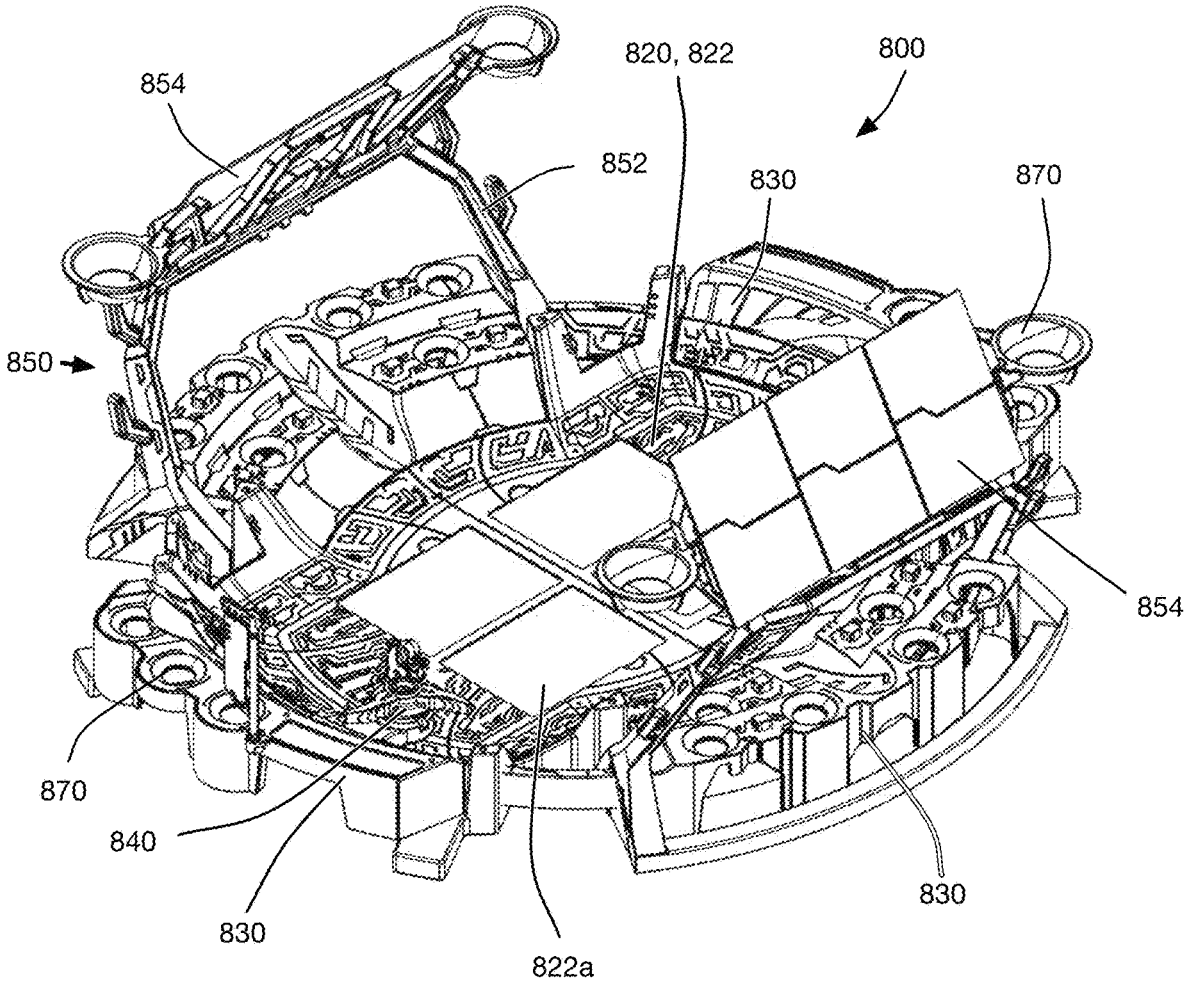
FIG. 8A shows an embodiment of the modular arena according to the present disclosure.
Figure 8B:
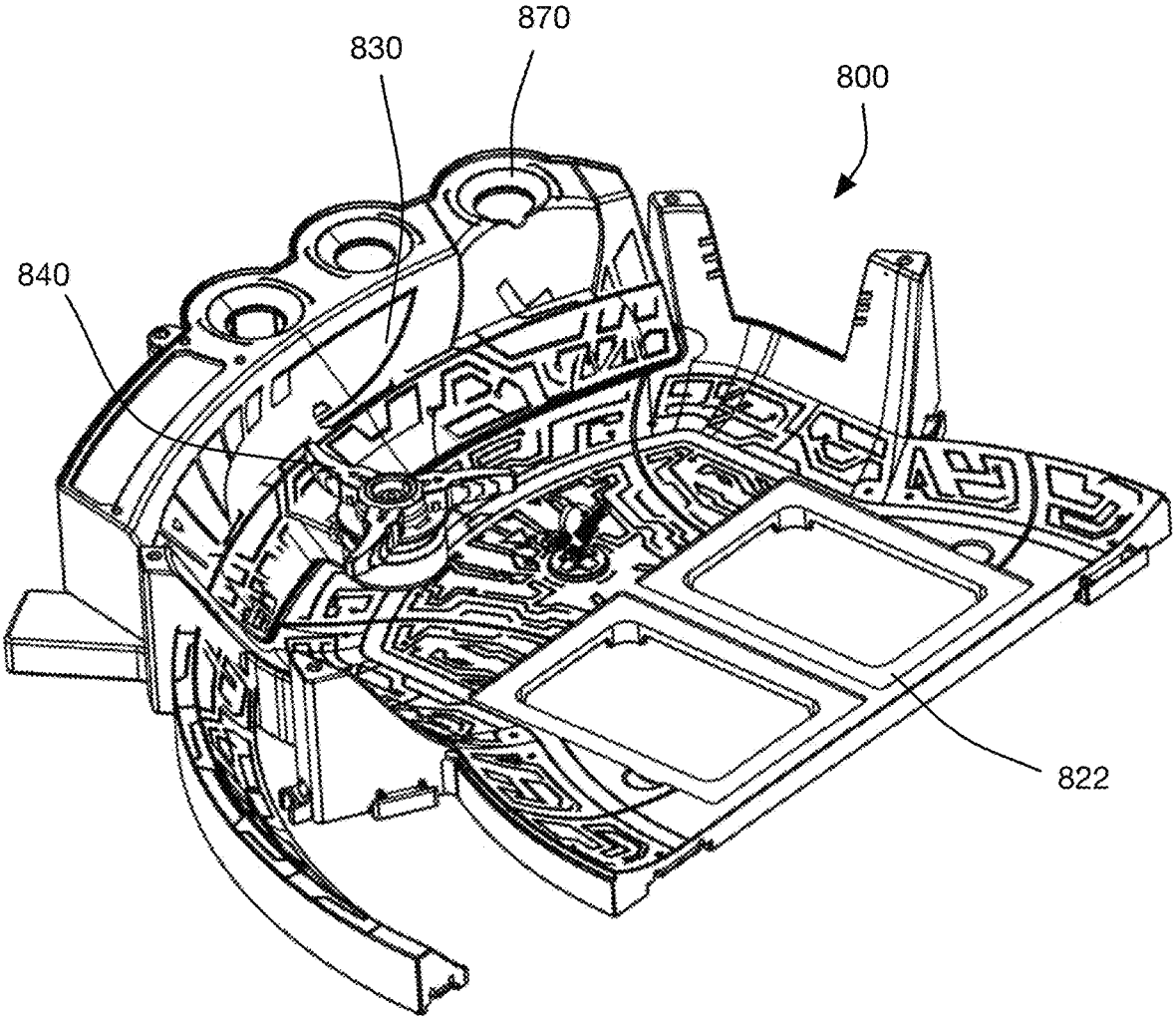
FIG. 8B shows a cut-out view of a portion of the modular arena from FIG. 8A that includes a contact actuator.
Figure 8C:
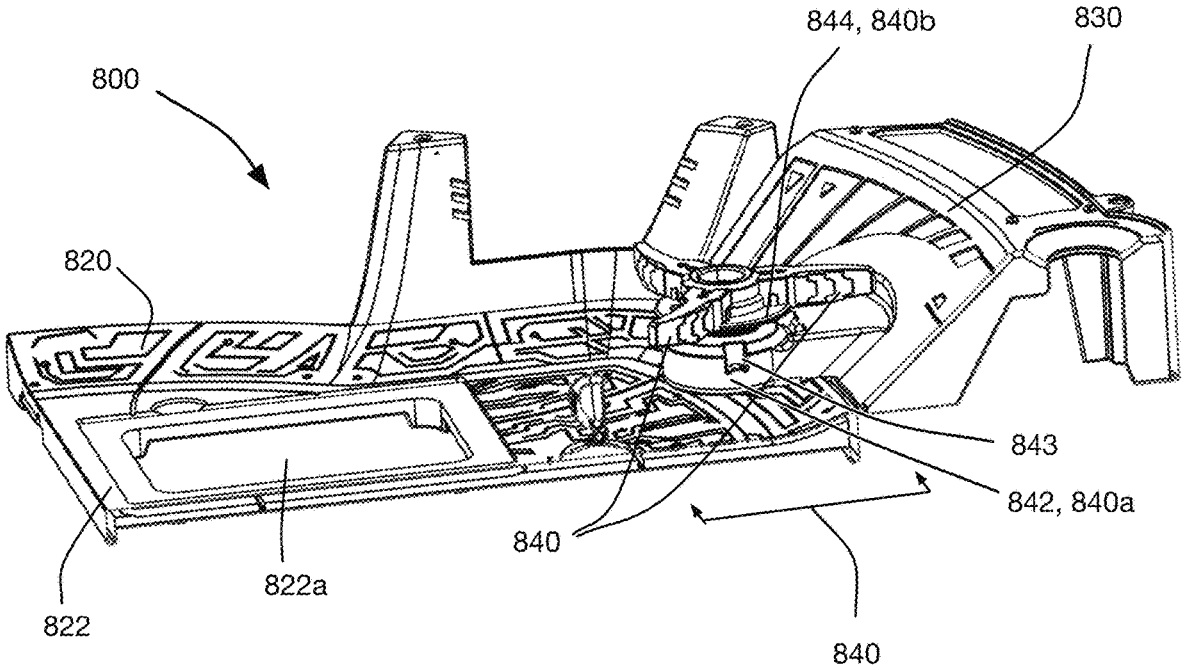
FIG. 8C shows an additional cut-out view of a portion of the modular arena in FIG. 8A that includes contact actuator.
Figure 8D:
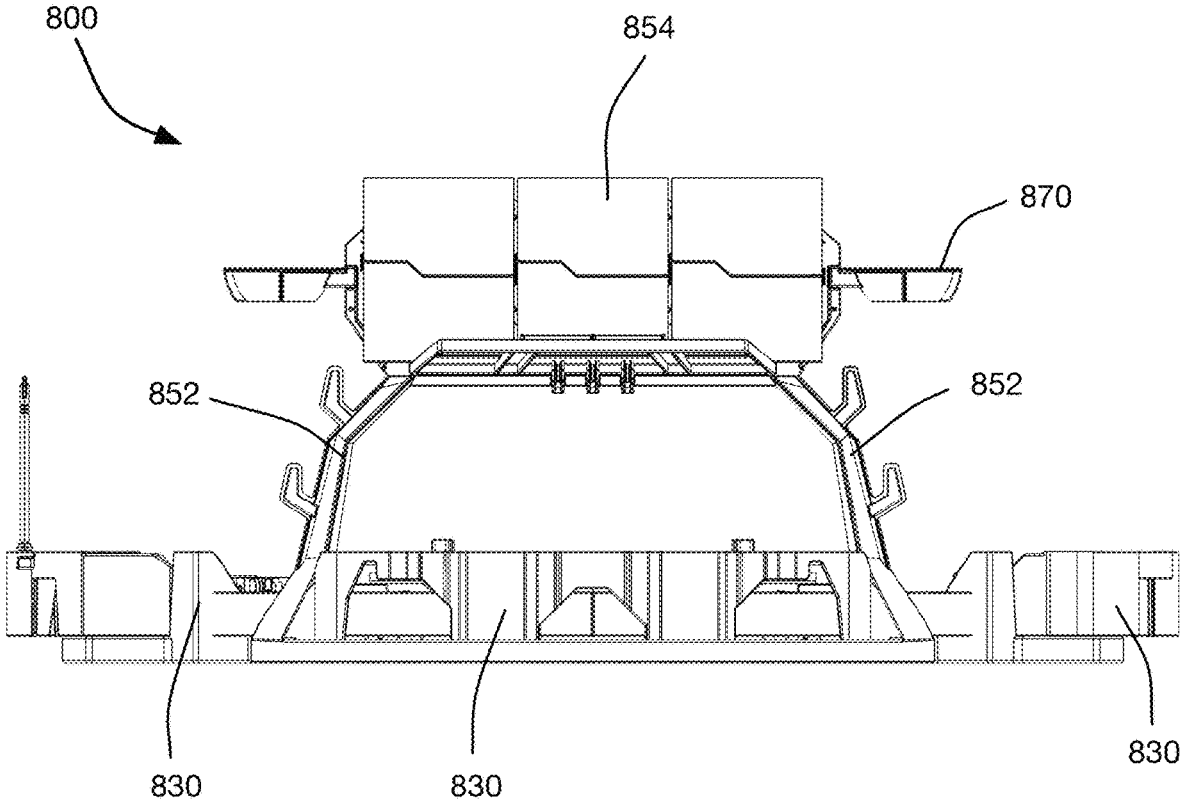
FIG. 8D shows a side-view of the embodiment of the modular arena provided in FIG. 8A.

In the specific embodiment of the modular arena 800 provided in FIGS. 8A and 8D, the modular arena 800 has a generally ovular form and includes the playing surface 822 for the plurality of spinning tops. The modular arena 800 includes a plurality of interchangeable wall portion 830*s* that are disposed around a plurality of sides of the playing surface 822. In the embodiment shown, a wall portion 830 is positioned on four sides of the ovular playing surface 822 to provide a relatively continuous wall of the arena around the playing surface 822. Two of the wall portions 830 includes elevated card stands 850. The card holding stands includes a pair of support members 852 and a support platform 854 that is inclined at an angle over an edge of the playing surface 822. The support platform 854 is sized such that at least one playing card can be placed on, and supported by, the support platform 854.

In the specific embodiment of FIG. 8A, the two wall portions 830 that include the elevated card stands 850 also include a launch ramp for rolling at least one transformable toy onto the playing surface 822 of the modular arena 800. In this embodiment, the launch ramps are each defined by a sloping recess that is integrally formed within the respective wall portions 830.

In the specific embodiment provided in FIG. 8C, an embodiment of the contact actuator 840 is shown attached to a wall portion 830. The contact actuator 840 has the form of a three-arm spinning wheel. In this embodiment, the spinning wheel includes a base portion 840*a* and a rotating top 840*b* that spins relative to the base portion 840*a*. The driving portion 842 of the contact actuator 840 is contained within the base portion 840*a* and the base portion 840*a* includes a through-aperture 843 for inserting a ripcord member 88 into the driving portion 842 of the contact actuator 840. The actuating portion 844 is defined by the rotating top 840*b* of the three-arm spinning wheel and includes three curved arms 840*c* extending radially outward from the rotating top 840*b*.

In an embodiment such as the embodiment provided in FIGS. 8A to 8D, the at least one wall portion 830 includes a holding recess 870. The holding recess 870 is sized and shaped to support a transformable toy when the transformable toy is not being used on the playing surface 822.

In an additional embodiment, at least one of the interchangeable wall portions 830 includes a contact actuator 840 as described above.

In the embodiment shown in FIGS. 8A and 8C, the playing surface 822 includes a plurality of recesses 822*a* sized to removably hold an interchangeable section of the playing surface 822. The playing surface 822 also includes several upwardly projecting portions that are integrally formed with, and extend upward from, the playing surface 822. In use, an interchangeable section of the playing surface 822 is provided in each of the plurality of recesses 822*a* such that a substantially continuous playing surface 822 is formed.

In many embodiments, it has been shown for the interaction element to be a first magnetically responsive member, which interacts with a second magnetically responsive member that is external to the transformable toy. It will be noted, however, that the interaction element could be some other type of member, such as a projection member on the pivot arm, which projects slightly downward from the immediately adjacent outer surface of the transformable toy, such that dropping the transformable toy would cause the projection member to hit whatever support surface the transformable toy is dropped on, which in turn drives the projection member upwardly into the body of the transformable toy. Driving the projection member upwardly may be the movement that, in turn, drives the pivot arm to pivot in such a way as to move the latch to the unlatched or release position.

In all the embodiments shown in the figures the transformable toy was positionable in a position in which it is a sphere, which permits the transformable toy to be rolled along a support surface. The transformable toy may be said to be in a rollable state, when it has the spherical shape. However, it will be noted that the transformable toy could be shaped differently than a sphere in the rollable state. For example, the transformable toy could be shaped in a cylindrical form. Alternatively the transformable toy could be shaped as a polyhedron with a sufficient number of faces and corners that it approximates a sphere and is rollable. As yet another alternative the transformable toy in the rollable state, could be shaped as a vehicle with wheels, and is therefore rollable.

The above-described embodiments are intended to be examples of the present disclosure and alterations and modifications may be affected thereto, by those of skill in the art, without departing from the scope of the disclosure that is defined solely by the claims appended hereto.

What is claimed is:

1. A transformable toy comprising:

a top housing portion including a connector and at least one movable housing element that is movable between a retracted position and an expanded position, the at least one movable housing element being biased towards the expanded position and including a catch, the connector being separably connectable to each of a first bottom housing portion and a second bottom housing portion, each of the first bottom housing portion and the second bottom housing portion including a latch and an actuator connected to the latch, the latch being positioned within each of the first bottom housing portion and second bottom housing portion such that when the top housing portion is separably connected to one of the first and second bottom housing portions, and when the at least one movable housing element is moved to the retracted position, the latch engages the catch to retain the at least one movable housing element in the retracted position, wherein, when the at least one movable housing element is retained in the retracted position by the latch, the actuator is actuatable to disengage the latch from the catch and release the at least one movable housing element, wherein the second bottom housing portion includes a driving element operably mounted within the second bottom housing portion for driving a motion of the second bottom housing portion and the top housing portion along a support surface, and wherein the first bottom housing portion either is devoid of any driving element for driving motion of the first bottom housing portion, or includes a driving element that is different than the driving element of the second bottom housing portion and is operably mounted within the first bottom housing portion for driving a motion of the first bottom housing portion and the top housing portion along the support surface.

2. The transformable toy of claim 1, wherein the latch includes a pivot member and a first magnetically responsive element provided on an end of the pivot member for interacting with a second magnetically responsive element, wherein an interaction of the first magnetically responsive element and the second magnetically responsive element drives an actuation of the actuator.

3. The transformable toy of claim 1, wherein the top housing portion and each of the first bottom housing portion and second bottom housing portion are individually shaped such that when the top housing portion and one of the first and second bottom housing portions are separably connected and when the at least one movable housing element is in the retracted position the transformable toy is rollable along the support surface about at least one rotational axis of the transformable toy, and when the at least one movable housing element is in the expanded position, the at least one movable housing element inhibits rolling of the transformable toy about the at least one rotational axis.

4. The transformable toy of any of claim 1, wherein the shape of each of the first and second bottom housing portions is substantially hemispherical, and wherein the shape of the top housing portion when the at least one movable housing element is in the retracted position is hemispherical.

5. The transformable toy of claim 1, wherein the second bottom housing portion includes a through-opening for accessing and driving a motion of the driving element.

6. The transformable toy of claim 5, wherein the driving element of the second bottom housing portion is a shaft assembly including:

a shaft rotatably mounted within the second bottom housing portion along a central axis of the second bottom housing portion; and a flywheel mounted to the shaft.

7. A transformable toy comprising:

a top housing portion including a connector and at least one movable housing element that is movable between a retracted position and an expanded position, the at least one movable housing element being biased towards the expanded position and including a latch and an actuator connected to the latch, the connector being separably connectable to one of a first bottom housing portion and a second bottom housing portion, each of the first bottom housing portion and the second bottom housing portion including a catch positioned such that when the top housing portion is separably connected to one of the first and second bottom housing portions, and when the at least one movable housing element is moved to the retracted position, the latch engages the catch to retain the at least one movable housing element in the retracted position, the actuator being actuatable, when the at least one movable housing element is retained in the retracted position, to disengage the latch from the catch and release the at least one movable housing element, the second bottom housing portion including a driving element operably mounted within the second bottom housing portion to drive a motion thereof.

8. The transformable toy of claim 7, wherein the latch includes a pivot member and a first magnetically responsive element provided on an end of the pivot member for interacting with a second magnetically responsive element, wherein at least one of the first magnetically responsive elements is a magnet, wherein an interaction of the first magnetically responsive element and the second magnetically responsive element drives an actuation of the actuator.

9. The transformable toy of claim 7, wherein the top housing portion and each of the first bottom housing portion and second bottom housing portion are individually shaped such that when the top housing portion and one of the first and second bottom housing portions are separably connected and when the at least one movable housing element is in the retracted position the transformable toy is rollable along the playing surface about at least one rotational axis of the transformable toy, and when the at least one movable housing element is in the expanded position, the at least one movable housing element inhibits rolling of the transformable toy about the at least one rotational axis.

10. The transformable toy of claim 7, wherein the shape of each of the first and second bottom housing portions is hemispherical; and wherein the shape of the top housing portion when the at least one movable housing element is in the retracted position is hemispherical.

11. The transformable toy of claim 7, wherein the second bottom housing portion includes a through-opening for accessing and driving a motion of the driving element.

12. The transformable toy of claim 11, wherein the driving element of the second bottom housing portion is a shaft assembly including:

a shaft rotatably mounted within the second bottom housing portion along a central axis of the second bottom housing portion; and a flywheel mounted to the shaft.

13. A transformable toy for use on a playing surface, the transformable toy comprising:

a top housing portion including at least one movable housing element that is movable between a retracted position and an expanded position, the at least one movable housing element including a catch and being biased towards the expanded position; and a bottom housing portion separably connected to the top housing portion, and including a latch mounted therein and an actuator connected to the latch, the latch being positioned within the bottom housing such that when the at least one movable housing element is moved to the retracted position, the latch engages the catch to retain the at least one movable housing element in the retracted position, the actuator being actuatable when the at least one movable housing element is retained in the retracted position to disengage the latch from the catch and release the at least one movable housing element, the top housing portion and the bottom housing portion each being shaped such that when the top housing portion and bottom housing portion are separably connected and when the at least one movable housing element is in the retracted position, the transformable toy is rollable along the playing surface about at least one rotational axis of the transformable toy, and when the at least one movable housing element is in the expanded position, the at least one movable housing element inhibits rolling of the transformable toy about the at least one rotational axis.

14. The transformable toy of claim 13, wherein the shape of the bottom housing portions is substantially hemispherical, and wherein the shape of the top housing portion is substantially hemispherical when the at least one movable housing element is in the retracted position.

15. The transformable toy of claim 13, wherein the at least one movable housing element is at least one top movable housing element;

wherein the bottom housing portion further includes at least one bottom movable housing element that is movable between a retracted position and an exposed position, the at least one bottom movable housing element being biased towards the exposed position and being operatively connected to the latch such that when the latch engages the catch of the top movable housing element, the at least one bottom movable housing element is retained in the retracted position; and wherein an actuation of actuator for disengaging the latch from the catch will also release the at least one bottom movable housing element.

16. A transformable toy for use on a toy playing surface, the transformable toy comprising:

a toy housing;

a shaft assembly including a shaft rotatably mounted along a central axis of the toy housing and a flywheel mounted to the shaft, the shaft defining a spinning axis of the transformable toy and the flywheel being chargeable to drive a spinning motion of the transformable toy about the spinning axis such that the transformable toy is in a spinning orientation;

an access aperture for charging the flywheel, at least one movable housing element that is movable between a retracted position and an expanded position, the at least one movable housing element including a catch and being biased towards the expanded position;

a latch being positioned within the toy housing such that when the at least one movable housing element is moved to the retracted position, the latch engages the catch to retain the at least one movable housing element in the retracted position; and an actuator connected to the latch and including an interaction element, the actuator being actuatable, when the at least one movable housing element is retained in the retracted position, to disengage the latch from the catch and release the at least one movable housing element, the actuator being positioned within the toy housing such that when the transformable toy is spinning at or below a set speed, the transformable toy will tip from the spinning orientation such that the interaction element of the actuator interacts with at least a portion of the toy playing surface and drives an actuation of the actuator.

17. The transformable toy of claim 16, wherein the shaft is rotatably mounted within the toy housing such that an end of the shaft extends through the toy housing to define a spin point on which the transformable toy spins about the spinning axis.

18. The transformable toy of claim 16, wherein the toy housing includes a weighted section that is disposed eccentrically about the spinning axis of the toy housing, the weighted section being relatively positioned within the toy housing such that when the transformable toy is spinning about the spinning axis at or below the set speed, the transformable toy will tip from the spinning orientation such that the spinning motion of the transformable toy is stopped, and such that the interaction element of the actuator interacts with the at least a portion of the toy playing surface.

19. The transformable toy of claim 16, wherein the toy housing includes a spin point formed on a bottom extent of the toy housing, the spin point being positioned on the toy housing such that it intersects a central axis of the transformable toy and that the central axis of the transformable toy defines the spinning axis of the transformable toy.

20. The transformable toy of claim 16, wherein the actuator includes a pivot member with free first and second ends, the pivot member being pivotally mounted within the toy housing, wherein the free first end of pivot member includes the latch and the free second end of the pivot member includes the interaction element.

21. The transformable toy of claim 16, wherein the interaction element is a magnet.

22. The transformable toy of claim 16, wherein the at least a portion of the toy playing surface is a magnetic portion of the toy playing surface.

23. The transformable toy of claim 16, wherein the actuator includes at least one movable weight that is movable between an inner radial position and an outer radial position relative to the spinning axis of the transformable toy, the at least one movable weight being connected within the toy housing such that when the transformable toy is spinning at or below the set speed the sliding weight will be in the inner radial position, and when the transformable toy is spinning above the set speed the at least one movable weight will be in the outer radial position.

24. The transformable toy of claim 23, wherein when the at least one movable weight is in the inner radial position and when the at least one movable housing element is retained in the retracted position, the latch will disengage from the catch and release the at least one movable housing element.

* * * * *